US008815479B2

(12) United States Patent
Shida et al.

(10) Patent No.: US 8,815,479 B2
(45) Date of Patent: Aug. 26, 2014

(54) ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

(75) Inventors: Kazuhisa Shida, Mishima (JP); Atsushi Okuda, Yokohama (JP); Kazunori Noguchi, Suntou-gun (JP); Takashi Anezaki, Hiratsuka (JP); Harunobu Ogaki, Suntou-gun (JP); Shio Murai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/879,344

(22) PCT Filed: Oct. 25, 2011

(86) PCT No.: PCT/JP2011/075019
§ 371 (c)(1),
(2), (4) Date: Apr. 12, 2013

(87) PCT Pub. No.: WO2012/057349
PCT Pub. Date: May 3, 2012

(65) Prior Publication Data

US 2013/0202326 A1 Aug. 8, 2013

(30) Foreign Application Priority Data

Oct. 29, 2010 (JP) ..... 2010-244360
May 30, 2011 (JP) ..... 2011-120704

(51) Int. Cl.
*G03G 5/147* (2006.01)
*G03G 5/05* (2006.01)
*G03G 5/06* (2006.01)
*G03G 5/047* (2006.01)

(52) U.S. Cl.
CPC ..... *G03G 5/047* (2013.01); *G03G 5/14756* (2013.01); *G03G 5/0614* (2013.01); *G03G 5/0564* (2013.01); *G03G 5/14773* (2013.01); *G03G 5/0589* (2013.01); *G03G 5/0578* (2013.01); *G03G 5/056* (2013.01); *G03G 5/14752* (2013.01); *G03G 5/14786* (2013.01)
USPC ..... 430/58.5; 430/58.8; 430/58.85; 430/59.6; 430/133; 399/159; 399/111

(58) Field of Classification Search
CPC ..... G03G 5/0578; G03G 5/0589
USPC ..... 430/59.6, 58.85, 58.8, 58.5, 133; 399/111, 159
See application file for complete search history.

(56) References Cited

U.S. PATENT DOCUMENTS

| | | | | |
|---|---|---|---|---|
| 6,165,662 | A | 12/2000 | Kato et al. | |
| 6,991,881 | B2 | 1/2006 | Ogaki et al. | |
| 6,994,941 | B2 | 2/2006 | Tanaka et al. | |
| 7,001,699 | B2 | 2/2006 | Tanaka et al. | |
| 7,045,261 | B2 | 5/2006 | Tanaka et al. | |
| 7,171,142 | B2 | 1/2007 | Kawakami et al. | |
| 7,413,840 | B1 | 8/2008 | Ogaki et al. | |
| 7,551,878 | B2 | 6/2009 | Ogaki et al. | |
| 7,553,594 | B2 | 6/2009 | Ogaki et al. | |
| 7,585,604 | B2 | 9/2009 | Ogaki et al. | |
| 7,622,238 | B2 | 11/2009 | Uematsu et al. | |
| 7,629,102 | B2 | 12/2009 | Ochi et al. | |
| 7,645,547 | B2 | 1/2010 | Okuda et al. | |
| 7,655,370 | B2 | 2/2010 | Kitamura et al. | |
| 7,704,657 | B2 | 4/2010 | Uesugi et al. | |
| 7,718,331 | B2 | 5/2010 | Uematsu et al. | |
| 7,749,667 | B2 | 7/2010 | Kawahara et al. | |
| 7,799,496 | B2 | 9/2010 | Uesugi et al. | |
| 7,838,190 | B2 | 11/2010 | Ogaki et al. | |
| 7,875,410 | B2 | 1/2011 | Ogaki et al. | |
| 7,901,855 | B2 | 3/2011 | Ogaki et al. | |
| 7,927,774 | B2 | 4/2011 | Ogaki et al. | |
| 7,931,848 | B2 | 4/2011 | Ochi et al. | |
| 8,455,170 | B2 | 6/2013 | Nakamura et al. | |
| 8,457,528 | B2 | 6/2013 | Ochi et al. | |
| 8,632,935 | B2 * | 1/2014 | Sugiyama et al. | 430/132 |
| 2010/0015541 | A1 * | 1/2010 | Ogawa | 430/59.6 |
| 2010/0047704 | A1 * | 2/2010 | Tajima et al. | 430/59.6 |
| 2010/0092208 | A1 * | 4/2010 | Ogaki et al. | 399/111 |
| 2011/0158683 | A1 | 6/2011 | Okuda et al. | |

(Continued)

FOREIGN PATENT DOCUMENTS

| | | | |
|---|---|---|---|
| JP | 7-261440 | A | 10/1995 |
| JP | 2000-171989 | A | 6/2000 |

(Continued)

OTHER PUBLICATIONS

English language machine translation of JP 2002-128883 (May 2002).*
English language machine translation of JP 2010-126652 (Jun. 2010).*
PCT International Search Report and Written Opinion of the International Searching Authority, International Application No. PCT/JP2011/075019, Mailing Date Jan. 17, 2012.
Sekiya, et al., U.S. Appl. No. 13/930,341, filed Jun. 28, 2013.
Okuda, et al., U.S. Appl. No. 13/930,383, filed Jun. 28, 2013.
Kaku, et al., U.S. Appl. No. 13/930,368, filed Jun. 28, 2013.

*Primary Examiner* — Christopher Rodee
(74) *Attorney, Agent, or Firm* — Fitzpatrick, Cella, Harper and Scinto

(57) ABSTRACT

An electrophotographic photosensitive member comprises a charge-transporting layer which is a surface layer of the electrophotographic photosensitive member; wherein the charge-transporting layer has a matrix-domain structure having: a matrix comprising a component [β] and a component [γ] (charge-transporting substances having specific structures), and a domain comprising a component [α](resin [α1], or resin [α1] and resin [α2]).

6 Claims, 1 Drawing Sheet

(56) References Cited

U.S. PATENT DOCUMENTS

| | | | | |
|---|---|---|---|---|
| 2011/0177438 | A1* | 7/2011 | Noguchi et al. | 430/58.2 |
| 2012/0114375 | A1 | 5/2012 | Fujii et al. | |
| 2012/0301181 | A1* | 11/2012 | Ogaki et al. | 399/111 |
| 2012/0301182 | A1* | 11/2012 | Anezaki et al. | 399/111 |
| 2013/0202327 | A1 | 8/2013 | Murai et al. | |
| 2013/0221560 | A1 | 8/2013 | Kawai et al. | |
| 2013/0236823 | A1 | 9/2013 | Noguchi et al. | |

FOREIGN PATENT DOCUMENTS

| | | | | |
|---|---|---|---|---|
| JP | 2002-128883 | A | | 5/2002 |
| JP | 2007-79555 | A | | 3/2007 |
| JP | 2009-37229 | A | | 2/2009 |
| JP | 2010126652 | A | * | 6/2010 |
| WO | 2010/008095 | A1 | | 1/2010 |

* cited by examiner

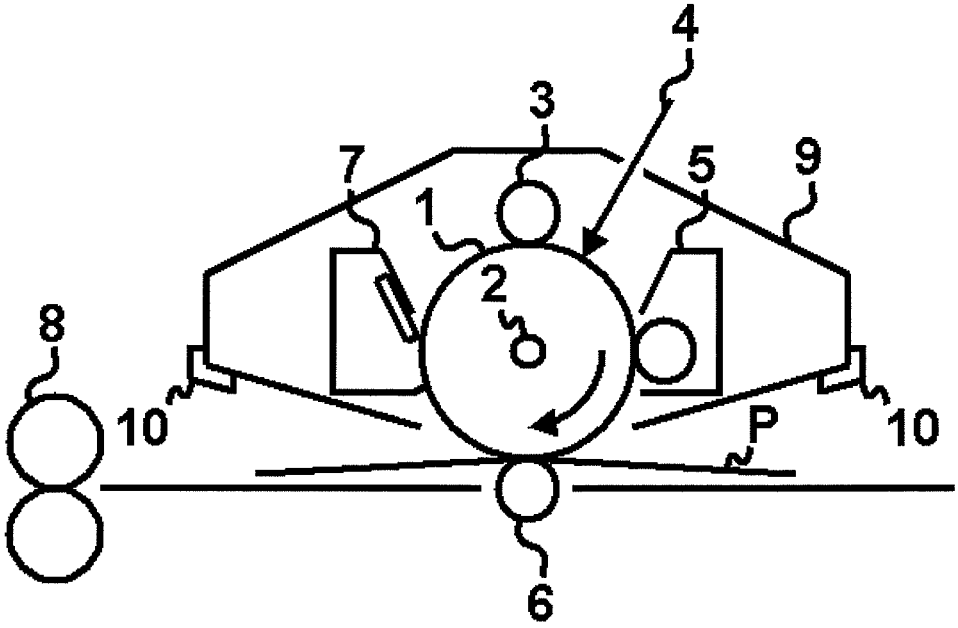
4
3
7
5
9
1
2
8
10
10
P
6

ELECTROPHOTOGRAPHIC PHOTOSENSITIVE MEMBER, PROCESS CARTRIDGE, ELECTROPHOTOGRAPHIC APPARATUS, AND METHOD OF MANUFACTURING ELECTROPHOTOGRAPHIC PHOTOSENSITIVE MEMBER

TECHNICAL FIELD

The present invention relates to an electrophotographic photosensitive member, a process cartridge, an electrophotographic apparatus, and a method of manufacturing an electrophotographic photosensitive member.

BACKGROUND ART

An organic electrophotographic photosensitive member (hereinafter, referred to as "electrophotographic photosensitive member") containing an organic photoconductive substance (charge-generating substance) is known as an electrophotographic photosensitive member mounted on an electrophotographic apparatus. In an electrophotographic process, a variety of members such as a developer, a charging member, a cleaning blade, paper, and a transferring member (hereinafter, also referred to as "contact member or the like") have contact with the surface of the electrophotographic photosensitive member. Therefore, the electrophotographic photosensitive member is required to reduce generation of image deterioration due to contact stress with such contact member or the like. In particular, in recent years, the electrophotographic photosensitive member is required to have a sustained effect of reducing the image deterioration due to contact stress with improvement of durability of the electrophotographic photosensitive member.

For sustained reduction of contact stress, PTL 1 has proposed a method of forming a matrix-domain structure in the surface layer using a siloxane resin obtained by integrating a siloxane structure into a molecular chain. In particular, the literature shows that use of a polyester resin integrated with a specific siloxane structure can achieve an excellent balance between sustained reduction of contact stress and potential stability (suppression of variation) in repeated use of the electrophotographic photosensitive member.

On the other hand, there has been proposed a technology for adding a siloxane-modified resin having a siloxane structure in its molecular chain to a surface layer of an electrophotographic photosensitive member. PTL 2 and PTL 3 have each proposed an electrophotographic photosensitive member containing a polycarbonate resin integrated with a siloxane structure having a specific structure, and effects such as a prolonged life based on improvements in sliding property, cleaning property, and mar resistance.

CITATION LIST

Patent Literature

PTL 1: International Patent WO 2010/008095A

PTL 2: Japanese Patent Application Laid-Open No. H07-261440

PTL 3: Japanese Patent Application Laid-Open No. 2000-171989

PTL 4: Japanese Patent Application Laid-Open No. 2007-79555

PTL 5: Japanese Patent Application Laid-Open No. 2009-37229

PTL 6: Japanese Patent Application Laid-Open No. 2002-128883

SUMMARY OF INVENTION

Technical Problem

The electrophotographic photosensitive member disclosed in PTL 1 has an excellent balance between sustained reduction of contact stress and potential stability in repeated use. However, the inventors of the present invention have made studies, and as a result, the inventors have found that, in the case of using a charge-transporting substance having a specific structure, the potential stability in repeated use can further be improved.

PTL 2 discloses that an electrophotographic photosensitive member having a surface layer formed of a mixture of a resin integrated with a siloxane structure having a specific structure and a polycarbonate resin having no siloxane structure is used to improve sliding property, abrasion resistance, and film strength and to prevent a solvent crack. However, in PTL 2, a sustained reduction of contact stress is insufficient.

Meanwhile, PTL 3 discloses that an electrophotographic photosensitive member containing a resin integrated with a siloxane structure is used to have an excellent balance between potential stability and abrasion resistance. However, in PTL 3, a resin integrated with a siloxane structure and a resin having no siloxane structure are mixed, but a sustained reduction of contact stress is insufficient. In the electrophotographic photosensitive members disclosed in PTL 2 and PTL 3, a balance between a sustained reduction of contact stress and potential stability in repeated use cannot be achieved.

An object of the present invention is to provide an electrophotographic photosensitive member containing a specific charge-transporting substance, which has an excellent balance between sustained reduction of contact stress with a contact member or the like and potential stability in repeated use. Another object of the present invention is to provide a process cartridge having the electrophotographic photosensitive member and an electrophotographic apparatus having the electrophotographic photosensitive member. A further object of the present invention is to provide a method of manufacturing the electrophotographic photosensitive member.

Solution to Problem

The above-mentioned objects are achieved by the following present invention.

An electrophotographic photosensitive member, comprising: a conductive support, a charge-generating layer which is provided on the conductive support and comprises a charge-generating substance, and a charge-transporting layer which is provided on the charge-generating layer and is a surface layer of the electrophotographic photosensitive member; wherein the charge-transporting layer comprises a resin having a siloxane moiety at the end one or both ends, and has a matrix-domain structure having: a domain which comprises the component $\alpha$; and a matrix which comprises the component $\beta$ and the component $\gamma$; wherein the content of the component $\alpha$ is not less than 60% by mass and not more than 100% by mass relative to the total mass of the resin having a siloxane moiety at the end one or both ends in the charge-transporting layer; wherein the component $\alpha$ consists of a resin $\alpha1$, or the resin $\alpha1$ and a resin $\alpha2$, and the content of the resin $\alpha1$ is not less than 0.1% by mass and not more than 100% by mass relative to the total mass of the component α; wherein the resin α1 is at least one resin selected from the group consisting of a resin having a structure represented by the following formula (B), and a resin having a structure represented by the following formula (C), and the content of a siloxane moiety in the resin α1 is not less than 5% by mass and not more than 30% by mass relative to the total mass of the resin α1:

(B)

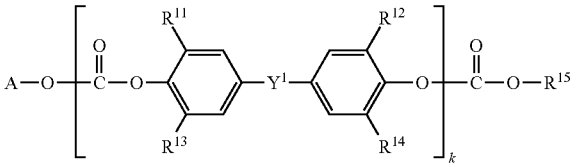

wherein, in the formula (B), $R^{11}$ to $R^{14}$ each independently represents a hydrogen atom, or a methyl group, $R^{15}$ represents a structure represented by the following formula (R15-1) or (R15-2), $Y^1$ represents a single bond, a methylene group, an ethylidene group, a propylidene group, a phenylethylidene group, a cyclohexylidene group, or an oxygen atom, "k" represents number of repetitions of a structure within the brackets, "A" represents a structure represented by the following formula (A);

(R15-1)

(R15-2)

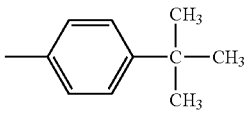

(C)

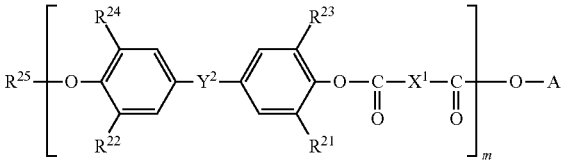

wherein, in the formula (C), $R^{21}$ to $R^{24}$ each independently represents a hydrogen atom, or a methyl group, $R^{25}$ represents a structure represented by the following formula (R25-1), (R25-2), or (R25-3), $X^1$ and $X^2$ each independently represents a meta-phenylene group, a para-phenylene group, or a bivalent group having two para-phenylene groups bonded with an oxygen atom, $Y^2$ represents a single bond, a methylene group, an ethylidene group, a propylidene group, a cyclohexylidene group, or an oxygen atom, "m" represents number of repetitions of a structure within the brackets, "A" represents a structure represented by the following formula (A):

(R25-1)

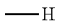

(R25-2)

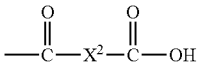

(R25-3)

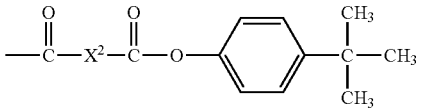

(A)

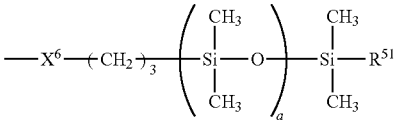

wherein, the formula (A), $R^{51}$ represents an alkyl group having 1 to 4 carbon atoms, $X^6$ represents a phenylene group or a structure represented by the following formula (A2), "a" in the formula (A) and "b" in the formula (A2) each represents number of repetitions of a structure within the brackets, an average of "a" in the resin α1 or the resin α2 ranges from 10 to 400, an average of "b" in the resin [α1] or the resin [α2] ranges from 1 to 10;

(A2)

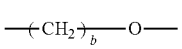

wherein the resin α2 is at least one resin selected from the group consisting of a resin having a structure represented by the following formula (D), and a resin having a structure represented by the following formula (E), and the content of a siloxane moiety in the resin α2 is not less than 5% by mass and not more than 60% by mass relative to the total mass of the resin α2;

(D)

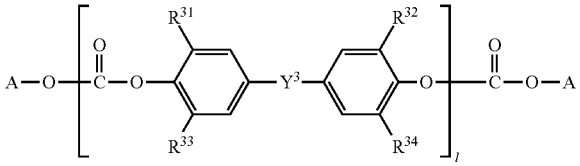

wherein, in the formula (D), $R^{31}$ to $R^{34}$ each independently represents a hydrogen atom, or a methyl group, $Y^3$ represents a single bond, a methylene group, an ethylidene group, a propylidene group, a phenylethylidene group, a cyclohexylidene group, or an oxygen atom, "l" represents number of repetitions of a structure within the brackets, "A" represents a structure represented by the formula (A);

(E)

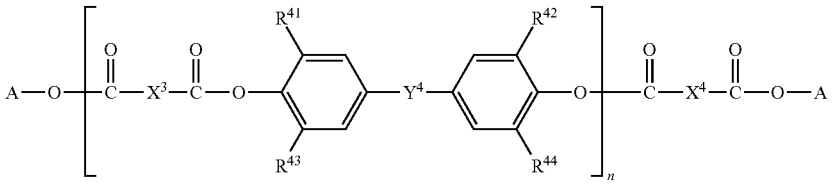

wherein, in the formula (E), $R^{41}$ to $R^{44}$ each independently represents a hydrogen atom, or a methyl group, $X^3$ and $X^4$ each independently represents a meta-phenylene group, a para-phenylene group, or a bivalent group having two para-phenylene groups bonded with an oxygen atom, $Y^4$ represents a single bond, a methylene group, an ethylidene group, a propylidene group, a cyclohexylidene group, or an oxygen atom, "n" represents number of repetitions of a structure within the brackets, "A" represents a structure represented by the formula (A):

wherein the component β is the at least one resin selected from the group consisting of a polycarbonate resin F having a repeating structural unit represented by the following formula (F) and a polyester resin G having a repeating structural unit represented by the following formula (G):

(F)

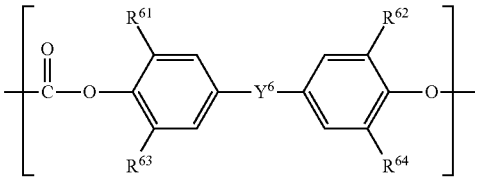

wherein, in the formula (F), $R^{61}$ to $R^{64}$ each independently represents a hydrogen atom, or a methyl group, $Y^6$ represents a single bond, a methylene group, an ethylidene group, a propylidene group, a phenylethylidene group, a cyclohexylidene group, or an oxygen atom;

(G)

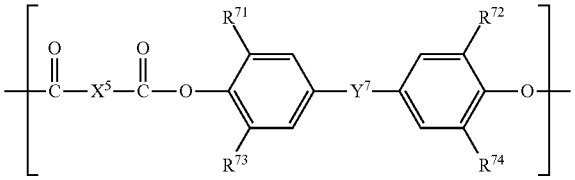

wherein, in the formula (G), $R^{71}$ to $R^{74}$ each independently represent a hydrogen atom, or a methyl group, $X^5$ represents a meta-phenylene group, a para-phenylene group, or a bivalent group having two para-phenylene groups bonded with an oxygen atom, $Y^7$ represents a single bond, a methylene group, an ethylidene group, a propylidene group, a cyclohexylidene group, or an oxygen atom; wherein the component γ is at least one charge-transporting substance selected from the group consisting of a compound represented by the following formula (1), a compound represented by the following formula (1'), a compound represented by the following formula (2) and a compound represented by the following formula (2');

(1)

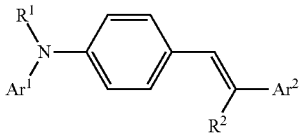

(1')

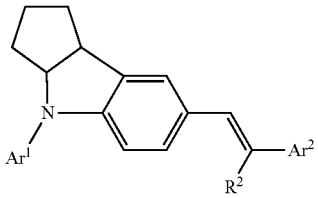

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group; and (2)

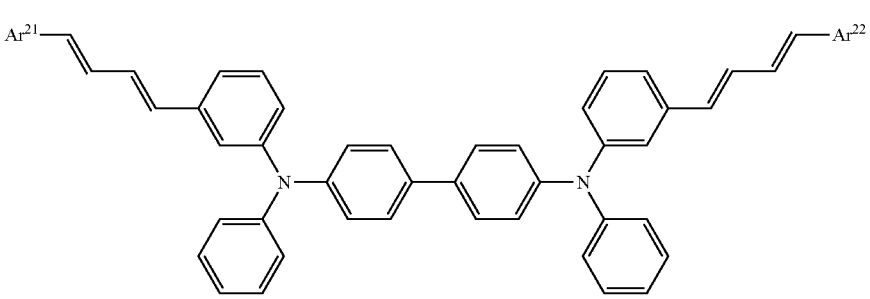

-continued

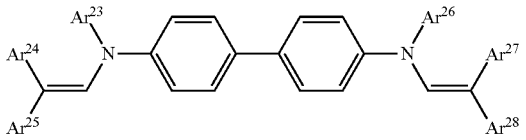

(2')

wherein, in the formulae (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

The present invention also relates to a process cartridge detachably attachable to a main body of an electrophotographic apparatus, wherein the process cartridge integrally supports: the electrophotographic photosensitive member; and at least one device selected from the group consisting of a charging device, a developing device, a transferring device, and a cleaning device.

The present invention also relates to an electrophotographic apparatus, comprising: the electrophotographic photosensitive member; a charging device; an exposing device; a developing device; and a transferring device.

The present invention also relates to a method of manufacturing the electrophotographic photosensitive member, wherein the method comprises a step of forming the charge-transporting layer by applying a charge-transporting-layer coating solution on the charge-generating layer and drying the coating solution, and wherein the charge-transporting-layer coating solution comprises the component α, the component β and the component γ.

Advantageous Effects of Invention

According to the present invention, it is possible to provide the electrophotographic photosensitive member containing a specific charge-transporting substance, which has an excellent balance between sustained reduction of contact stress with a contact member or the like and potential stability in repeated use. Moreover, according to the present invention, it is also possible to provide the process cartridge having the electrophotographic photosensitive member and the electrophotographic apparatus having the electrophotographic photosensitive member. Further, according to the present invention, it is also possible to provide the method of manufacturing the electrophotographic photosensitive member.

Further features of the present invention will become apparent from the following description of exemplary embodiments with reference to the attached drawings.

BRIEF DESCRIPTION OF DRAWING

FIG. 1 is a diagram that schematically shows the construction of an electrophotographic apparatus including a process cartridge having an electrophotographic photosensitive member of the present invention.

DESCRIPTION OF EMBODIMENTS

As described above, an electrophotographic photosensitive member of the present invention includes: a conductive support, a charge-generating layer which is provided on the conductive support and comprises a charge-generating substance, and a charge-transporting layer which is provided on the charge-generating layer and is a surface layer of the electrophotographic photosensitive member, in which the charge-transporting layer has a matrix-domain structure having: a matrix which includes a component [β] and a component [γ]; and a domain which includes a component [α].

When the matrix-domain structure of the present invention is compared to a "sea-island structure," the matrix corresponds to the sea, and the domain corresponds to the island. The domain including the component [α] has a granular (island-like) structure formed in the matrix including the components [β] and [γ]. The domain including the component [α] is present in the matrix as an independent domain. Such matrix-domain structure can be confirmed by observing the surface of the charge-transporting layer or the cross-sectional surface of the charge-transporting layer.

Observation of a state of the matrix-domain structure or determination of the domain structure can be performed by using, for example, a commercially available laser microscope, a light microscope, an electron microscope, or an atomic force microscope. Observation of the state of the matrix-domain structure or determination of the domain structure can be performed by using any of the above-mentioned microscopes at a predetermined magnification.

The number average particle size of the domain including the component [α] in the present invention is preferably not less than 100 nm and not more than 1,000 nm. Further, the particle size distribution of the particle sizes of each domain is preferably narrow from the viewpoint of sustained effect of reducing contact stress. The number average particle size in the present invention is determined by arbitrarily selecting 100 of domains confirmed by observing the cross-sectional surface obtained by vertically cutting the charge-transporting layer of the present invention by the above-mentioned microscope. Then, the maximum diameters of the respective selected domains are measured and averaged to calculate the number average particle size of each domain. It should be noted that if the cross-sectional surface of the charge-transporting layer is observed by the microscope, image information in a depth direction can be obtained to provide a three-dimensional image of the charge-transporting layer.

The matrix-domain structure of the charge-transporting layer in the electrophotographic photosensitive member of the present invention can be formed by using a charge-transporting-layer coating solution which contains the components [α], [β], and [γ]. In addition, the electrophotographic photosensitive member of the present invention can be manufactured by applying the charge-transporting-layer coating solution on the charge-generating layer and drying the coating solution.

The matrix-domain structure of the present invention is a structure in which the domain including the component [α] is formed in the matrix including the components [β] and [γ]. It is considered that the effect of reducing contact stress is sustainably exerted by forming the domain including the component [α] not only on the surface of the charge-transporting layer but also in the charge-transporting layer. Specifically, this is probably because the siloxane resin component having an effect of reducing contact stress, which is reduced by a friction of a member such as paper or a cleaning blade, can be supplied from the domain in the charge-transporting layer.

The inventors of the present invention have found that, in the case where a charge-transporting substance having a specific structure is used as the charge-transporting substance, the potential stability in repeated use may further be improved. Further, the inventors have estimated the reason of further enhancement of the potential stability in repeated use in an electrophotographic photosensitive member containing the specific charge-transporting substance (the component [γ]) of the present invention, as follows.

In the electrophotographic photosensitive member including the charge-transporting layer having the matrix-domain structure of the present invention, it is important to reduce the charge-transporting substance content in the domain of the formed matrix-domain structure as much as possible for suppressing a potential variation in repeated use. In the case where compatibility between the charge-transporting substance and a resin integrated with the siloxane structure which forms the domain is high, the charge-transporting substance content in the domain becomes high, and charges are captured in the charge-transporting substance in the domain in repeated use of the photosensitive member, resulting in insufficient potential stability.

In order to achieve an excellent balance between potential stability in repeated use and sustained reduction of contact stress in the electrophotographic photosensitive member containing the charge-transporting substance having a specific structure, it is necessary to improve the property by a resin integrated with the siloxane structure. The component [γ] in the present invention is a charge-transporting substance having high compatibility with the resin in the charge-transporting layer, and aggregates of the component [γ] may be easy to form because the component [γ] is contained in a large amount in the domain including the siloxane-containing resin.

In the present invention, excellent charge-transporting ability can be maintained by forming a domain including the component [α] of the present invention in the electrophotographic photosensitive member including the component [γ]. This is probably because the content of the component [γ] in the domain is reduced by forming the domain including the component [α]. This is probably because a structure of a resin [α1] contained in the component [α] that has a siloxane moiety at an end or both ends can suppress remaining of the component [γ] having a structure compatible with the resin in the domain.

Further, in the present invention, when the component [α] consists of the resin [α1], or the resin [α1] and the resin [α2] at a content of 0.1% by mass or more to 100% by mass or less relative to the total mass of the resin in the component [α], a stable matrix-domain structure is present inside the charge-transporting layer.

<Component [γ]>

The component [γ] of the present invention is at least one charge-transporting substance selected from the group consisting of a compound represented by the following formula (1), a compound represented by the following formula (1'), a compound represented by the following formula (2), and a compound represented by the following formula (2').

(1)

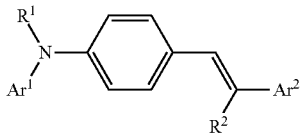

(1')

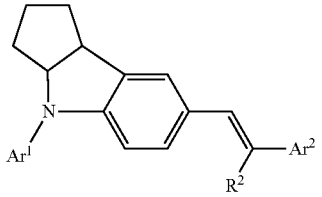

In the formulae (1) and (1'), $Ar^1$ represents a phenyl group or a phenyl group substituted with a methyl group or an ethyl group. $Ar^2$ represents a phenyl group, a phenyl group substituted with a methyl group, a phenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), or a biphenyl group substituted with an univalent group represented by the formula "—CH═CH—Ta". $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group). $R^2$ represents a hydrogen atom, a phenyl group, or a phenyl group substituted with a methyl group.

(2)

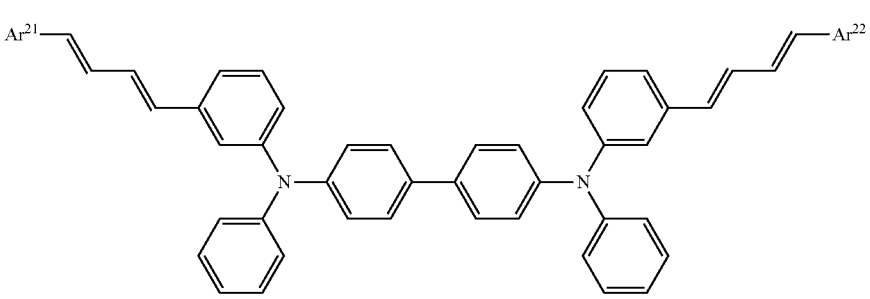

-continued (2')

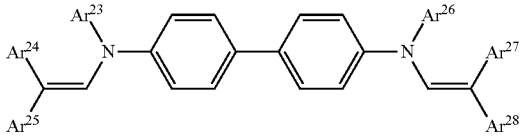

In the formula (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

Specific examples of the charge-transporting substance which is the component [γ] and has the structure represented by the above-mentioned formula (1), (1'), (2), or (2') are shown below.

(1-1)

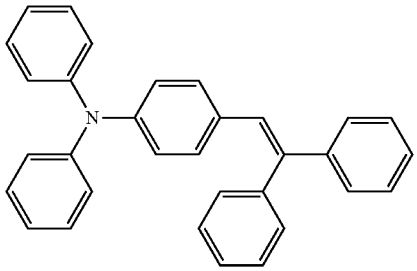

(1-2)

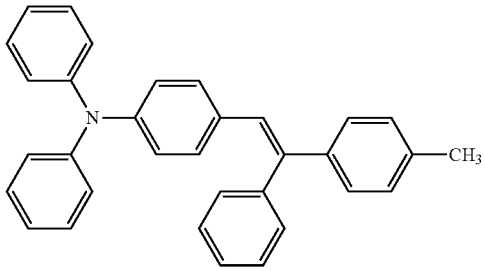

(1-3)

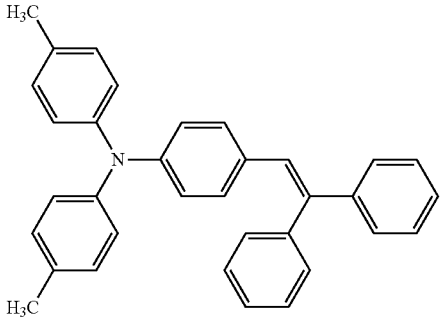

(1-4)

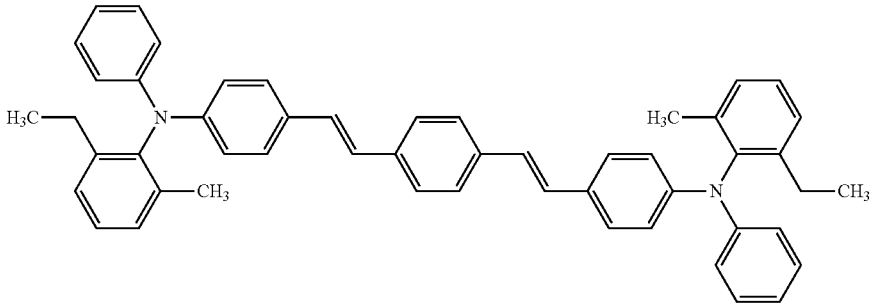

(1-5)

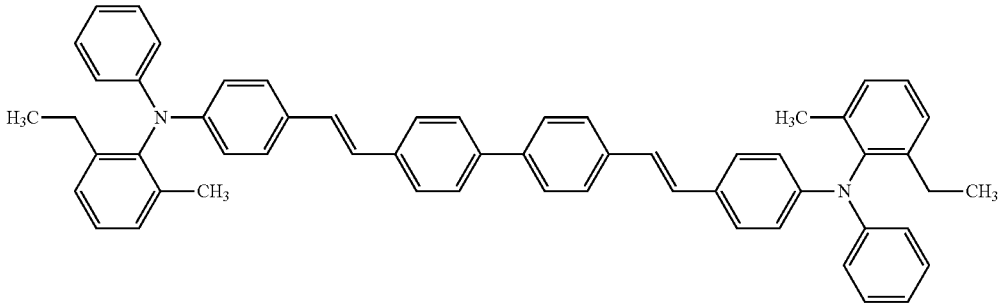

-continued
(1-6)
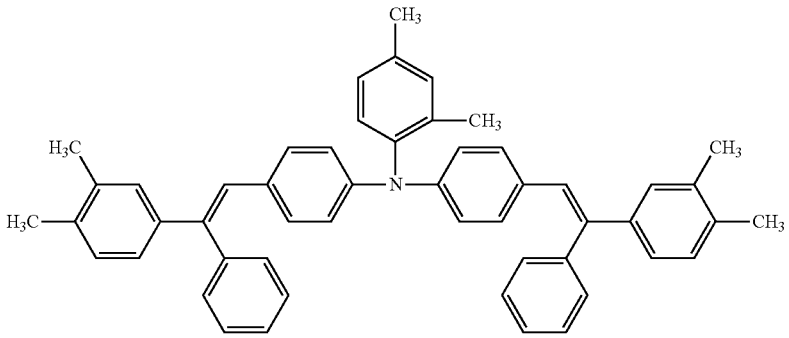
(1-7)
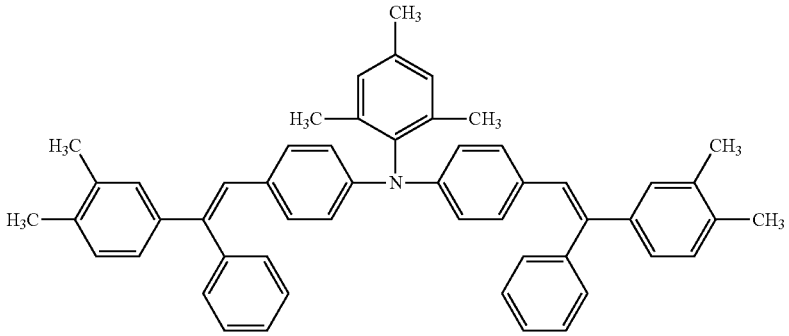
(1-8)
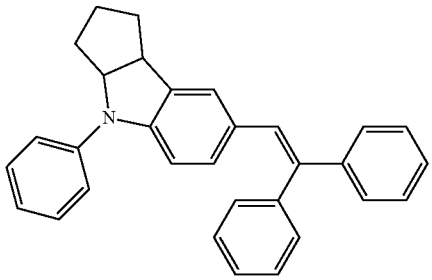
(1-9)
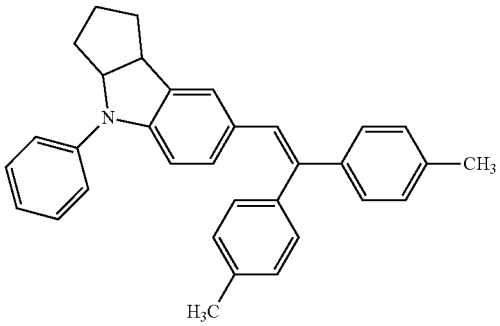
(1-10)
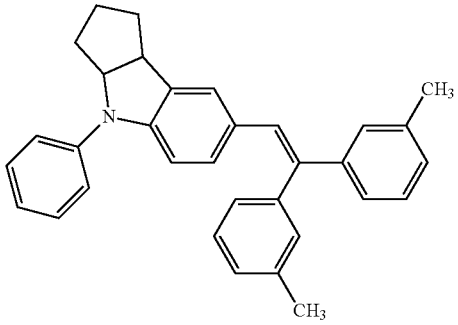
(1-11)
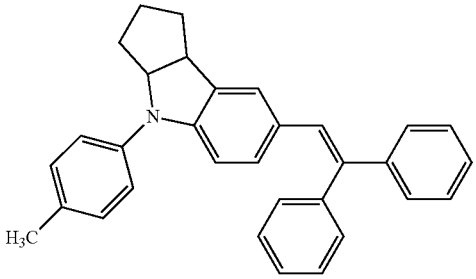

-continued
(2-1)
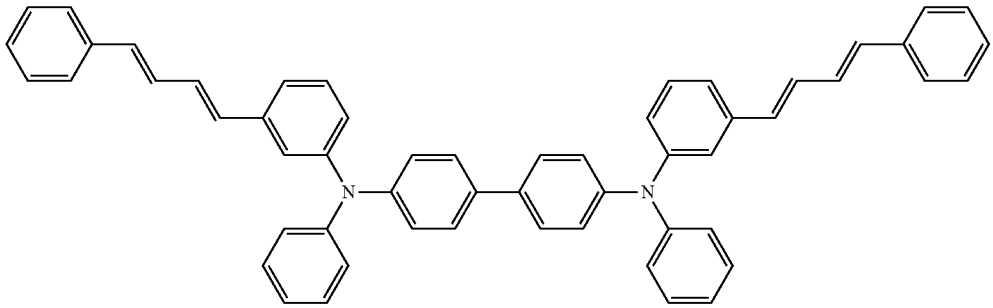
(2-2)
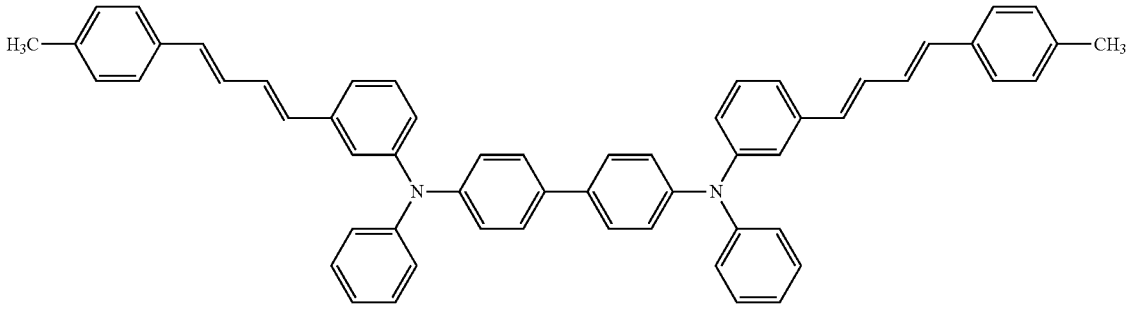
(2-3)
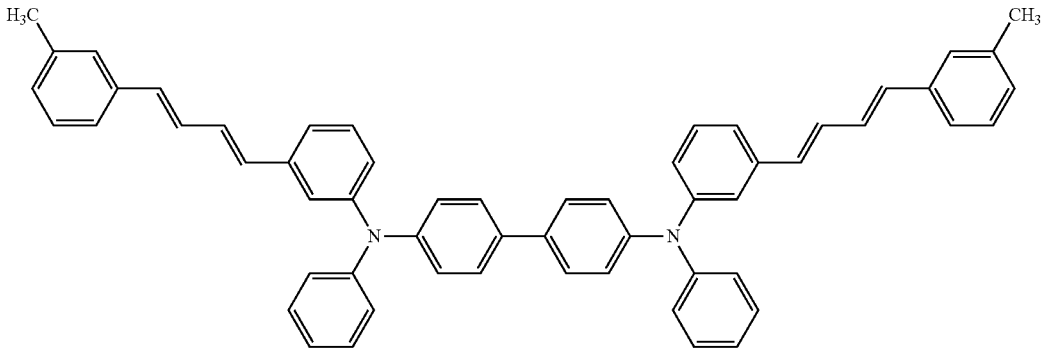
(2-4)
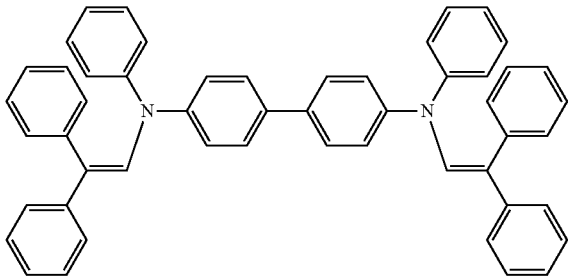
(2-5)
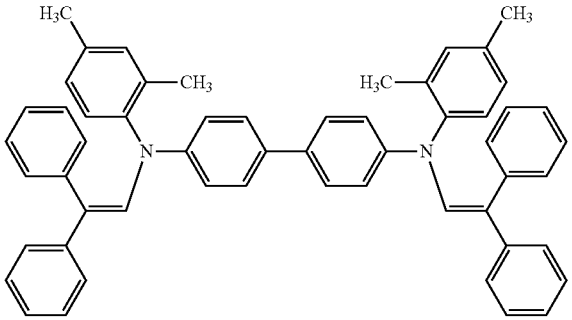

-continued (2-6)

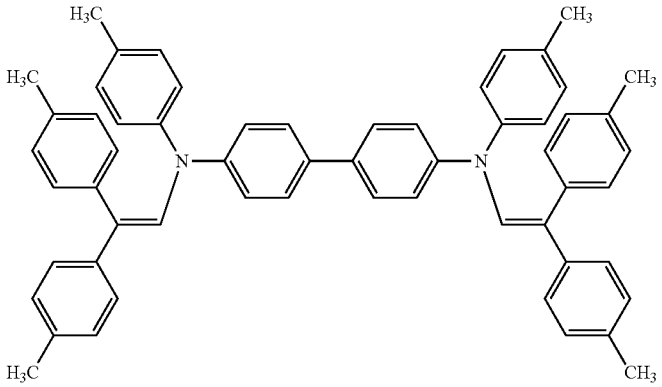

Of those, the component [γ] is preferably a charge-transporting substance having the structure represented by the above-mentioned formula (1-2), (1-3), (1-4), (1-5), (1-7), (1-8), (1-9), (2-1), or (2-5).

<Component [α]>

The component [α] consists of the resin [α1], or the resin [α1] and the resin [α2]. In addition, the content of the resin [α1] is 0.1% by mass or more to 100% by mass or less with respect to the total mass of the component [α].

The resin [α1] is at least one resin selected from the group consisting of a resin having a structure represented by the following formula (B), and a resin having a structure represented by the following formula (C), and the content of a siloxane moiety in the resin [α1] is 5% by mass or more to 30% by mass or less relative to the total mass of the resin [α1].

(B)

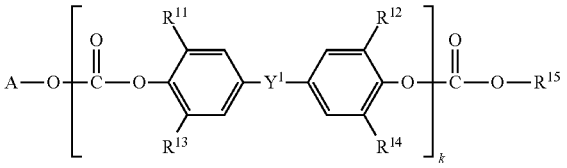

In the formula (B), $R^{11}$ to $R^{14}$ each independently represents a hydrogen atom, or a methyl group, $R^{15}$ represents a structure represented by the following formula (R15-1) or (R15-2), $Y^1$ represents a single bond, a methylene group, an ethylidene group, a propylidene group, a phenylethylidene group, a cyclohexylidene group, or an oxygen atom, "k" represents number of repetitions of a structure within the brackets, and "A" represents a structure represented by the following formula (A).

(R15-1)

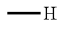

(R15-2)

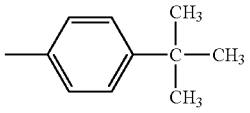

-continued (C)

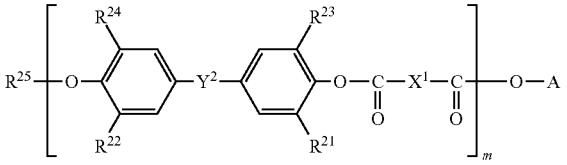

In the formula (C), $R^{21}$ to $R^{24}$ each independently represents a hydrogen atom, or a methyl group, $R^{25}$ represents a structure represented by the following formula (R25-1), (R25-2), or (R25-3), $X^1$ and $X^2$ each independently represents a meta-phenylene group, a para-phenylene group, or a bivalent group having two para-phenylene groups bonded with an oxygen atom, $Y^2$ represents a single bond, a methylene group, an ethylidene group, a propylidene group, a cyclohexylidene group, or an oxygen atom, "m" represents number of repetitions of a structure within the brackets, and "A" represents a structure represented by the following formula (A).

(R25-1)

(R25-2)

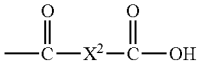

(R25-3)

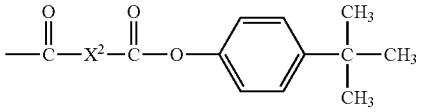

(A)

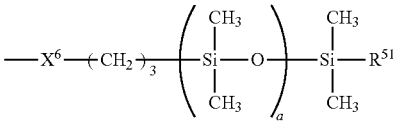

In the formula (A), $R^{51}$ represents an alkyl group having 1 to 4 carbon atoms, $X^6$ represents a phenylene group or a structure represented by the following formula (A2), "a" in the formula (A) and "b" in the formula (A2) each represents number of repetitions of a structure within the brackets, an average of "a" in the component [α] ranges from 10 to 400, and an average of "b" in the component [α] ranges from 1 to 10.

(A2)

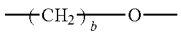

In the present invention, the domain contains the component [α]. In this case, the content of the resin [α1] is 0.1% by mass or more to 100% by mass or less with respect to the component [α]. When the domain contains the resin [α1] and the resin [α2], a stable matrix-domain structure may be present inside the charge-transporting layer, which is preferred from the viewpoint of an effect of relieving contact stress. This is probably because the resin [α1] has a siloxane structure at only one end of the resin, and hence has high migration property to the surface of the domain and has a function as a surfactant between the matrix and the domain or as a surface treatment material for the domain. The content is more preferably 1% by mass or more to 50% by mass or less, which leads to an excellent sustained effect of reducing contact stress.

The resin [α2] is at least one resin selected from the group consisting of a resin having a structure represented by the following formula (D), and a resin having a structure represented by the following formula (E), and the content of a siloxane moiety in the resin [α2] is 5% by mass or more to 60% by mass or less relative to the total mass of the resin [α2].

(D)

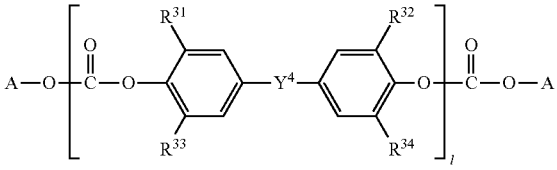

In the formula (D), $R^{31}$ to $R^{34}$ each independently represents a hydrogen atom, or a methyl group, $Y^3$ represents a single bond, a methylene group, an ethylidene group, a propylidene group, a phenylethylidene group, a cyclohexylidene group, or an oxygen atom, "l" represents number of repetitions of a structure within the brackets, and "A" represents a structure represented by the formula (A).

(E)

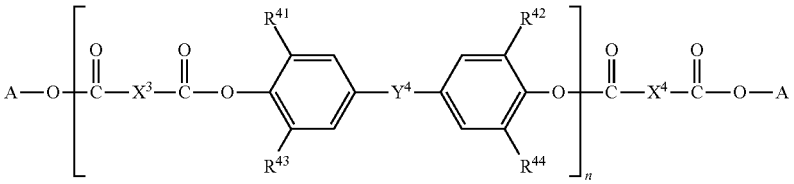

In the formula (E), $R^{41}$ to $R^{44}$ each independently represents a hydrogen atom, or a methyl group, $X^3$ and $X^4$ each independently represents a meta-phenylene group, a para-phenylene group, or a bivalent group having two para-phenylene groups bonded with an oxygen atom, $Y^4$ represents a single bond, a methylene group, an ethylidene group, a propylidene group, a cyclohexylidene group, or an oxygen atom, "n" represents number of repetitions of a structure within the brackets, and "A" represents a structure represented by the formula (A).

The resin [α1] having the structure represented by the formula (B) or the structure represented by the formula (C) is described. The resin [α1] is a resin having the structure represented by the formula (A) having the siloxane moiety at only one end of the resin. The respective repeating structural units in a structure within the brackets in the formula (B) or the formula (C) may have the same or different structures.

I"k" in the formula (B) and "m" in the formula (C) each independently represents number of repetitions of a structure within the brackets. An average of each of "k" and "m" in the resin [a1] is preferably 10 or more to 400 or less, and from the viewpoint of a balance between sustained reduction of contact stress and potential stability in repeated use, the average is preferably 15 or more to 300 or less. "k" and "m" each correlate with a weight-average molecular weight (hereinafter, referred to as "Mw"), and the Mw of the resin having the structure represented by the formula (B) is preferably 5,000 or more to 100,000 or less, and the Mw of the resin having the structure represented by the formula (C) is preferably 7,000 or more to 140,000 or less. "k" and "m" are independently adjusted by the weight-average molecular weights of the above-mentioned resins and the average of the number of repetitions "a" of the structure within the brackets in the formula (A).

In the present invention, the weight-average molecular weight of the resin is a weight-average molecular weight in terms of polystyrene measured according to a conventional method by a method described in PTL 4.

Specific examples of the repeating structural unit within the brackets in the structure represented by the formula (B) are shown below.

(B-1)

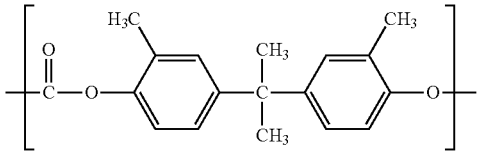

-continued (B-2)

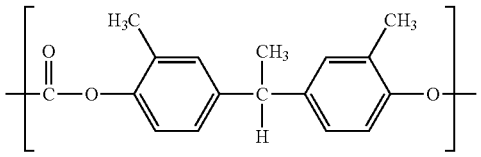

-continued
(B-3)
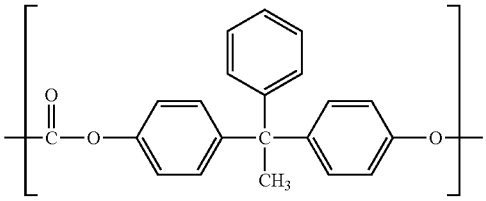
(B-4)
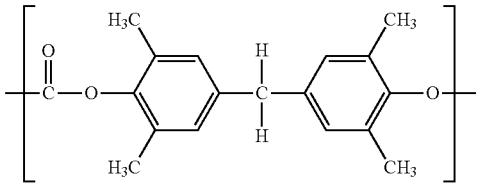
(B-5)
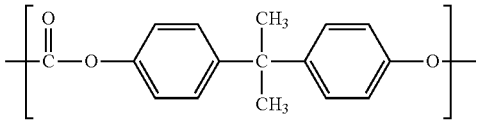
(B-6)
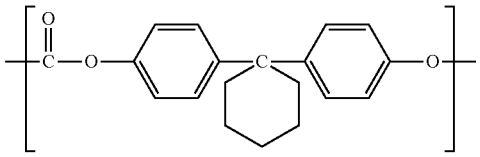
-continued
(B-7)
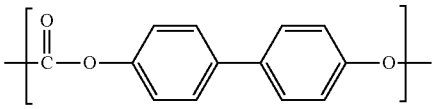
(B-8)
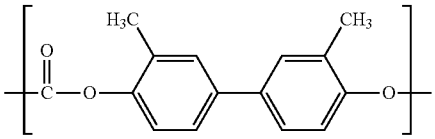
(B-9)
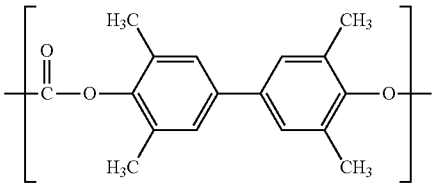
(B-10)
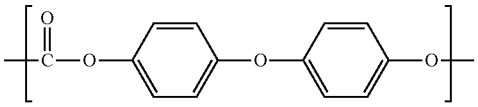
Of those, the structure represented by the formula (B-1), (B-2), (B-7), (B-8), (B-9), or (B-10) is preferred.
Specific examples of the repeating structural unit within the brackets in the structure represented by the formula (C) are shown below.
(C-1)
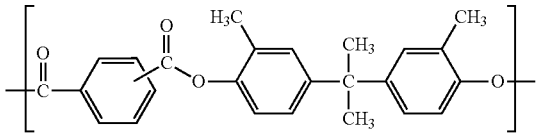
(C-2)
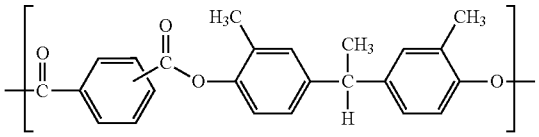
(C-3)
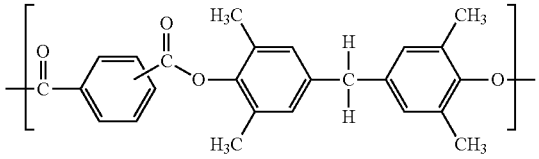
(C-4)
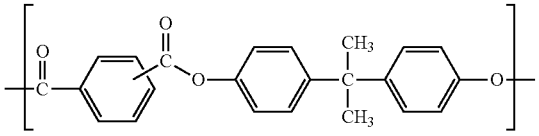
(C-5)
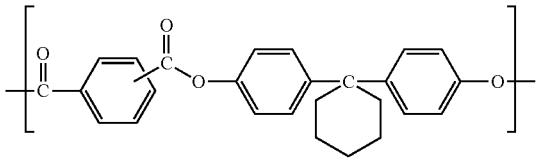
(C-6)
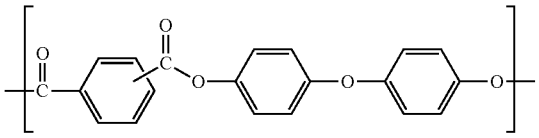
(C-7)
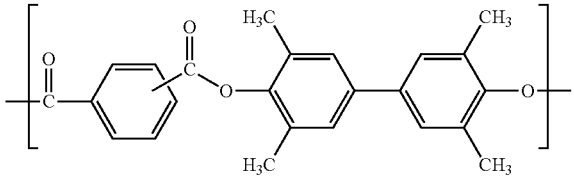

-continued (C-8)

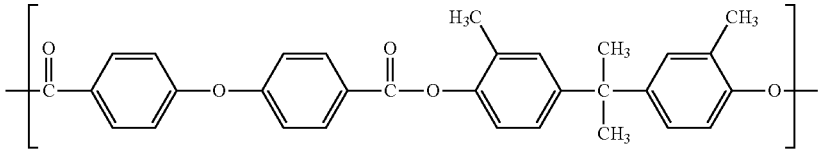

(C-9)

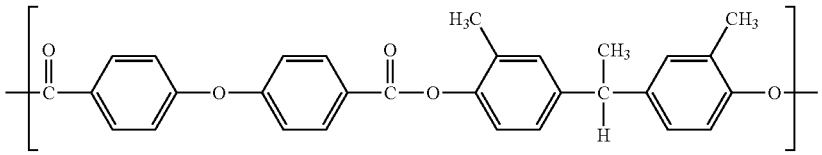

Of those, the structure represented by the formula (C-1), (C-2), (C-8), or (C-9) is preferred.

Next, "A" represented by the formula (B) or the formula (C) is described. "A" in the formula is represented by the following formula (A).

(A)

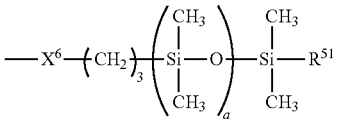

(A2)

In the formula (A), "a" represents number of repetitions of the structure within the brackets. The average of "a" in the resin α1 or the resin α2 is 10 or more to 400 or less. If the average of "a" is less than 10, a sustained effect of reducing contact stress is insufficient. Meanwhile, if the average of "a" exceeds 400, the sustained effect of reducing contact stress is insufficient because surface migration property of the resin having a siloxane moiety is enhanced, resulting in difficulty in forming the domain. Moreover, the number of repetitions "a" of the structure within the brackets in each structural unit is preferably in a range of ±10% of the value represented as the average of "a" because the effect of the present invention can be obtained stably.

$R^{51}$ in the formula (A) represents an alkyl group having 1 to 4 carbon atoms. Examples of the alkyl group having 1 to 4 carbon atoms include a methyl group, an ethyl group, a propyl group, and a butyl group. $X^6$ represents a phenylene group or a group represented by the formula (A2). The phenylene group is preferably a para-phenylene group. "b" in the formula (A2) represents number of repetitions of the structure within the brackets, and the average of "b" with respect to the resin α1 or the resin α2 is 1 or more to 10 or less. The difference between the maximum value and the minimum value of the number of repetitions "b" of the structure within the brackets in each repeating structural unit is 0 or more to 2 or less.

The resin [α1] having the structure represented by the formula (B) or the structure represented by the formula (C) in the present invention contains a siloxane moiety at a content of 5% by mass or more to 30% by mass or less with respect to the total mass of the resin [α1]. The content is more preferably 10% by mass or more to 30% by mass or less.

In the present invention, the siloxane moiety is a moiety which includes silicon atoms present at the both ends of the siloxane structure, groups bonded to the silicon atoms, and oxygen atoms, silicon atoms, and groups bonded to the atoms present between the silicon atoms present at the both ends. Specifically, for example, the siloxane moiety refers to the moiety surrounded by the dashed line in the structure represented by the following formula (B-S) or the following formula (C-S).

(B-S)

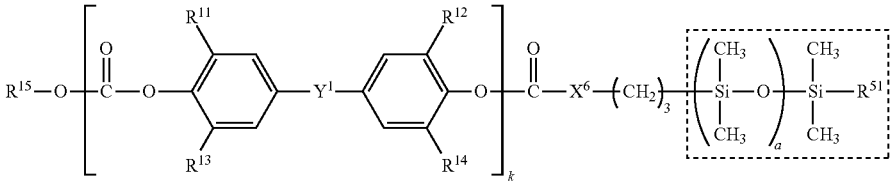

(C-S)

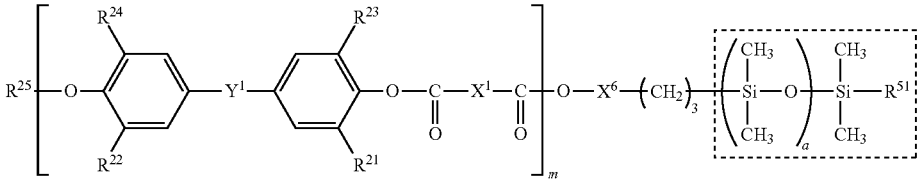

That is, the structural formula shown below represents the siloxane moiety.

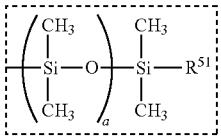

If the siloxane moiety content is less than 5% by mass with respect to the total mass of the resin [α1] in the present invention, the sustained effect of reducing contact stress is insufficient, and the domain is not formed effectively in the matrix containing the components [β] and [γ]. If the siloxane moiety content is larger than 30% by mass, the domain structure becomes unstable, and the component [γ] forms aggregates in the vicinity of the domain containing the component [α], resulting in insufficient potential stability in repeated use.

Next, the resin [α2], which is at least one resin selected from the group consisting of the resin having the structure represented by the formula (D), and the resin having the structure represented by the formula (E), is described. The resin [α2] is a resin which has the structure having the siloxane moiety and represented by the formula (A) at the both ends of the resin. In the structure within the brackets in the formula (D) or the formula (E), each repeating structural unit may have the same or different structures.

Each of "l" in the formula (D) and "n" in the formula (E) represents number of repetitions of the structure within the brackets. The average of each of "l" and "n" in the resin [α2] is preferably 10 or more to 300 or less from the viewpoint of the excellent balance between sustained reduction of contact stress and potential stability in repeated use, the average is preferably from 20 or more to 250 or less. "l" and "n" correlate to the weight-average molecular weight (hereinafter, referred to as Mw). The Mw of the resin having the structure represented by the formula (D) is preferably 5,000 or more to 150,000 or less, and the Mw of the resin having the structure represented by the formula (E) is preferably 7,000 or more to 200,000 or less. "l" and "n" are each adjusted by the weight-average molecular weight of the resin [α2] having the structure represented by the formula (D) or the structure represented by the formula (E), and the average of the number of repetitions "a" of the structure within the brackets in the formula (A).

Specific examples of the repeating structural unit within the brackets in the structure represented by the formula (D) are shown below.

(D-1)

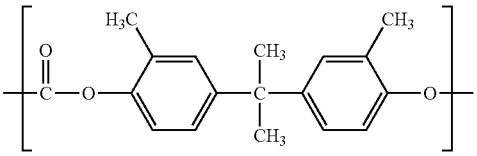

(D-2)

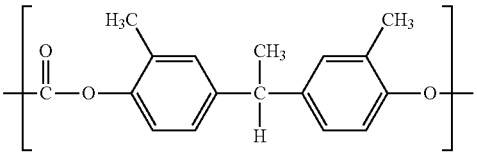

-continued (D-3)

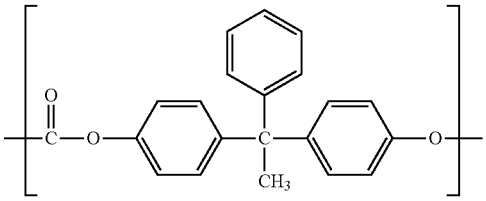

(D-4)

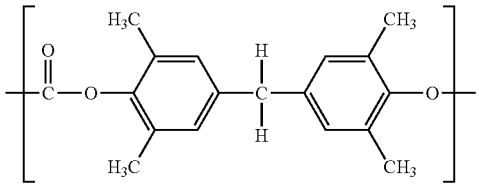

(D-5)

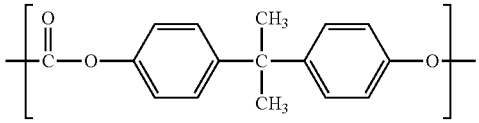

(D-6)

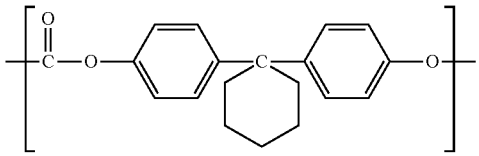

(D-7)

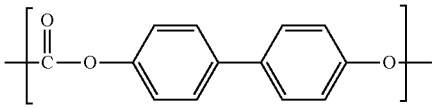

(D-8)

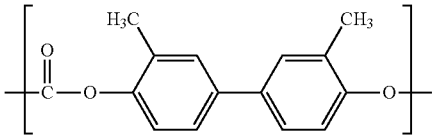

(D-9)

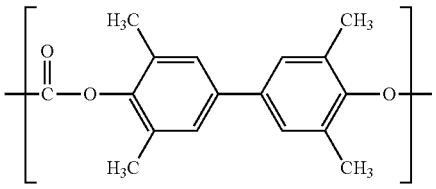

(D-10)

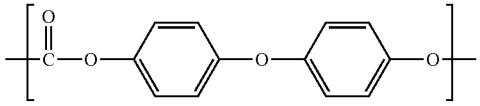

Of those, the structure represented by the formula (D-1), (D-2), (D-7), (D-8), (D-9), or (D-10) is preferred.

Specific examples of the repeating structural unit within the brackets in the structure represented by the formula (E) are shown below.

(E-1)

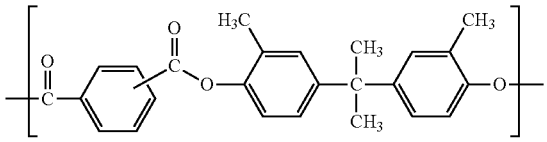

(E-2)

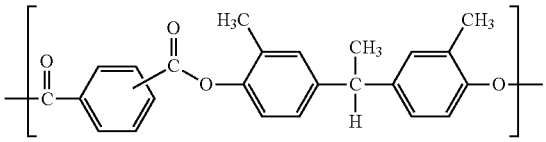

(E-3)

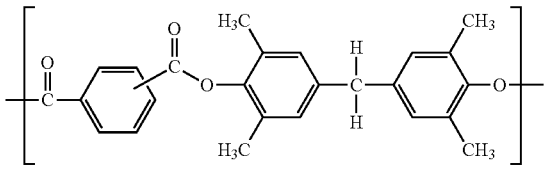

(E-4)

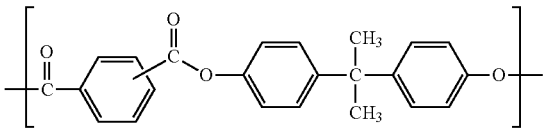

(E-5)

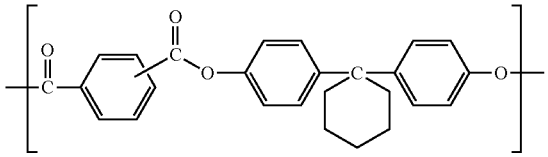

(E-6)

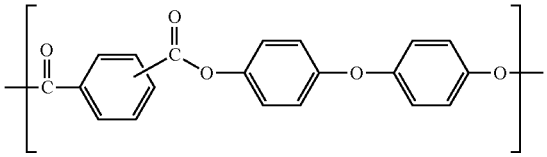

(E-7)

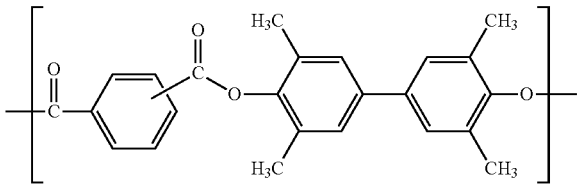

(E-8)

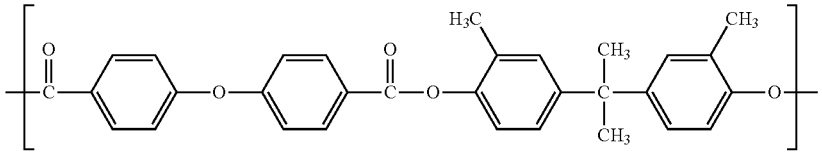

(E-9)

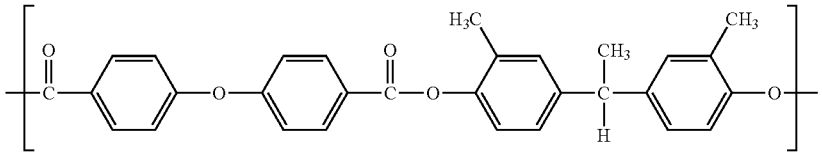

(E-10)

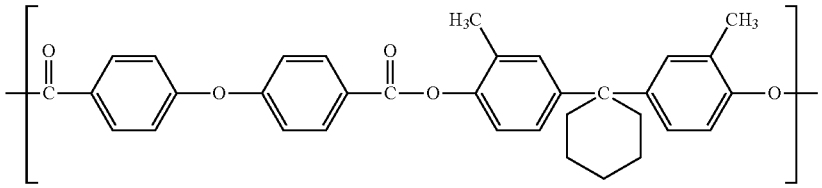

Of those, the structure represented by the formula (E-1), (E-2), (E-8), or (E-9) is preferred.

Next, "A" represented by the formula (D) or the formula (E) is described. The structure of "A" in the formula is represented by the above-mentioned formula (A).

In the present invention, the siloxane moiety is as described above. Specifically, in the case of the structure represented by the following formula (D-S) or the following formula (E-S), the siloxane moiety of the resin [α2] refers to the moiety surrounded by the dashed line. Further, the moiety refers to the above-mentioned siloxane moieties.

(D-S)

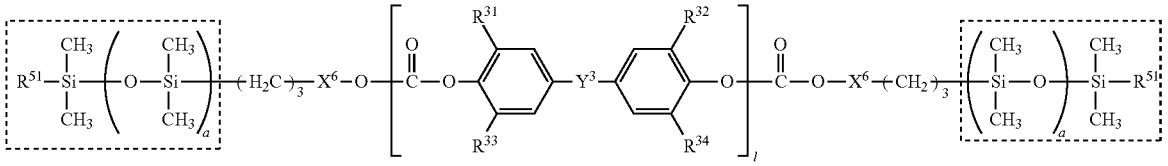

(E-S)

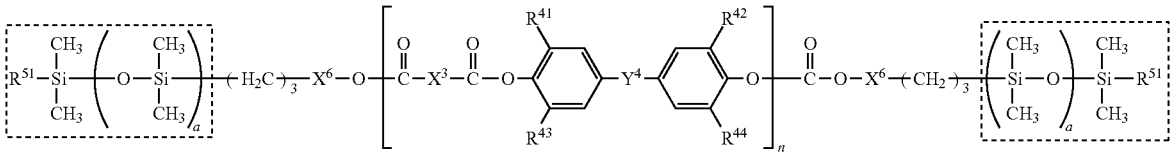

The resin [α2] in the present invention contains the siloxane moiety at a content of 5% by mass or more to 60% by mass or less with respect to the total mass of the resin [α2].

If the siloxane moiety content is 5% by mass or more to 60% by mass or less with respect to the total mass of the resin [α2], the sustained effect of reducing contact stress is sufficient, and the domain can be formed effectively in the matrix including the components [β] and [γ], resulting in sufficient potential stability in repeated use.

The charge-transporting layer which is the surface layer of the electrophotographic photosensitive member of the present invention contains a resin having the siloxane moiety at the end. In the present invention, the component [α](resin [α1] and resin [α2]) is a resin having the siloxane moiety at the end, and an additional resin having the siloxane moiety at the end may be mixed. Specific examples of the resin include a polycarbonate resin having the siloxane moiety at the end and a polyester resin having the siloxane structure at the end. In the present invention, from the viewpoint of the sustained effect of reducing contact stress and the effect of potential stability in repeated use, the content of the component [α] in the charge-transporting layer is 60% by mass or more to 100% by mass or less relative to the total mass of the resin having the siloxane moiety at the end one or both ends in the charge-transporting layer.

In the present invention, a preferred combination of the resin [α1] and the resin [α2] includes the resin having the structure represented by the above-mentioned formula (B) as the resin [α1] and the resin having the structure represented by the above-mentioned formula (D) as the resin [α2]. In addition, in the case where the resin [α1] is the resin having the structure represented by the above-mentioned formula (C), the resin [α2] is the resin having the structure represented by the above-mentioned formula (E).

The content of the siloxane moiety relative to the resin [α1] and the resin [α2] of the present invention can be analyzed by a general analysis technology. An example of the analysis technology is shown below.

First, the charge-transporting layer which is the surface layer of the electrophotographic photosensitive member is dissolved with a solvent. After that, a variety of materials in the charge-transporting layer which is the surface layer are fractionated using a fractionation apparatus capable of separating and collecting components, such as size exclusion chromatography or high-performance liquid chromatography. Structures of component materials in a fractionated resin which is the resin [α1] or the resin [α2] and contents of the materials can be determined by a conversion method based on peak positions and peak area ratios of hydrogen atoms (hydrogen atom which is included in the resin) measured by $^1$H-NMR measurement. The number of repetitions of the siloxane moiety and a molar ratio are calculated from the results and converted into content (mass ratio). Moreover, the fractionated resin which is the resin [α1] or the resin [α2] is hydrolyzed in the presence of an alkali to extract an alcohol moiety having a polysiloxane group or a phenol moiety having a polysiloxane group. Nuclear magnetic resonance spectrum analysis or mass spectrometry is performed for the resultant alcohol moiety having a polysiloxane group or phenol moiety having a polysiloxane group to calculate the number of repetitions of the siloxane moiety and a molar ratio, which are converted into content (mass ratio).

In the present invention, the mass ratio of the siloxane moiety in the resin which is the resin [α1] or the resin [α2] was measured by the above-mentioned technology.

Further, the mass ratio of the siloxane moiety in the resin [α1] or the resin [α2] relates to the amount of a raw material of a monomer unit containing the siloxane moiety used in polymerization, and hence the amount of the raw material used was adjusted to achieve a desired mass ratio of the siloxane moiety.

The resin [α1] and resin [α2] used in the present invention can each be synthesized by, for example, a conventional phosgene method or transesterification method.

Synthesis examples of the resin [α1] and resin [α2] used in the present invention are shown below.

The resin having the structure represented by the formula (B) can be synthesized by synthesis methods described in PTL 3 and PTL 5. In the present invention, resins each having the structure represented by the formula (B) (resins B) shown as synthesis examples in Table 1 were synthesized by the same synthesis method using raw materials appropriate for the structures represented by the formula (B). It should be noted that the resin B was purified by: fractionation and separation through size exclusion chromatography; $^1$H-NMR measurement for the fractionated components; and determination of the composition of the resin based on a relative ratio of the siloxane moiety in the resin. Table 1 shows the weight-average molecular weights of the synthesized resins B and the contents of the siloxane moieties in the resins B.

TABLE 1

| | Resin [α1] | Structure within brackets represented by formula (B) | R15 in formula (B) | Example of structure represented by formula (A) X6 | R51 | a | Weight-average molecular weight | Siloxane moiety content in formula (B) |
|---|---|---|---|---|---|---|---|---|
| *Synthesis Example 1 | Resin B(1) | B-1 | R15-1 | Phenylene | CH3 | 20 | 50000 | 3% |
| Synthesis Example 2 | Resin B(2) | B-1 | R15-1 | Phenylene | CH3 | 35 | 50000 | 5% |
| Synthesis Example 3 | Resin B(3) | B-1 | R15-1 | Phenylene | CH3 | 70 | 50000 | 10% |
| Synthesis Example 4 | Resin B(4) | B-1 | R15-1 | Phenylene | CH3 | 200 | 50000 | 30% |
| *Synthesis Example 5 | Resin B(5) | B-1 | R15-1 | Phenylene | CH3 | 240 | 60000 | 35% |
| Synthesis Example 6 | Resin B(6) | B-1 | R15-1 | Phenylene | C2H5 | 35 | 50000 | 5% |
| Synthesis Example 7 | Resin B(7) | B-1 | R15-1 | Phenylene | C3H7 | 35 | 50000 | 5% |
| Synthesis Example 8 | Resin B(8) | B-1 | R15-1 | Phenylene | C4H9 | 35 | 50000 | 5% |
| Synthesis Example 9 | Resin B(9) | B-1 | R15-2 | Phenylene | CH3 | 35 | 50000 | 5% |
| Synthesis Example 10 | Resin B(10) | B-1 | R15-1 | Formula (A2): b = 1 | CH3 | 35 | 50000 | 5% |
| Synthesis Example 11 | Resin B(11) | B-1 | R15-1 | Formula (A2): b = 2 | CH3 | 35 | 50000 | 5% |
| Synthesis Example 12 | Resin B(12) | B-1 | R15-1 | Formula (A2): b = 4 | CH3 | 35 | 50000 | 5% |
| Synthesis Example 13 | Resin B(13) | B-1 | R15-1 | Formula (A2): b = 10 | CH3 | 35 | 50000 | 5% |
| Synthesis Example 14 | Resin B(14) | B-2 | R15-2 | Phenylene | CH3 | 70 | 50000 | 10% |
| Synthesis Example 15 | Resin B(15) | B-3 | R15-2 | Phenylene | CH3 | 95 | 70000 | 10% |
| Synthesis Example 16 | Resin B(16) | B-4 | R15-2 | Phenylene | CH3 | 95 | 70000 | 10% |
| Synthesis Example 17 | Resin B(17) | B-5 | R15-2 | Phenylene | CH3 | 95 | 70000 | 10% |
| *Synthesis Example 18 | Resin B(18) | B-6 | R15-1 | Phenylene | CH3 | 30 | 70000 | 3% |
| Synthesis Example 19 | Resin B(19) | B-6 | R15-1 | Phenylene | CH3 | 45 | 70000 | 5% |
| Synthesis Example 20 | Resin B(20) | B-6 | R15-1 | Phenylene | CH3 | 95 | 70000 | 10% |
| Synthesis Example 21 | Resin B(21) | B-6 | R15-1 | Phenylene | CH3 | 280 | 70000 | 30% |
| *Synthesis Example 22 | Resin B(22) | B-6 | R15-1 | Phenylene | CH3 | 335 | 70000 | 35% |
| Synthesis Example 23 | Resin B(23) | B-6 | R15-1 | Phenylene | C2H5 | 95 | 70000 | 10% |
| Synthesis Example 24 | Resin B(24) | B-6 | R15-1 | Phenylene | C3H7 | 95 | 70000 | 10% |
| Synthesis Example 25 | Resin B(25) | B-6 | R15-1 | Phenylene | C4H9 | 95 | 70000 | 10% |
| Synthesis Example 26 | Resin B(26) | B-6 | R15-2 | Phenylene | CH3 | 95 | 70000 | 10% |
| Synthesis Example 27 | Resin B(27) | B-6 | R15-2 | Formula (A2): b = 1 | CH3 | 95 | 70000 | 10% |
| Synthesis Example 28 | Resin B(28) | B-6 | R15-2 | Formula (A2): b = 2 | CH3 | 95 | 70000 | 10% |
| Synthesis Example 29 | Resin B(29) | B-6 | R15-2 | Formula (A2): b = 4 | CH3 | 95 | 70000 | 10% |
| Synthesis Example 30 | Resin B(30) | B-6 | R15-2 | Formula (A2): b = 10 | CH3 | 95 | 70000 | 10% |
| Synthesis Example 31 | Resin B(31) | B-7 | R15-2 | Phenylene | CH3 | 40 | 60000 | 5% |
| Synthesis Example 32 | Resin B(32) | B-8 | R15-2 | Phenylene | CH3 | 40 | 60000 | 5% |
| Synthesis Example 33 | Resin B(33) | B-9 | R15-2 | Phenylene | CH3 | 45 | 70000 | 5% |
| *Synthesis Example 34 | Resin B(34) | B-10 | R15-1 | Phenylene | CH3 | 20 | 50000 | 3% |
| Synthesis Example 35 | Resin B(35) | B-10 | R15-1 | Phenylene | CH3 | 35 | 50000 | 5% |
| Synthesis Example 36 | Resin B(36) | B-10 | R15-1 | Phenylene | CH3 | 70 | 50000 | 10% |
| Synthesis Example 37 | Resin B(37) | B-10 | R15-1 | Phenylene | CH3 | 200 | 50000 | 30% |
| *Synthesis Example 38 | Resin B(38) | B-10 | R15-1 | Phenylene | CH3 | 240 | 50000 | 35% |
| Synthesis Example 39 | Resin B(39) | B-10 | R15-1 | Formula (A2): b = 1 | CH3 | 200 | 50000 | 30% |
| Synthesis Example 40 | Resin B(40) | B-10 | R15-1 | Formula (A2): b = 2 | CH3 | 200 | 50000 | 30% |
| Synthesis Example 41 | Resin B(41) | B-10 | R15-1 | Formula (A2): b = 2 | C2H5 | 200 | 50000 | 30% |
| Synthesis Example 42 | Resin B(42) | B-10 | R15-1 | Formula (A2): b = 2 | C3H7 | 200 | 50000 | 30% |
| Synthesis Example 43 | Resin B(43) | B-10 | R15-1 | Formula (A2): b = 2 | C4H9 | 200 | 50000 | 30% |
| Synthesis Example 44 | Resin B(44) | B-10 | R15-2 | Formula (A2): b = 2 | CH3 | 200 | 50000 | 30% |
| Synthesis Example 45 | Resin B(45) | B-10 | R15-2 | Formula (A2): b = 4 | CH3 | 200 | 50000 | 30% |
| Synthesis Example 46 | Resin B(46) | B-10 | R15-2 | Formula (A2): b = 10 | CH3 | 200 | 50000 | 30% |
| Synthesis Example 47 | Resin B(47) | B-5/B-7 | R15-1 | Phenylene | CH3 | 40 | 60000 | 5% |
| Synthesis Example 48 | Resin B(48) | B-5/B-7 | R15-2 | Formula (A2): b = 1 | CH3 | 40 | 60000 | 5% |
| Synthesis Example 49 | Resin B(49) | B-5/B-7 | R15-2 | Formula (A2): b = 2 | CH3 | 40 | 60000 | 5% |
| Synthesis Example 50 | Resin B(50) | B-5/B-7 | R15-2 | Formula (A2): b = 2 | C2H5 | 40 | 60000 | 5% |
| Synthesis Example 51 | Resin B(51) | B-5/B-7 | R15-2 | Formula (A2): b = 2 | C3H7 | 40 | 60000 | 5% |
| Synthesis Example 52 | Resin B(52) | B-5/B-7 | R15-2 | Formula (A2): b = 2 | C4H9 | 40 | 60000 | 5% |
| Synthesis Example 53 | Resin B(53) | B-5/B-7 | R15-2 | Formula (A2): b = 2 | CH3 | 40 | 60000 | 5% |
| Synthesis Example 54 | Resin B(54) | B-5/B-7 | R15-2 | Formula (A2): b = 4 | CH3 | 40 | 60000 | 5% |
| Synthesis Example 55 | Resin B(55) | B-5/B-7 | R15-2 | Formula (A2): b = 10 | CH3 | 40 | 60000 | 5% |

It should be noted that Synthesis Examples 1, 5, 18, 22, 34, and 38 indicated by "*" in Table 1 are comparative synthesis examples.

The term "Siloxane moiety content in formula (B)" in Table 1 refers to the average of the siloxane moiety content in each resin having the structure represented by the above-mentioned formula (B) as defined above.

In a synthesis example (resin B(3)), the maximum value and the minimum value of the number of repetitions "a" of the structure within the brackets represented by the formula (A) were 74 and 65, respectively. The difference between the maximum value and the minimum value of the number of repetitions "b" of the structure within the brackets represented by the formula (A2) was 0.

The resin having the structure represented by the formula (C) can be synthesized by a synthesis method described in PTL 6. In the present invention, resins each having the structure represented by the formula (C) (resin C) shown as synthesis examples in Table 2 were synthesized by the same synthesis method using raw materials appropriate for the structure represented by the formula (C). It should be noted that the resin C was purified by: fractionation and separation through size exclusion chromatography; $^{1}$H-NMR measurement for the fractionated components; and determination of the composition of the resin based on a relative ratio of the siloxane moiety in the resin. Table 2 shows the weight-average molecular weights of the synthesized resins C and the contents of the siloxane moieties in the resins C.

TABLE 2

| | Resin [α1] | Structure within brackets represented by formula (C) | R25 in formula (C) | Example of structure represented by formula (A) X6 | R51 | a | Weight-average molecular weight | Siloxane moiety content in formula (C) |
|---|---|---|---|---|---|---|---|---|
| *Synthesis Example 56 | Resin C(1) | C-1 | R25-2 | Phenylene | CH3 | 30 | 70000 | 3% |
| Synthesis Example 57 | Resin C(2) | C-1 | R25-2 | Phenylene | CH3 | 50 | 70000 | 5% |
| Synthesis Example 58 | Resin C(3) | C-1 | R25-2 | Phenylene | CH3 | 100 | 70000 | 10% |
| Synthesis Example 59 | Resin C(4) | C-1 | R25-2 | Phenylene | CH3 | 285 | 70000 | 30% |
| *Synthesis Example 60 | Resin C(5) | C-1 | R25-2 | Phenylene | CH3 | 330 | 70000 | 35% |
| Synthesis Example 61 | Resin C(6) | C-1 | R25-2 | Phenylene | C2H5 | 50 | 70000 | 5% |
| Synthesis Example 62 | Resin C(7) | C-1 | R25-2 | Phenylene | C3H7 | 50 | 70000 | 5% |
| Synthesis Example 63 | Resin C(8) | C-1 | R25-2 | Phenylene | C4H9 | 50 | 70000 | 5% |
| Synthesis Example 64 | Resin C(9) | C-1 | R25-1 | Phenylene | CH3 | 50 | 70000 | 5% |
| Synthesis Example 65 | Resin C(10) | C-1 | R25-3 | Phenylene | CH3 | 50 | 70000 | 5% |
| Synthesis Example 66 | Resin C(11) | C-1 | R25-2 | Formula (A2): b = 1 | CH3 | 50 | 70000 | 5% |
| Synthesis Example 67 | Resin C(12) | C-1 | R25-2 | Formula (A2): b = 2 | CH3 | 50 | 70000 | 5% |
| Synthesis Example 68 | Resin C(13) | C-1 | R25-2 | Formula (A2): b = 4 | CH3 | 50 | 70000 | 5% |
| Synthesis Example 69 | Resin C(14) | C-1 | R25-2 | Formula (A2): b = 10 | CH3 | 50 | 70000 | 5% |
| Synthesis Example 70 | Resin C(15) | C-1 | R25-3 | Formula (A2): b = 2 | CH3 | 50 | 70000 | 5% |
| *Synthesis Example 71 | Resin C(16) | C-2 | R25-3 | Formula (A2): b = 2 | CH3 | 25 | 60000 | 3% |
| Synthesis Example 72 | Resin C(17) | C-2 | R25-3 | Formula (A2): b = 2 | CH3 | 40 | 60000 | 5% |
| Synthesis Example 73 | Resin C(18) | C-2 | R25-3 | Formula (A2): b = 2 | CH3 | 80 | 60000 | 10% |
| Synthesis Example 74 | Resin C(19) | C-2 | R25-3 | Formula (A2): b = 2 | CH3 | 240 | 60000 | 30% |
| *Synthesis Example 75 | Resin C(20) | C-2 | R25-3 | Formula (A2): b = 2 | CH3 | 285 | 60000 | 35% |
| Synthesis Example 76 | Resin C(21) | C-2 | R25-3 | Formula (A2): b = 2 | C2H5 | 80 | 60000 | 10% |
| Synthesis Example 77 | Resin C(22) | C-2 | R25-3 | Formula (A2): b = 2 | C3H7 | 80 | 60000 | 10% |
| Synthesis Example 78 | Resin C(23) | C-2 | R25-3 | Formula (A2): b = 2 | C4H9 | 80 | 60000 | 10% |
| Synthesis Example 79 | Resin C(24) | C-2 | R25-3 | Formula (A2): b = 1 | CH3 | 80 | 60000 | 10% |
| Synthesis Example 80 | Resin C(25) | C-2 | R25-3 | Formula (A2): b = 4 | CH3 | 80 | 60000 | 10% |
| Synthesis Example 81 | Resin C(26) | C-2 | R25-3 | Formula (A2): b = 10 | CH3 | 80 | 60000 | 10% |
| Synthesis Example 82 | Resin C(27) | C-2 | R25-2 | Phenylene | CH3 | 80 | 60000 | 10% |
| Synthesis Example 83 | Resin C(28) | C-2 | R25-2 | Phenylene | CH3 | 110 | 80000 | 10% |
| Synthesis Example 84 | Resin C(29) | C-2 | R25-2 | Phenylene | CH3 | 120 | 90000 | 10% |
| Synthesis Example 85 | Resin C(30) | C-1 | R25-2 | Phenylene | CH3 | 50 | 70000 | 5% |
| Synthesis Example 86 | Resin C(31) | C-3 | R25-2 | Phenylene | CH3 | 55 | 80000 | 5% |
| Synthesis Example 87 | Resin C(32) | C-4 | R25-2 | Phenylene | CH3 | 60 | 90000 | 5% |
| Synthesis Example 88 | Resin C(33) | C-5 | R25-2 | Phenylene | CH3 | 55 | 80000 | 5% |
| Synthesis Example 89 | Resin C(34) | C-6 | R25-2 | Phenylene | CH3 | 60 | 90000 | 5% |
| Synthesis Example 90 | Resin C(35) | C-7 | R25-2 | Phenylene | CH3 | 55 | 80000 | 5% |
| Synthesis Example 91 | Resin C(36) | C-8 | R25-2 | Phenylene | CH3 | 55 | 80000 | 5% |
| *Synthesis Example 92 | Resin C(37) | C-9 | R25-3 | Phenylene | CH3 | 31 | 80000 | 3% |
| Synthesis Example 93 | Resin C(38) | C-9 | R25-3 | Phenylene | CH3 | 55 | 80000 | 5% |
| Synthesis Example 94 | Resin C(39) | C-9 | R25-3 | Phenylene | CH3 | 110 | 80000 | 10% |
| Synthesis Example 95 | Resin C(40) | C-9 | R25-3 | Phenylene | CH3 | 330 | 80000 | 30% |
| *Synthesis Example 96 | Resin C(41) | C-9 | R25-3 | Phenylene | CH3 | 380 | 80000 | 35% |
| Synthesis Example 97 | Resin C(42) | C-9 | R25-1 | Phenylene | CH3 | 330 | 80000 | 30% |
| Synthesis Example 98 | Resin C(43) | C-9 | R25-2 | Phenylene | CH3 | 330 | 80000 | 30% |
| Synthesis Example 99 | Resin C(44) | C-9 | R25-2 | Formula (A2): b = 1 | CH3 | 330 | 80000 | 30% |
| Synthesis Example 100 | Resin C(45) | C-9 | R25-2 | Formula (A2): b = 2 | CH3 | 330 | 80000 | 30% |
| Synthesis Example 101 | Resin C(46) | C-9 | R25-2 | Formula (A2): b = 4 | CH3 | 330 | 80000 | 30% |
| Synthesis Example 102 | Resin C(47) | C-9 | R25-2 | Formula (A2): b = 10 | CH3 | 330 | 80000 | 30% |
| Synthesis Example 103 | Resin C(48) | C-9 | R25-2 | Phenylene | C2H5 | 330 | 80000 | 30% |
| Synthesis Example 104 | Resin C(49) | C-9 | R25-2 | Phenylene | C3H7 | 330 | 80000 | 30% |
| Synthesis Example 105 | Resin C(50) | C-9 | R25-2 | Phenylene | C4H9 | 330 | 80000 | 30% |

It should be noted that Synthesis Examples 56, 60, 71, 75, 92, and 96 indicated by "*" in Table 2 are comparative synthesis examples.

The structures (C-1) within the brackets in the formula (C) represented by the resins C(1) to C(15) in Table 2 each have a terephthalic acid/isophthalic acid ratio of 1/1. The structure (C-1) within the brackets in the formula (C) represented by the resin C(30) in Table 2 has a terephthalic acid/isophthalic acid ratio of 7/3. The term "Siloxane moiety content in formula (C)" in Table 2 refers to the average of the siloxane moiety content in each resin having the structure represented by the above-mentioned formula (C) as defined above.

In a synthesis example (resin C(3)), the maximum value and the minimum value of the number of repetitions "a" of the structure within the brackets represented by the formula (A) were 107 and 96, respectively. The difference between the maximum value and the minimum value of the number of repetitions "b" of the structure within the brackets represented by the formula (A2) was 0.

The resin having the structure represented by the formula (D) can also be synthesized by synthesis methods described in PTL 3 and PTL 5. In the present invention, the resin having the structure represented by the formula (D) (resin D) shown as synthesis examples in Table 3 were synthesized by the same method using raw materials appropriate for the structure represented by the formula (D). In the same way as above, the resin D was purified by: fractionation and separation through size exclusion chromatography; $^{1}$H-NMR measurement for the fractionated components; and determination of the composition of the resin based on a relative ratio of the siloxane moiety in the resin. Table 3 shows the weight-average molecular weights of the synthesized resins D and the contents of the siloxane moieties in the resins D.

TABLE 3

| | Resin [α2] | Structure within brackets represented by formula (D) | Example of structure represented by formula (A) X6 | R51 | a | Weight-average molecular weight | Siloxane moiety content in formula (D) |
|---|---|---|---|---|---|---|---|
| *Synthesis Example 106 | Resin D(1) | D-1 | Phenylene | CH3 | 10 | 50000 | 3% |
| Synthesis Example 107 | Resin D(2) | D-1 | Phenylene | CH3 | 17 | 50000 | 5% |
| Synthesis Example 108 | Resin D(3) | D-1 | Phenylene | CH3 | 70 | 50000 | 20% |
| Synthesis Example 109 | Resin D(4) | D-1 | Phenylene | CH3 | 200 | 50000 | 60% |
| *Synthesis Example 110 | Resin D(5) | D-1 | Phenylene | CH3 | 220 | 50000 | 65% |
| Synthesis Example 111 | Resin D(6) | D-1 | Phenylene | C2H5 | 17 | 50000 | 5% |
| Synthesis Example 112 | Resin D(7) | D-1 | Phenylene | C3H7 | 17 | 50000 | 5% |
| Synthesis Example 113 | Resin D(8) | D-1 | Phenylene | C4H9 | 17 | 50000 | 5% |
| Synthesis Example 114 | Resin D(9) | D-1 | Formula (A2): b = 1 | CH3 | 17 | 50000 | 5% |
| Synthesis Example 115 | Resin D(10) | D-1 | Formula (A2): b = 2 | CH3 | 17 | 50000 | 5% |
| Synthesis Example 116 | Resin D(11) | D-1 | Formula (A2): b = 4 | CH3 | 17 | 50000 | 5% |
| Synthesis Example 117 | Resin D(12) | D-1 | Formula (A2): b = 10 | CH3 | 17 | 50000 | 5% |
| Synthesis Example 118 | Resin D(13) | D-2 | Phenylene | CH3 | 70 | 50000 | 20% |
| Synthesis Example 119 | Resin D(14) | D-3 | Phenylene | CH3 | 95 | 70000 | 20% |
| Synthesis Example 120 | Resin D(15) | D-4 | Phenylene | CH3 | 95 | 70000 | 20% |
| Synthesis Example 121 | Resin D(16) | D-5 | Phenylene | CH3 | 110 | 80000 | 20% |
| *Synthesis Example 122 | Resin D(17) | D-6 | Phenylene | CH3 | 15 | 70000 | 3% |
| Synthesis Example 123 | Resin D(18) | D-6 | Phenylene | CH3 | 23 | 70000 | 5% |
| Synthesis Example 124 | Resin D(19) | D-6 | Phenylene | CH3 | 95 | 70000 | 20% |
| Synthesis Example 125 | Resin D(20) | D-6 | Phenylene | CH3 | 280 | 70000 | 60% |
| *Synthesis Example 126 | Resin D(21) | D-6 | Phenylene | CH3 | 307 | 70000 | 65% |
| Synthesis Example 127 | Resin D(22) | D-6 | Phenylene | C2H5 | 95 | 70000 | 20% |
| Synthesis Example 128 | Resin D(23) | D-6 | Phenylene | C3H7 | 95 | 70000 | 20% |
| Synthesis Example 129 | Resin D(24) | D-6 | Phenylene | C4H9 | 95 | 70000 | 20% |
| Synthesis Example 130 | Resin D(25) | D-6 | Formula (A2): b = 1 | CH3 | 95 | 70000 | 20% |
| Synthesis Example 131 | Resin D(26) | D-6 | Formula (A2): b = 2 | CH3 | 95 | 70000 | 20% |
| Synthesis Example 132 | Resin D(27) | D-6 | Formula (A2): b = 4 | CH3 | 95 | 70000 | 20% |
| Synthesis Example 133 | Resin D(28) | D-6 | Formula (A2): b = 10 | CH3 | 95 | 70000 | 20% |
| Synthesis Example 134 | Resin D(29) | D-7 | Phenylene | CH3 | 110 | 80000 | 20% |
| Synthesis Example 135 | Resin D(30) | D-8 | Phenylene | CH3 | 110 | 80000 | 20% |
| Synthesis Example 136 | Resin D(31) | D-9 | Phenylene | CH3 | 95 | 70000 | 20% |
| *Synthesis Example 137 | Resin D(32) | D-10 | Phenylene | CH3 | 13 | 60000 | 3% |
| Synthesis Example 138 | Resin D(33) | D-10 | Phenylene | CH3 | 20 | 60000 | 5% |
| Synthesis Example 139 | Resin D(34) | D-10 | Phenylene | CH3 | 80 | 60000 | 20% |
| Synthesis Example 140 | Resin D(35) | D-10 | Phenylene | CH3 | 240 | 60000 | 60% |
| *Synthesis Example 141 | Resin D(36) | D-10 | Phenylene | CH3 | 265 | 60000 | 65% |
| Synthesis Example 142 | Resin D(37) | D-10 | Formula (A2): b = 1 | CH3 | 240 | 60000 | 60% |
| Synthesis Example 143 | Resin D(38) | D-10 | Formula (A2): b = 2 | CH3 | 240 | 60000 | 60% |
| Synthesis Example 144 | Resin D(39) | D-10 | Formula (A2): b = 2 | C2H5 | 240 | 60000 | 60% |
| Synthesis Example 145 | Resin D(40) | D-10 | Formula (A2): b = 2 | C3H7 | 240 | 60000 | 60% |
| Synthesis Example 146 | Resin D(41) | D-10 | Formula (A2): b = 2 | C4H9 | 240 | 60000 | 60% |
| Synthesis Example 147 | Resin D(42) | D-10 | Formula (A2): b = 4 | CH3 | 240 | 60000 | 60% |
| Synthesis Example 148 | Resin D(43) | D-10 | Formula (A2): b = 10 | CH3 | 240 | 60000 | 60% |
| Synthesis Example 149 | Resin D(44) | D-5/D-7 | Phenylene | CH3 | 27 | 80000 | 5% |
| Synthesis Example 150 | Resin D(45) | D-5/D-7 | Formula (A2): b = 1 | CH3 | 27 | 80000 | 5% |
| Synthesis Example 151 | Resin D(46) | D-5/D-7 | Formula (A2): b = 2 | CH3 | 27 | 80000 | 5% |
| Synthesis Example 152 | Resin D(47) | D-5/D-7 | Formula (A2): b = 2 | C2H5 | 27 | 80000 | 5% |
| Synthesis Example 153 | Resin D(48) | D-5/D-7 | Formula (A2): b = 2 | C3H7 | 27 | 80000 | 5% |
| Synthesis Example 154 | Resin D(49) | D-5/D-7 | Formula (A2): b = 2 | C4H9 | 27 | 80000 | 5% |
| Synthesis Example 155 | Resin D(50) | D-5/D-7 | Formula (A2): b = 4 | CH3 | 27 | 80000 | 5% |
| Synthesis Example 156 | Resin D(51) | D-5/D-7 | Formula (A2): b = 10 | CH3 | 27 | 80000 | 5% |

It should be noted that Synthesis Examples 106, 110, 122, 126, 137, and 141 indicated by "*" in Table 3 are comparative synthesis examples.

The term "Siloxane moiety content in formula (D)" in Table 3 refers to the average of the siloxane moiety content in each resin having the structure represented by the above-mentioned formula (D) as defined above.

In a synthesis example (resin D(3)), the maximum value and the minimum value of the number of repetitions "a" of the structure within the brackets represented by the formula (A) were 74 and 65, respectively. The difference between the maximum value and the minimum value of the number of repetitions "b" of the structure within the brackets represented by the formula (A2) was 0.

The resin having the structure represented by the formula (E) can also be synthesized by a synthesis method described in PTL 6. In the present invention, resins each having the structure represented by the formula (E) (resin E) shown as synthesis examples in Table 4 was synthesized by the same method using raw materials appropriate for the structure represented by the formula (E). In the same way as above, the resin E was purified by: fractionation and separation through size exclusion chromatography; $^{1}$H-NMR measurement for the fractionated components; and determination of the composition of the resin based on a relative ratio of the siloxane moiety in the resin. Table 4 shows the weight-average molecular weights of the synthesized resins E and the contents of the siloxane moieties in the resins E.

TABLE 4

| | Resin [α2] | Structure within brackets represented by formula (E) | Example of structure represented by formula (A) X6 | R51 | a | Weight-average molecular weight | Siloxane moiety content in formula (E) |
|---|---|---|---|---|---|---|---|
| *Synthesis Example 157 | Resin E(1) | E-1 | Phenylene | CH3 | 13 | 70000 | 3% |
| Synthesis Example 158 | Resin E(2) | E-1 | Phenylene | CH3 | 23 | 70000 | 5% |
| Synthesis Example 159 | Resin E(3) | E-1 | Phenylene | CH3 | 95 | 70000 | 20% |
| Synthesis Example 160 | Resin E(4) | E-1 | Phenylene | CH3 | 285 | 70000 | 60% |
| *Synthesis Example 161 | Resin E(5) | E-1 | Phenylene | CH3 | 310 | 70000 | 65% |
| Synthesis Example 162 | Resin E(6) | E-1 | Phenylene | C2H5 | 23 | 70000 | 5% |
| Synthesis Example 163 | Resin E(7) | E-1 | Phenylene | C3H7 | 23 | 70000 | 5% |
| Synthesis Example 164 | Resin E(8) | E-1 | Phenylene | C4H9 | 23 | 70000 | 5% |
| Synthesis Example 165 | Resin E(9) | E-1 | Formula (A2): b = 1 | CH3 | 23 | 70000 | 5% |
| Synthesis Example 166 | Resin E(10) | E-1 | Formula (A2): b = 2 | CH3 | 23 | 70000 | 5% |
| Synthesis Example 167 | Resin E(11) | E-1 | Formula (A2): b = 4 | CH3 | 23 | 70000 | 5% |
| Synthesis Example 168 | Resin E(12) | E-1 | Formula (A2): b = 10 | CH3 | 23 | 70000 | 5% |
| Synthesis Example 169 | Resin E(13) | E-2 | Phenylene | CH3 | 20 | 60000 | 5% |
| *Synthesis Example 170 | Resin E(14) | E-2 | Formula (A2): b = 2 | CH3 | 12 | 60000 | 3% |
| Synthesis Example 171 | Resin E(15) | E-2 | Formula (A2): b = 2 | CH3 | 20 | 60000 | 5% |
| Synthesis Example 172 | Resin E(16) | E-2 | Formula (A2): b = 2 | CH3 | 80 | 60000 | 20% |
| Synthesis Example 173 | Resin E(17) | E-2 | Formula (A2): b = 2 | CH3 | 250 | 60000 | 60% |
| *Synthesis Example 174 | Resin E(18) | E-2 | Formula (A2): b = 2 | CH3 | 265 | 60000 | 65% |
| Synthesis Example 175 | Resin E(19) | E-2 | Formula (A2): b = 2 | C2H5 | 80 | 60000 | 20% |
| Synthesis Example 176 | Resin E(20) | E-2 | Formula (A2): b = 2 | C3H7 | 80 | 60000 | 20% |
| Synthesis Example 177 | Resin E(21) | E-2 | Formula (A2): b = 2 | C4H9 | 80 | 60000 | 20% |
| Synthesis Example 178 | Resin E(22) | E-2 | Formula (A2): b = 1 | CH3 | 80 | 60000 | 20% |
| Synthesis Example 179 | Resin E(23) | E-2 | Formula (A2): b = 4 | CH3 | 80 | 60000 | 20% |
| Synthesis Example 180 | Resin E(24) | E-2 | Formula (A2): b = 10 | CH3 | 80 | 60000 | 20% |
| Synthesis Example 181 | Resin E(25) | E-1 | Phenylene | CH3 | 95 | 70000 | 20% |
| Synthesis Example 182 | Resin E(26) | E-3 | Phenylene | CH3 | 120 | 90000 | 20% |
| Synthesis Example 183 | Resin E(27) | E-4 | Phenylene | CH3 | 110 | 80000 | 20% |
| Synthesis Example 184 | Resin E(28) | E-5 | Phenylene | CH3 | 120 | 90000 | 20% |
| Synthesis Example 185 | Resin E(29) | E-6 | Phenylene | CH3 | 110 | 80000 | 20% |
| Synthesis Example 186 | Resin E(30) | E-7 | Phenylene | CH3 | 120 | 90000 | 20% |
| Synthesis Example 187 | Resin E(31) | E-8 | Phenylene | CH3 | 110 | 80000 | 20% |
| *Synthesis Example 188 | Resin E(32) | E-9 | Phenylene | CH3 | 15 | 80000 | 3% |
| Synthesis Example 189 | Resin E(33) | E-9 | Phenylene | CH3 | 28 | 80000 | 5% |
| Synthesis Example 190 | Resin E(34) | E-9 | Phenylene | CH3 | 110 | 80000 | 20% |
| Synthesis Example 191 | Resin E(35) | E-9 | Phenylene | CH3 | 320 | 80000 | 60% |
| *Synthesis Example 192 | Resin E(36) | E-9 | Phenylene | CH3 | 350 | 80000 | 65% |
| Synthesis Example 193 | Resin E(37) | E-9 | Formula (A2): b = 1 | CH3 | 110 | 80000 | 20% |
| Synthesis Example 194 | Resin E(38) | E-9 | Formula (A2): b = 2 | CH3 | 110 | 80000 | 20% |
| Synthesis Example 195 | Resin E(39) | E-9 | Formula (A2): b = 4 | CH3 | 110 | 80000 | 20% |
| Synthesis Example 196 | Resin E(40) | E-9 | Formula (A2): b = 10 | CH3 | 110 | 80000 | 20% |
| Synthesis Example 197 | Resin E(41) | E-9 | Phenylene | C2H5 | 110 | 80000 | 20% |
| Synthesis Example 198 | Resin E(42) | E-9 | Phenylene | C3H7 | 110 | 80000 | 20% |
| Synthesis Example 199 | Resin E(43) | E-9 | Phenylene | C4H9 | 110 | 80000 | 20% |

It should be noted that Synthesis Examples 157, 161, 170, 174, 188, and 192 indicated by "*" in Table 4 are comparative synthesis examples.

The structures (E-1) within the brackets in the formula (E) represented by the resins E(1) to E(12) in Table 4 each have a terephthalic acid/isophthalic acid ratio of 1/1. The structure (E-1) within the brackets in the formula (E) represented by the resin E(25) in Table 4 has a terephthalic acid/isophthalic acid ratio of 7/3. The term "Siloxane moiety content in formula (E)" in Table 4 refers to the average of the siloxane moiety content in each resin having the structure represented by the above-mentioned formula (E) as defined above.

In a synthesis example (resin E(3)), the maximum value and the minimum value of the number of repetitions "a" of the structure within the brackets represented by the formula (A) were 105 and 95, respectively. The difference between the maximum value and the minimum value of the number of repetitions "b" of the structure within the brackets represented by the formula (A2) was 0.

<Component [β]>

The component [β] is at least one resin selected from the group consisting of a polycarbonate resin F having a repeating structural unit represented by the following formula (F) and a polyester resin G having a repeating structural unit represented by the following formula (G).

(F)

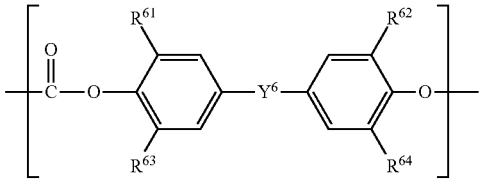

In the formula (F), $R^{61}$ to $R^{64}$ each independently represents a hydrogen atom or a methyl group. $Y^6$ represents a single bond, a methylene group, an ethylidene group, a propylidene group, a phenylethylidene group, a cyclohexylidene group, or an oxygen atom.

(G)

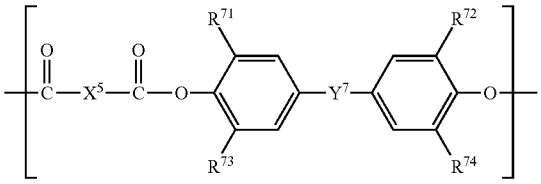

In the formula (G), $R^{71}$ to $R^{74}$ each independently represents a hydrogen atom, or a methyl group. $X^5$ represents a meta-phenylene group, a para-phenylene group, or a bivalent group having two para-phenylene groups bonded with an oxygen atom. $Y^7$ represents a single bond, a methylene group, an ethylidene group, a propylidene group, a cyclohexylidene group, or an oxygen atom.

Specific examples of the repeating structural unit represented by the above-mentioned formula (F) are shown below.

(F-1)

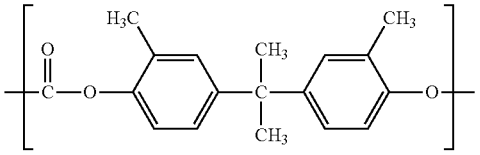

(F-2)

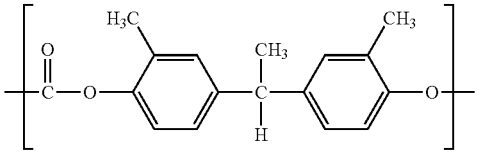

(F-3)

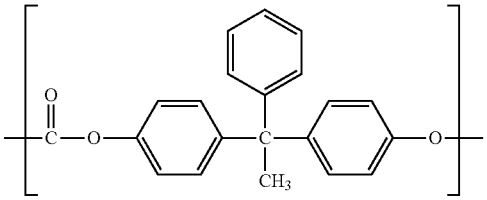

(F-4)

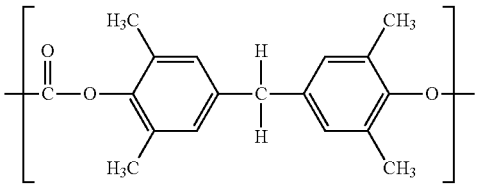

(F-5)

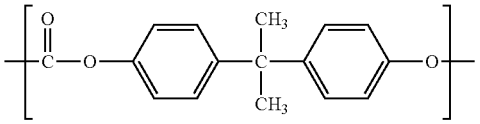

-continued (F-6)

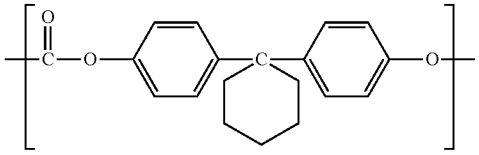

(F-7)

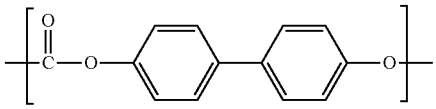

(F-8)

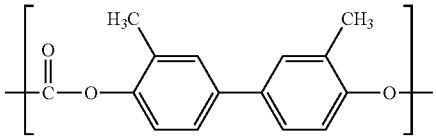

(F-9)

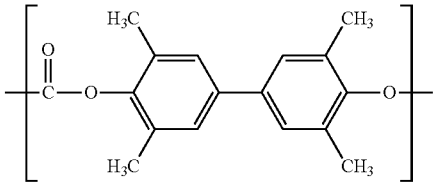

(F-10)

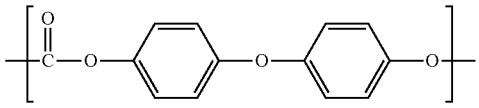

Of those, the repeating structural unit represented by the formula (F-1), (F-2), (F-3), (F-6), or (F-10) is preferred.

The polyester resin G which is the component [β] and has the repeating structural unit represented by the above-mentioned formula (G) is described. Specific examples of the repeating structural unit represented by the above-mentioned formula (G) are shown below.

(G-1)

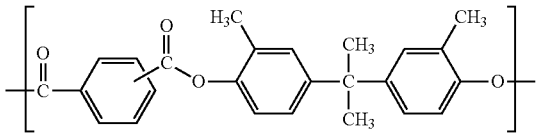

(G-2)

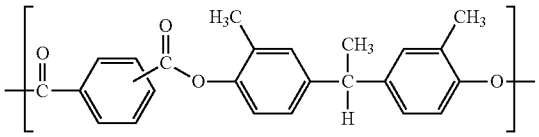

(G-3)

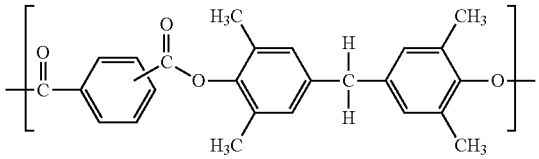

(G-4)

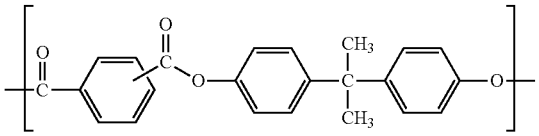

-continued (G-5)

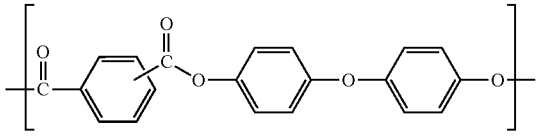

(G-6)

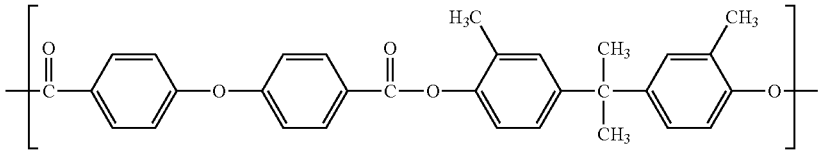

(G-7)

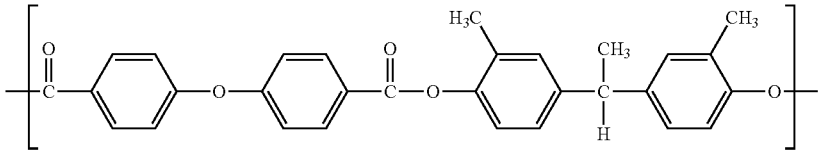

Of those, the repeating structural unit represented by the formula (G-1), (G-2), (G-6), or (G-7) is preferred. Further, from the viewpoint of forming a uniform matrix of the component [β] and the charge-transporting substance, the component [β] preferably has no siloxane moiety.

The charge-transporting layer which is the surface layer of the electrophotographic photosensitive member of the present invention contains the component [β] as a resin that constructs the matrix, and an additional resin may be mixed therein. Examples of the additional resin which may be mixed include an acrylic resin, a polyester resin, and a polycarbonate resin. In the case where the additional resin is mixed, the ratio of the component [β] (polyester resin G or polycarbonate resin F) to the additional resin is preferably in a range in which the content of the component [β] is 90% by mass or more to 100% by mass or less (mass ratio). In the present invention, in the case where the additional resin is mixed in addition to the polyester resin G or the polycarbonate resin F, from the viewpoint of forming a uniform matrix with the charge-transporting substance, the additional resin preferably has no siloxane structure.

The charge-transporting layer which is the surface layer of the electrophotographic photosensitive member of the present invention contains the component [γ] as the charge-transporting substance, and may contain a charge-transporting substance having another structure. Examples of the charge-transporting substance having another structure include a triarylamine compound and a hydrazone compound. Of those, use of the triarylamine compound as the charge-transporting substance is preferred in terms of potential stability in repeated use. In the case where a charge-transporting substance having another structure is mixed, the component [γ] is contained at a content of preferably 50% by mass or more in whole charge-transporting substances in the charge-transporting layer.

Next, the construction of the electrophotographic photosensitive member of the present invention is described.

The electrophotographic photosensitive member of the present invention has a conductive support, a charge-generating layer which is provided on the conductive support and comprises a charge-generating substance, and a charge-transporting layer which is provided on the charge-generating layer, comprises a charge-transporting substance. Further, in the electrophotographic photosensitive member, the charge-transporting layer is a surface layer (outermost layer) of the electrophotographic photosensitive member.

Further, the charge-transporting layer of the electrophotographic photosensitive member of the present invention includes the above-mentioned components [α], [β], and [γ]. Further, the charge-transporting layer may have a laminate structure, and in such case, the layer is formed so that at least the charge-transporting layer provided on the outermost surface has the above-mentioned matrix-domain structure.

In general, as the electrophotographic photosensitive member, a cylindrical electrophotographic photosensitive member produced by forming a photosensitive layer (charge-generating layer or charge-transporting layer) on a cylindrical conductive support is widely used, but the member may have a form of belt or sheet.

Conductive Support

The conductive support to be used in the electrophotographic photosensitive member of the present invention is preferably conductive (conductive support) and is, for example, one made of aluminum or an aluminum alloy. In the case of aluminum or an aluminum alloy, the conductive support used may be an ED tube or an EI tube or one obtained by subjecting the ED tube or the EI tube to cutting, electrolytic composite polish, or a wet- or dry-honing process. Further examples thereof include a conductive support made of a metal or a resin having formed thereon a thin film of a conductive material such as aluminum, an aluminum alloy, or an indium oxide-tin oxide alloy. The surface of the support may be subjected to, for example, cutting treatment, roughening treatment, or alumite treatment.

Further, in order to suppress an interference fringe, it is preferred to adequately make the surface of the support rough. Specifically, a support obtained by processing the surface of the above-mentioned support by honing, blast, cutting, or electrolytic polishing, or a support having a conductive layer which includes conductive particles and a resin on a support made of aluminum or an aluminum alloy is preferably used. In order to suppress generation of an interference fringe in an output image due to interference of light reflected on the surface of the conductive layer, a surface roughness-imparting agent for making the surface of the conductive layer rough may be added to the conductive layer.

Conductive Layer

In the electrophotographic photosensitive member of the present invention, a conductive layer having conductive particles and a resin may be provided on the support. In a method of forming a conductive layer having conductive particles and a resin on a support, powder containing the conductive particles is contained in the conductive layer.

Examples of the conductive particles include carbon black, acetylene black, metal powders made of, for example, aluminum, nickel, iron, nichrome, copper, zinc, and silver, and metal oxide powders made of, for example, conductive tin oxide and ITO.

Examples of the resin to be used in the conductive layer include a polyester resin, a polycarbonate resin, a polyvinyl butyral resin, an acrylic resin, a silicone resin, an epoxy resin, a melamine resin, a urethane resin, a phenol resin, and an alkyd resin. Those resins may be used each alone or in combination of two or more kinds thereof.

Examples of a solvent used as a conductive-layer coating solution include an ether-based solvent, an alcohol-based solvent, a ketone-based solvent, and an aromatic hydrocarbon solvent. The film thickness of the conductive layer is preferably 0.2 μm or more to 40 μm or less, more preferably 1 μm or more to 35 μm or less, still more preferably 5 μm or more to 30 μm or less.

Intermediate Layer

The electrophotographic photosensitive member of the present invention may include an intermediate layer between the conductive support or the conductive layer and the charge-generating layer.

The intermediate layer can be formed by applying an intermediate-layer coating solution containing a resin on the support or the conductive layer and drying or hardening the coating solution.

Examples of the resin to be used in the intermediate layer include polyacrylic acids, methylcellulose, ethylcellulose, a polyamide resin, a polyimide resin, a polyamideimide resin, a polyamide acid resin, a melamine resin, an epoxy resin, and a polyurethane resin. The resin to be used in the intermediate layer is preferably a thermoplastic resin, and specifically, a thermoplastic polyamide resin is preferred. Examples of the polyamide resin include copolymer nylon with low crystallinity or amorphous which can be applied in solution state.

The film thickness of the intermediate layer is preferably 0.05 μm or more to 40 μm or less, more preferably 0.1 μm or more to 20 μm or less.

The intermediate layer may further contain a semiconductive particle, an electron-transporting substance, or an electron-accepting substance.

Charge-Generating Layer

In the electrophotographic photosensitive member of the present invention, the charge-generating layer is provided on the conductive support, conductive layer, or intermediate layer.

Examples of the charge-generating substance to be used in the electrophotographic photosensitive member of the present invention include azo pigments, phthalocyanine pigments, indigo pigments, and perylene pigments. Only one kind of those charge-generating substances may be used, or two or more kinds thereof may be used. Of those, oxytitanium phthalocyanine, hydroxygallium phthalocyanine, and chlorogallium phthalocyanine are particularly preferred because of their high sensitivity.

Examples of the resin to be used in the charge-generating layer include a polycarbonate resin, a polyester resin, a butyral resin, a polyvinyl acetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge-generating layer can be formed by applying a charge-generating-layer coating solution, which is prepared by dispersing a charge-generating substance together with a resin and a solvent, and then drying the coating solution. Further, the charge-generating layer may also be a deposited film of a charge-generating substance.

Examples of the dispersion method include those using a homogenizer, an ultrasonic wave, a ball mill, a sand mill, an attritor, or a roll mill.

A ratio between the charge-generating substance and the resin is preferably 0.1 part by mass or more to 10 parts by mass or less, particularly preferably 1 part by mass or more to 3 parts by mass or less of the charge-generating substance with respect to 1 part by mass of the resin.

Examples of the solvent to be used in the charge-generating-layer coating solution include an alcohol-based solvent, a sulfoxide-based solvent, a ketone-based solvent, an ether-based solvent, an ester-based solvent, and an aromatic hydrocarbon solvent.

The film thickness of the charge-generating layer is preferably 0.01 μm or more to 5 μm or less, more preferably 0.1 μm or more to 2 μm or less. Further, the charge-generating layer may be added with any of various sensitizers, antioxidants, UV absorbents, plasticizers, and the like if required. A charge-transporting substance or a charge-accepting substance may also be added to the charge-generating layer to prevent the flow of charge from being disrupted in the charge-generating layer.

Charge-Transporting Layer

In the electrophotographic photosensitive member of the present invention, the charge-transporting layer is provided on the charge-generating layer.

The charge-transporting layer which is the surface layer of the electrophotographic photosensitive member of the present invention contains the component [γ] as a specific charge-transporting substance, and may also contain a charge-transporting substance having another structure as described above. The charge-transporting substance which has another structure and may be mixed is as described above.

The charge-transporting layer which is the surface layer of the electrophotographic photosensitive member of the present invention contains the components [α] and [β] as resins, and as described above, another resin may further be mixed. The resin which may be mixed is as described above.

The charge-transporting layer can be formed by applying a charge-transporting-layer coating solution obtained by dissolving a charge-transporting substance and the above-mentioned resins into a solvent and then drying the coating solution.

A ratio between the charge-transporting substance and the resins is preferably 0.4 part by mass or more to 2 parts by mass or less, more preferably 0.5 part by mass or more to 1.2 parts by mass or less of the charge-transporting substance with respect to 1 part by mass of the resins.

Examples of the solvent to be used for the charge-transporting-layer coating solution include ketone-based solvents, ester-based solvents, ether-based solvents, and aromatic hydrocarbon solvents. Those solvents may be used each alone or as a mixture of two or more kinds thereof. Of those solvents, it is preferred to use any of the ether-based solvents and the aromatic hydrocarbon solvents from the viewpoint of resin solubility.

The charge-transporting layer has a film thickness of preferably 5 μm or more to 50 μm or less, more preferably 10 μm or more to 35 μm or less.

In addition, the charge-transporting layer may be added with an antioxidant, a UV absorber, or a plasticizer if required.

A variety of additives may be added to each layer of the electrophotographic photosensitive member of the present invention. Examples of the additives include: a deterioration-preventing agent such as an antioxidant, a UV absorber, or a light stabilizer; and fine particles such as organic fine particles or inorganic fine particles. Examples of the deterioration-preventing agent include a hindered phenol-based antioxidant, a hindered amine-based light stabilizer, a sulfur atom-containing antioxidant, and a phosphorus atom-containing antioxidant. Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the coating solutions corresponding to the above-mentioned respective layers, any of the application methods can be employed, such as dip coating, spraying coating, spinner coating, roller coating, Mayer bar coating, and blade coating.

Electrophotographic Apparatus

FIG. 1 illustrates an example of the schematic construction of an electrophotographic apparatus including a process cartridge including the electrophotographic photosensitive member of the present invention.

In FIG. 1, a cylindrical electrophotographic photosensitive member 1 can be driven to rotate around an axis 2 in the direction indicated by the arrow at a predetermined peripheral speed. The surface of the rotated electrophotographic photosensitive member 1 is uniformly charged in negative at predetermined potential by a charging device (primary charging device: such as a charging roller) 3 during the process of rotation. Subsequently, the surface of the electrophotographic photosensitive member 1 receives exposure light (image exposure light) 4 which is emitted from an exposing device (not shown) such as a slit exposure or a laser-beam scanning exposure and which is intensity-modulated according to a time-series electric digital image signal of image information of purpose. In this way, electrostatic latent images corresponding to the image information of purpose are sequentially formed on the surface of the electrophotographic photosensitive member 1.

The electrostatic latent images formed on the surface of the electrophotographic photosensitive member 1 are converted into toner images by reversal development with toner included in a developer of a developing device 5. Subsequently, the toner images being formed and held on the surface of the electrophotographic photosensitive member 1 are sequentially transferred to a transfer material (such as paper) P by a transfer bias from a transferring device (such as transfer roller) 6. It should be noted that the transfer material P is taken from a transfer material supplying device (not shown) in synchronization with the rotation of the electrophotographic photosensitive member 1 and fed to a portion (contact part) between the electrophotographic photosensitive member 1 and the transferring device 6. Further, bias voltage having a polarity reverse to that of the electric charges the toner has is applied to the transferring device 6 from a bias power source (not shown).

The transfer material P which has received the transfer of the toner images is dissociated from the surface of the electrophotographic photosensitive member 1 and then introduced to a fixing device 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the remaining developer (remaining toner) after the transfer by a cleaning device (such as cleaning blade) 7. Subsequently, the surface of the electrophotographic photosensitive member 1 is subjected to a neutralization process with pre-exposure light (not shown) from a pre-exposing device (not shown) and then repeatedly used in image formation. As shown in FIG. 1, further, when the charging device 3 is a contact-charging device using a charging roller, the pre-exposure is not always required.

In the present invention, of the components including the electrophotographic photosensitive member 1, the charging device 3, the developing device 5, the transferring device 6, and the cleaning device 7 as described above, a plurality of them may be selected and housed in a container and then integrally supported as a process cartridge. In addition, the process cartridge may be designed so as to be detachably mounted on the main body of an electrophotographic apparatus such as a copying machine or a laser beam printer. In FIG. 1, the electrophotographic photosensitive member 1, the charging device 3, the developing device 5, and the cleaning device 7 are integrally supported and placed in a cartridge, thereby forming a process cartridge 9. The process cartridge 9 is detachably mounted on the main body of the electrophotographic apparatus using a guiding device 10 such as a rail of the main body of the electrophotographic apparatus.

EXAMPLES

Hereinafter, the present invention is described in more detail with reference to examples and comparative examples. However, the present invention is not limited in any way to the following examples. In addition, "part(s)" means "part(s) by mass" in the examples.

Example 1

The surface of an aluminum cylinder with a diameter of 30 mm and a length of 260.5 mm was anodized and then subjected to a nickel-sealing treatment, and the resultant cylinder was used as a conductive support.

Next, 10 parts of a titanyl phthalocyanine crystal (charge-generating substance) having a crystal structure showing intense peaks at Bragg angles (2θ±0.2°) of 9.6°, 24.0°, and 27.2° in CuKα characteristic X-ray diffraction were prepared. To the crystal were added 250 parts of cyclohexanone and 5 parts of a polyvinyl butyral resin (product name: S-LEC BX-1, manufactured by Sekisui Chemical Co., Ltd.), and the resultant mixture was dispersed by a sand mill apparatus using glass beads with a diameter of 1 mm under a 23±3° C. atmosphere for 1 hour. After dispersion, 250 parts of ethyl acetate were added to prepare a charge-generating-layer coating solution. The charge-generating-layer coating solution was applied on the above-mentioned conductive support by dip coating and dried at 100° C. for 10 minutes, to thereby form a charge-generating layer with a film thickness of 0.3 μm.

Next, 7 parts of a charge-transporting substance having the structure represented by the formula (2-1) as the component [γ], 0.005 part of the resin B(2) synthesized in Synthesis Example 2 corresponding to the resin [α1] and 4.995 parts of the resin D(2) synthesized in Synthesis Example 107 corresponding to the resin [α2] as the component [α], and 8 parts of a polycarbonate resin (weight-average molecular weight: 80,000) having the repeating structure represented by the formula (F-1) as the component [β] were dissolved in a mixed solvent of 80 parts of tetrahydrofuran and toluene (tetrahydrofuran: 64 parts, toluene: 16 parts), to thereby prepare a charge-transporting-layer coating solution.

The charge-transporting-layer coating solution was applied on the above-mentioned charge-generating layer by dip coating and dried at 120° C. for 1 hour, to thereby form a charge-transporting layer with a film thickness of 16 μm. It was confirmed that the resultant charge-transporting layer contained a domain including the component [α] in a matrix including the components [β] and [γ].

Thus, an electrophotographic photosensitive member including the charge-transporting layer as the surface layer was produced. Table 5 shows the resins [α1] and [α2] and components [β] and [γ] in the charge-transporting layer, the content of the resin [α1] with respect to the component [α], and the content of the component [α] with respect to the total mass of the resin having a siloxane moiety at the end of the charge-transporting layer.

Next, evaluation is described.

Evaluation was performed for a variation (potential variation) of bright section potentials in repeated use of 2,000 sheets of paper, torque relative values in early time and in repeated use of 2,000 sheets of paper, and observation of the surface of the electrophotographic photosensitive member in measurement of the torques.

A laser beam printer manufactured by Canon Inc. (LBP-2510), modified so as to adjust a charge potential (dark section potential) of the electrophotographic photosensitive member, was used as an evaluation apparatus. Further, a cleaning blade made of polyurethane rubber was set so as to have a contact angle of 22.5° and a contact pressure of 35 g/cm$^2$ relative to the surface of the electrophotographic photosensitive member. Evaluation was performed under an environment of a temperature of 23° C. and a relative humidity of 50%.

<Evaluation of Potential Variation>

The exposure amount (image exposure amount) of a 780-nm laser light source used as an evaluation apparatus was set so that the light intensity on the surface of the electrophotographic photosensitive member was 0.3 μJ/cm$^2$. Measurement of the potentials (dark section potential and bright section potential) of the surface of the electrophotographic photosensitive member was performed at a position of a developing device after replacing the developing device by a fixture fixed so that a probe for potential measurement was located at a position of 130 mm from the end of the electrophotographic photosensitive member. The dark section potential at an unexposed part of the electrophotographic photosensitive member was set to −450 V, laser light was irradiated, and the bright section potential obtained by light attenuation from the dark section potential was measured. Further, A4-size plain paper was used to continuously output 2,000 images, and variations of the bright section potentials before and after the output were evaluated. A test chart having a printing ratio of 5% was used. The results are shown in the column "Potential variation" in Table 12.

<Evaluation of Torque Relative Value>

A driving current (current A) of a rotary motor of the electrophotographic photosensitive member was measured under the same conditions as those in the evaluation of the potential variation described above. This evaluation was performed for evaluating an amount of contact stress between the electrophotographic photosensitive member and the cleaning blade. The resultant current shows how large the amount of contact stress between the electrophotographic photosensitive member and the cleaning blade is.

Moreover, an electrophotographic photosensitive member for comparison of a torque relative value was produced by the following method. The electrophotographic photosensitive member was produced in the same manner as in Example 1 except that the resin B(2) corresponding to the resin [α1] and the resin D(2) corresponding to the resin [α2] in the component [α] used in the charge-transporting layer of the electrophotographic photosensitive member of Example 1 were replaced by the polycarbonate resin (weight-average molecular weight: 80,000) having the repeating structure represented by the formula (F-1), and only the component [β] was used as the resin. The resultant electrophotographic photosensitive member was used as the electrophotographic photosensitive member for comparison. The resultant electrophotographic photosensitive member for comparison was used to measure a driving current (current B) of a rotary motor of the electrophotographic photosensitive member in the same manner as in Example 1.

A ratio of the driving current (current A) of the rotary motor of the electrophotographic photosensitive member containing the component [α] according to the present invention to the driving current (current B) of the rotary motor of the electrophotographic photosensitive member for comparison not containing the component [α] was calculated. The resultant value of (current A)/(current B) was compared as a torque relative value. The torque relative value represents a degree of reduction in contact stress between the electrophotographic photosensitive member and the cleaning blade by use of the component [α]. As the torque relative value becomes smaller, the degree of reduction in contact stress between the electrophotographic photosensitive member and the cleaning blade becomes larger. The results are shown in the column "Initial torque relative value" in Tables 12 and 13.

Subsequently, A4-size plain paper was used to continuously output 2,000 images. A test chart having a printing ratio of 5% was used. After that, measurement of torque relative values after repeated use of 2,000 sheets was performed. The torque relative value after repeated use of 2,000 sheets of the paper was measured in the same manner as in the evaluation for the initial torque relative value. In this process, 2,000 sheets of the paper were used in a repetitive manner for the electrophotographic photosensitive member for comparison, and the resultant driving current of the rotary motor was used to calculate the torque relative value after repeated use of 2,000 sheets of paper. The results are shown in the column "Torque relative value after repeated use of 2,000 sheets of paper" in Tables 12 and 13.

<Evaluation of Matrix-Domain Structure>

The cross-sectional surface of the charge-transporting layer, obtained by cutting the charge-transporting layer in a vertical direction with respect to the electrophotographic photosensitive member prepared by the above-mentioned method, was observed using an ultradeep profile measurement microscope VK-9500 (manufactured by KEYENCE CORPORATION). In this process, an area of 100 μm×100 μm (10,000 μm$^2$) in the surface of the electrophotographic photosensitive member was defined as a visual field and observed at an object lens magnification of 50× to measure the maximum diameter of 100 formed domains selected at random in the visual field. An average was calculated from the maximum diameter and provided as a number average particle size. Tables 12 and 13 show the results.

Examples 2 to 299

Electrophotographic photosensitive members were prepared in the same manner as in Example 1 except that the components [α], [β], and [γ] in the charge-transporting layers were replaced as shown in Tables 5 to 10, and evaluated. It was confirmed that each of the resultant charge-transporting layers contains a domain including the component [α] in a matrix including the components [β] and [γ]. Tables 5 to 10 show the siloxane moiety contents and compositions of the resins in the charge-transporting layer. Tables 12 and 13 show the results. It should be noted that a charge-transporting substance having the structure represented by the following formula (3-1) was mixed as the charge-transporting substance with a charge-transporting substance which is the component [γ] and has the structure represented by the formula (2-1).

Meanwhile, the polyester resins G having the repeating structural units represented by (G-1), (G-2), (G-3), (G-4), and (G-5) each have a terephthalic acid/isophthalic acid ratio of 1/1.

(3-1)

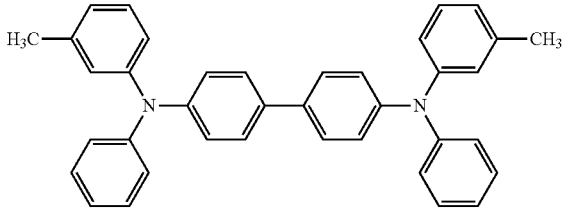

Examples 300 to 305

Electrophotographic photosensitive members were prepared in the same manner as in Example 1 except that, in Example 1, additional resins each having a siloxane moiety at the end were further added as shown in Table 11 and the components [α], [β], and [γ] were replaced as shown in Table 11, and evaluated. It was confirmed that each of the resultant charge-transporting layers contains a domain including the component [α] in a matrix including the components [β] and [γ]. Table 11 shows the siloxane moiety contents and compositions of resins in the charge-transporting layer. Table 13 shows the results.

Comparative Examples 1 to 83

Electrophotographic photosensitive members were prepared in the same manner as in Example 1 except that the components [α], [β], and [γ] in the charge-transporting layers were replaced as shown in Table 11, and evaluated. Tables 14 and 15 show the siloxane moiety contents and compositions of resins in the charge-transporting layer. Table 16 shows the results.

Comparative Examples 84 to 89

Electrophotographic photosensitive members were prepared in the same manner as in Example 1 except that, in Example 1, the resins corresponding to the component [α] were replaced to the repeating structural unit represented by the following formula (J-1) which is a structure described in PTL 1, and replacement was made as shown in Table 15, and evaluated. The resin J-1 having the repeating structural unit represented by the formula (J-1) has a terephthalic acid/isophthalic acid ratio of 1/1. Table 15 shows the siloxane moiety contents and compositions of resins in the charge-transporting layer. Table 16 shows the results. In the formed charge-transporting layer, a matrix-domain structure was formed. It should be noted that the numerical value representing the number of repetitions of the siloxane moiety in the repeating structural unit represented by the following formula (J-1) shows the average of the numbers of repetitions. In this case, the average of the numbers of repetitions of the siloxane moiety in the repeating structural unit represented by the following formula (J-1) in the resin J-1 is 40.

(J-1)

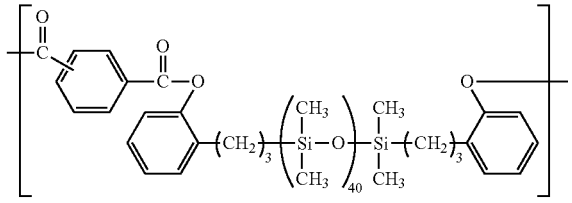

Comparative Examples 90 to 95

Electrophotographic photosensitive members were prepared in the same manner as in Example 1 except that, in Example 1, only the component [β] was used as the resin without using the component [α], silicone oil (product name, KF-56, manufactured by Shin-Etsu Chemical Co., Ltd.) was added as an additive at a concentration of 0.2% with respect to the total solid content in the charge-transporting layer, and replacement was made as shown in Table 15, and evaluated. Table 15 shows the siloxane moiety contents and compositions of resins in the charge-transporting layer. Table 16 shows the results. The resultant charge-transporting layer were found to have no matrix-domain structure.

TABLE 5

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 1 | Resin B(2) | 0.005 | Resin D(2) | 4.995 | 0.1% | 100% | (F-1) | 80000 | 8 | (2-1) | 7 |
| Example 2 | Resin B(2) | 0.050 | Resin D(2) | 4.950 | 1.0% | 100% | (F-1) | 80000 | 8 | (2-1) | 7 |
| Example 3 | Resin B(2) | 0.250 | Resin D(2) | 4.750 | 5.0% | 100% | (F-1) | 80000 | 8 | (2-1) | 7 |
| Example 4 | Resin B(2) | 1.000 | Resin D(2) | 4.000 | 20.0% | 100% | (F-1) | 80000 | 8 | (2-1) | 7 |
| Example 5 | Resin B(2) | 2.500 | Resin D(2) | 2.500 | 50.0% | 100% | (F-1) | 80000 | 8 | (2-1) | 7 |
| Example 6 | Resin B(2) | 5.000 | | | 100.0% | 100% | (F-1) | 80000 | 8 | (2-1) | 7 |
| Example 7 | Resin B(3) | 0.005 | Resin D(2) | 4.995 | 0.1% | 100% | (F-1) | 80000 | 8 | (2-1) | 7 |
| Example 8 | Resin B(3) | 2.500 | Resin D(2) | 2.500 | 50.0% | 100% | (F-1) | 80000 | 8 | (2-1) | 7 |
| Example 9 | Resin B(4) | 0.005 | Resin D(2) | 4.995 | 0.1% | 100% | (F-1) | 80000 | 8 | (2-1) | 7 |

TABLE 5-continued

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 10 | Resin B(4) | 5.000 | | | 100.0% | 100% | (F-1) | 80000 | 8 | (2-1) | 7 |
| Example 11 | Resin B(6) | 1.000 | Resin D(6) | 4.000 | 20.0% | 100% | (F-1) | 80000 | 8 | (2-1) | 7 |
| Example 12 | Resin B(7) | 1.000 | Resin D(7) | 4.000 | 20.0% | 100% | (F-1) | 80000 | 8 | (2-1) | 7 |
| Example 13 | Resin B(8) | 1.000 | Resin D(8) | 4.000 | 20.0% | 100% | (F-1) | 80000 | 8 | (2-1) | 7 |
| Example 14 | Resin B(9) | 1.000 | Resin D(2) | 4.000 | 20.0% | 100% | (F-1) | 80000 | 8 | (2-1) | 7 |
| Example 15 | Resin B(10) | 1.000 | Resin D(9) | 4.000 | 20.0% | 100% | (F-1) | 80000 | 8 | (2-1) | 7 |
| Example 16 | Resin B(11) | 1.000 | Resin D(10) | 4.000 | 20.0% | 100% | (F-1) | 80000 | 8 | (2-1) | 7 |
| Example 17 | Resin B(12) | 1.000 | Resin D(11) | 4.000 | 20.0% | 100% | (F-1) | 80000 | 8 | (2-1) | 7 |
| Example 18 | Resin B(13) | 1.000 | Resin D(12) | 4.000 | 20.0% | 100% | (F-1) | 80000 | 8 | (2-1) | 7 |
| Example 19 | Resin B(2) | 0.250 | Resin D(2) | 4.750 | 5.0% | 100% | (F-2) | 70000 | 8 | (2-1) | 7 |
| Example 20 | Resin B(2) | 0.250 | Resin D(2) | 4.750 | 5.0% | 100% | (F-3) | 90000 | 8 | (2-1) | 7 |
| Example 21 | Resin B(2) | 0.250 | Resin D(2) | 4.750 | 5.0% | 100% | (F-4) | 100000 | 8 | (2-1) | 7 |
| Example 22 | Resin B(2) | 0.250 | Resin D(2) | 4.750 | 5.0% | 100% | (F-5)/(F-7) | 80000 | 6.4/1.6 | (2-1) | 7 |
| Example 23 | Resin B(2) | 0.250 | Resin D(2) | 4.750 | 5.0% | 100% | (F-6) | 80000 | 8 | (2-1) | 7 |
| Example 24 | Resin B(2) | 0.250 | Resin D(2) | 4.750 | 5.0% | 100% | (F-1)/(F-9) | 90000 | 6.4/1.6 | (2-1) | 7 |
| Example 25 | Resin B(2) | 0.250 | Resin D(2) | 4.750 | 5.0% | 100% | (F-10) | 100000 | 8 | (2-1) | 7 |
| Example 26 | Resin B(2) | 0.250 | Resin D(2) | 4.750 | 5.0% | 100% | (G-1) | 120000 | 8 | (2-1) | 7 |
| Example 27 | Resin B(2) | 0.250 | Resin D(2) | 4.750 | 5.0% | 100% | (G-2) | 120000 | 8 | (2-1) | 7 |
| Example 28 | Resin B(2) | 0.250 | Resin D(2) | 4.750 | 5.0% | 100% | (G-6) | 150000 | 8 | (2-1) | 7 |
| Example 29 | Resin B(2) | 0.250 | Resin D(2) | 4.750 | 5.0% | 100% | (G-7) | 150000 | 8 | (2-1) | 7 |
| Example 30 | Resin B(2) | 0.250 | Resin D(2) | 4.750 | 5.0% | 100% | (F-1) | 80000 | 5 | (1-1)/(1-2) | 5/5 |
| Example 31 | Resin B(2) | 0.250 | Resin D(2) | 4.750 | 5.0% | 100% | (F-1) | 80000 | 5 | (1-3) | 10 |
| Example 32 | Resin B(2) | 0.250 | Resin D(2) | 4.750 | 5.0% | 100% | (F-1) | 80000 | 5 | (1-4)/(1-5) | 5/5 |
| Example 33 | Resin B(2) | 0.250 | Resin D(2) | 4.750 | 5.0% | 100% | (F-1) | 80000 | 8 | (1-6)/(1-7) | 3.5/3.5 |
| Example 34 | Resin B(2) | 0.250 | Resin D(2) | 4.750 | 5.0% | 100% | (F-1) | 80000 | 5 | (1-8)/(1-9) | 5/5 |
| Example 35 | Resin B(2) | 0.250 | Resin D(2) | 4.750 | 5.0% | 100% | (F-1) | 80000 | 5 | (2-1)/(3-1) | 5/5 |
| Example 36 | Resin B(2) | 0.250 | Resin D(2) | 4.750 | 5.0% | 100% | (F-1) | 80000 | 8 | (2-3) | 7 |
| Example 37 | Resin B(2) | 0.250 | Resin D(2) | 4.750 | 5.0% | 100% | (F-1) | 80000 | 8 | (2-4) | 7 |
| Example 38 | Resin B(2) | 0.250 | Resin D(2) | 4.750 | 5.0% | 100% | (F-1) | 80000 | 8 | (2-5) | 7 |
| Example 39 | Resin B(2) | 0.250 | Resin D(2) | 4.750 | 5.0% | 100% | (F-1) | 80000 | 8 | (2-6) | 7 |
| Example 40 | Resin B(2) | 0.250 | Resin D(18) | 4.750 | 5.0% | 100% | (F-1) | 80000 | 8 | (2-1) | 7 |
| Example 41 | Resin B(2) | 0.250 | Resin D(33) | 4.750 | 5.0% | 100% | (F-1) | 80000 | 8 | (2-1) | 7 |
| Example 42 | Resin B(2) | 0.250 | Resin D(44) | 4.750 | 5.0% | 100% | (F-1) | 80000 | 8 | (2-1) | 7 |
| Example 43 | Resin B(2) | 0.250 | Resin E(2) | 4.750 | 5.0% | 100% | (F-1) | 80000 | 8 | (2-1) | 7 |
| Example 44 | Resin B(2) | 0.250 | Resin E(33) | 4.750 | 5.0% | 100% | (F-1) | 80000 | 8 | (2-1) | 7 |
| Example 45 | Resin B(19) | 0.050 | Resin D(18) | 4.950 | 1.0% | 100% | (F-6) | 80000 | 8 | (2-1) | 7 |
| Example 46 | Resin B(19) | 0.005 | Resin D(18) | 4.995 | 0.1% | 100% | (F-6) | 80000 | 5 | (1-3) | 10 |
| Example 47 | Resin B(19) | 5.000 | | | 100.0% | 100% | (F-6) | 80000 | 5 | (1-3) | 10 |
| Example 48 | Resin B(20) | 0.005 | Resin D(19) | 4.995 | 0.1% | 100% | (F-6) | 80000 | 5 | (1-3) | 10 |
| Example 49 | Resin B(20) | 0.050 | Resin D(19) | 4.950 | 1.0% | 100% | (F-6) | 80000 | 5 | (1-3) | 10 |
| Example 50 | Resin B(20) | 0.250 | Resin D(19) | 4.750 | 5.0% | 100% | (F-6) | 80000 | 5 | (1-3) | 10 |
| Example 51 | Resin B(20) | 1.000 | Resin D(19) | 4.000 | 20.0% | 100% | (F-6) | 80000 | 5 | (1-3) | 10 |
| Example 52 | Resin B(20) | 2.500 | Resin D(19) | 2.500 | 50.0% | 100% | (F-6) | 80000 | 5 | (1-3) | 10 |
| Example 53 | Resin B(20) | 5.000 | | | 100.0% | 100% | (F-6) | 80000 | 5 | (1-3) | 10 |

TABLE 6

| | [α] | | | | | | [β] | | | [γ] | |
|---|---|---|---|---|---|---|---|---|---|---|---|
| | Resin [α1] | | Resin [α2] | | Resin [α1] | | | Weight-average | | | |
| | Type of resin | Part | Type of resin | Part | content | [α] content | Type of resin | molecular weight | Part | Type of CTM | Part |
| Example 54 | Resin B(21) | 0.005 | Resin D(20) | 4.995 | 0.1% | 100% | (F-6) | 80000 | 5 | (1-3) | 10 |
| Example 55 | Resin B(21) | 2.500 | Resin D(20) | 2.500 | 50.0% | 100% | (F-6) | 80000 | 5 | (1-3) | 10 |
| Example 56 | Resin B(23) | 0.050 | Resin D(22) | 4.950 | 1.0% | 100% | (F-6) | 80000 | 5 | (1-3) | 10 |
| Example 57 | Resin B(24) | 0.050 | Resin D(23) | 4.950 | 1.0% | 100% | (F-6) | 80000 | 5 | (1-3) | 10 |
| Example 58 | Resin B(25) | 0.050 | Resin D(24) | 4.950 | 1.0% | 100% | (F-6) | 80000 | 5 | (1-3) | 10 |
| Example 59 | Resin B(26) | 0.050 | Resin D(19) | 4.950 | 1.0% | 100% | (F-6) | 80000 | 5 | (1-3) | 10 |
| Example 60 | Resin B(27) | 0.050 | Resin D(25) | 4.950 | 1.0% | 100% | (F-6) | 80000 | 5 | (1-3) | 10 |
| Example 61 | Resin B(28) | 0.050 | Resin D(26) | 4.950 | 1.0% | 100% | (F-6) | 80000 | 5 | (1-3) | 10 |
| Example 62 | Resin B(29) | 0.050 | Resin D(27) | 4.950 | 1.0% | 100% | (F-6) | 80000 | 5 | (1-3) | 10 |
| Example 63 | Resin B(30) | 0.050 | Resin D(28) | 4.950 | 1.0% | 100% | (F-6) | 80000 | 5 | (1-3) | 10 |
| Example 64 | Resin B(20) | 0.050 | Resin D(19) | 4.950 | 1.0% | 100% | (F-1) | 80000 | 5 | (1-3) | 10 |
| Example 65 | Resin B(20) | 0.050 | Resin D(19) | 4.950 | 1.0% | 100% | (F-2) | 70000 | 5 | (1-3) | 10 |
| Example 66 | Resin B(20) | 0.050 | Resin D(19) | 4.950 | 1.0% | 100% | (F-3) | 90000 | 5 | (1-3) | 10 |
| Example 67 | Resin B(20) | 0.050 | Resin D(19) | 4.950 | 1.0% | 100% | (F-4) | 100000 | 5 | (1-3) | 10 |
| Example 68 | Resin B(20) | 0.050 | Resin D(19) | 4.950 | 1.0% | 100% | (F-5)/(F-7) | 80000 | 4/1 | (1-3) | 10 |
| Example 69 | Resin B(20) | 0.050 | Resin D(19) | 4.950 | 1.0% | 100% | (F-1)/(F-9) | 90000 | 4/1 | (1-3) | 10 |
| Example 70 | Resin B(20) | 0.050 | Resin D(19) | 4.950 | 1.0% | 100% | (F-10) | 100000 | 5 | (1-3) | 10 |
| Example 71 | Resin B(20) | 0.050 | Resin D(19) | 4.950 | 1.0% | 100% | (G-1) | 120000 | 5 | (1-3) | 10 |

TABLE 6-continued

| | [α] | | | | | | [β] | | | [γ] | |
|---|---|---|---|---|---|---|---|---|---|---|---|
| | Resin [α1] | | Resin [α2] | | Resin [α1] | | | Weight-average | | | |
| | Type of resin | Part | Type of resin | Part | content | [α] content | Type of resin | molecular weight | Part | Type of CTM | Part |
| Example 72 | Resin B(20) | 0.050 | Resin D(19) | 4.950 | 1.0% | 100% | (G-2) | 120000 | 5 | (1-3) | 10 |
| Example 73 | Resin B(20) | 0.050 | Resin D(19) | 4.950 | 1.0% | 100% | (G-6) | 150000 | 5 | (1-3) | 10 |
| Example 74 | Resin B(20) | 0.050 | Resin D(19) | 4.950 | 1.0% | 100% | (G-7) | 150000 | 5 | (1-3) | 10 |
| Example 75 | Resin B(20) | 0.050 | Resin D(19) | 4.950 | 1.0% | 100% | (F-6) | 80000 | 5 | (1-1)/(1-2) | 5/5 |
| Example 76 | Resin B(20) | 0.050 | Resin D(19) | 4.950 | 1.0% | 100% | (F-6) | 80000 | 5 | (1-4)/(1-5) | 5/5 |
| Example 77 | Resin B(20) | 0.050 | Resin D(19) | 4.950 | 1.0% | 100% | (F-6) | 80000 | 5 | (1-6)/(1-7) | 3.5/3.5 |
| Example 78 | Resin B(20) | 0.050 | Resin D(19) | 4.950 | 1.0% | 100% | (F-6) | 80000 | 8 | (1-8)/(1-9) | 3.5/3.5 |
| Example 79 | Resin B(20) | 0.050 | Resin D(19) | 4.950 | 1.0% | 100% | (F-6) | 80000 | 8 | (2-1) | 7 |
| Example 80 | Resin B(20) | 0.050 | Resin D(19) | 4.950 | 1.0% | 100% | (F-6) | 80000 | 5 | (2-1)/(3-1) | 5/5 |
| Example 81 | Resin B(20) | 0.050 | Resin D(19) | 4.950 | 1.0% | 100% | (F-6) | 80000 | 8 | (2-3) | 7 |
| Example 82 | Resin B(20) | 0.050 | Resin D(19) | 4.950 | 1.0% | 100% | (F-6) | 80000 | 8 | (2-4) | 7 |
| Example 83 | Resin B(20) | 0.050 | Resin D(19) | 4.950 | 1.0% | 100% | (F-6) | 80000 | 8 | (2-5) | 7 |
| Example 84 | Resin B(20) | 0.050 | Resin D(19) | 4.950 | 1.0% | 100% | (F-6) | 80000 | 8 | (2-6) | 7 |
| Example 85 | Resin B(20) | 0.050 | Resin D(3) | 4.950 | 1.0% | 100% | (F-6) | 80000 | 5 | (1-3) | 10 |
| Example 86 | Resin B(20) | 0.050 | Resin D(34) | 4.950 | 1.0% | 100% | (F-6) | 80000 | 5 | (1-3) | 10 |
| Example 87 | Resin B(20) | 0.050 | Resin D(44) | 4.950 | 1.0% | 100% | (F-6) | 80000 | 5 | (1-3) | 10 |
| Example 88 | Resin B(20) | 0.050 | Resin E(3) | 4.950 | 1.0% | 100% | (F-6) | 80000 | 5 | (1-3) | 10 |
| Example 89 | Resin B(20) | 0.050 | Resin E(33) | 4.950 | 1.0% | 100% | (F-6) | 80000 | 5 | (1-3) | 10 |
| Example 90 | Resin B(35) | 0.050 | Resin D(33) | 4.950 | 1.0% | 100% | (F-10) | 100000 | 8 | (2-1) | 7 |
| Example 91 | Resin B(35) | 0.005 | Resin D(33) | 4.995 | 0.1% | 100% | (F-10) | 100000 | 8 | (1-6)/(1-7) | 3.5/3.5 |
| Example 92 | Resin B(35) | 2.500 | Resin D(33) | 2.500 | 50.0% | 100% | (F-10) | 100000 | 8 | (1-6)/(1-7) | 3.5/3.5 |
| Example 93 | Resin B(36) | 0.005 | Resin D(34) | 4.995 | 0.1% | 100% | (F-10) | 100000 | 8 | (1-6)/(1-7) | 3.5/3.5 |
| Example 94 | Resin B(36) | 0.050 | Resin D(34) | 4.950 | 1.0% | 100% | (F-10) | 100000 | 8 | (1-6)/(1-7) | 3.5/3.5 |
| Example 95 | Resin B(36) | 0.250 | Resin D(34) | 4.750 | 5.0% | 100% | (F-10) | 100000 | 8 | (1-6)/(1-7) | 3.5/3.5 |
| Example 96 | Resin B(36) | 1.000 | Resin D(34) | 4.000 | 20.0% | 100% | (F-10) | 100000 | 8 | (1-6)/(1-7) | 3.5/3.5 |
| Example 97 | Resin B(36) | 5.000 | | | 100.0% | 100% | (F-10) | 100000 | 8 | (1-6)/(1-7) | 3.5/3.5 |
| Example 98 | Resin B(37) | 0.005 | Resin D(35) | 4.995 | 0.1% | 100% | (F-10) | 100000 | 8 | (1-6)/(1-7) | 3.5/3.5 |
| Example 99 | Resin B(37) | 1.000 | Resin D(35) | 4.000 | 20.0% | 100% | (F-10) | 100000 | 8 | (1-6)/(1-7) | 3.5/3.5 |
| Example 100 | Resin B(39) | 2.500 | Resin D(37) | 2.500 | 50.0% | 100% | (F-10) | 100000 | 8 | (1-6)/(1-7) | 3.5/3.5 |
| Example 101 | Resin B(40) | 2.500 | Resin D(38) | 2.500 | 50.0% | 100% | (F-10) | 100000 | 8 | (1-6)/(1-7) | 3.5/3.5 |
| Example 102 | Resin B(41) | 2.500 | Resin D(39) | 2.500 | 50.0% | 100% | (F-10) | 100000 | 8 | (1-6)/(1-7) | 3.5/3.5 |
| Example 103 | Resin B(42) | 2.500 | Resin D(40) | 2.500 | 50.0% | 100% | (F-10) | 100000 | 8 | (1-6)/(1-7) | 3.5/3.5 |
| Example 104 | Resin B(43) | 2.500 | Resin D(41) | 2.500 | 50.0% | 100% | (F-10) | 100000 | 8 | (1-6)/(1-7) | 3.5/3.5 |
| Example 105 | Resin B(44) | 2.500 | Resin D(38) | 2.500 | 50.0% | 100% | (F-10) | 100000 | 8 | (1-6)/(1-7) | 3.5/3.5 |
| Example 106 | Resin B(45) | 2.500 | Resin D(42) | 2.500 | 50.0% | 100% | (F-10) | 100000 | 8 | (1-6)/(1-7) | 3.5/3.5 |

TABLE 7

| | [α] | | | | | | [β] | | | [γ] | |
|---|---|---|---|---|---|---|---|---|---|---|---|
| | Resin [α1] | | Resin [α2] | | Resin [α1] | [α] | | Weight-average | | | |
| | Type of resin | Part | Type of resin | Part | content | content | Type of resin | molecular weight | Part | Type of CTM | Part |
| Example 107 | ResinB(46) | 2.500 | ResinD(43) | 2.500 | 50.0% | 100% | (F-10) | 100000 | 8 | (1-6)/(1-7) | 3.5/3.5 |
| Example 108 | ResinB(43) | 2.500 | ResinD(41) | 2.500 | 50.0% | 100% | (F-1) | 80000 | 8 | (1-6)/(1-7) | 3.5/3.5 |
| Example 109 | ResinB(43) | 2.500 | ResinD(41) | 2.500 | 50.0% | 100% | (F-2) | 70000 | 8 | (1-6)/(1-7) | 3.5/3.5 |
| Example 110 | ResinB(43) | 2.500 | ResinD(41) | 2.500 | 50.0% | 100% | (F-3) | 90000 | 8 | (1-6)/(1-7) | 3.5/3.5 |
| Example 111 | ResinB(43) | 2.500 | ResinD(41) | 2.500 | 50.0% | 100% | (F-4) | 100000 | 8 | (1-6)/(1-7) | 3.5/3.5 |
| Example 112 | ResinB(43) | 2.500 | ResinD(41) | 2.500 | 50.0% | 100% | (F-6) | 80000 | 8 | (1-6)/(1-7) | 3.5/3.5 |
| Example 113 | ResinB(43) | 2.500 | ResinD(41) | 2.500 | 50.0% | 100% | (F-5)/(F-7) | 80000 | 6.4/1.6 | (1-6)/(1-7) | 3.5/3.5 |
| Example 114 | ResinB(43) | 2.500 | ResinD(41) | 2.500 | 50.0% | 100% | (F-1)/(F-9) | 90000 | 6.4/1.6 | (1-6)/(1-7) | 3.5/3.5 |
| Example 115 | ResinB(43) | 2.500 | ResinD(41) | 2.500 | 50.0% | 100% | (G-1) | 120000 | 8 | (1-6)/(1-7) | 3.5/3.5 |
| Example 116 | ResinB(43) | 2.500 | ResinD(41) | 2.500 | 50.0% | 100% | (G-2) | 120000 | 8 | (1-6)/(1-7) | 3.5/3.5 |
| Example 117 | ResinB(43) | 2.500 | ResinD(41) | 2.500 | 50.0% | 100% | (G-6) | 150000 | 8 | (1-6)/(1-7) | 3.5/3.5 |
| Example 118 | ResinB(43) | 2.500 | ResinD(41) | 2.500 | 50.0% | 100% | (G-7) | 150000 | 8 | (1-6)/(1-7) | 3.5/3.5 |
| Example 119 | ResinB(43) | 2.500 | ResinD(41) | 2.500 | 50.0% | 100% | (F-10) | 100000 | 5 | (1-1)/(1-2) | 5/5 |
| Example 120 | ResinB(43) | 2.500 | ResinD(41) | 2.500 | 50.0% | 100% | (F-10) | 100000 | 5 | (1-3) | 10 |
| Example 121 | ResinB(43) | 2.500 | ResinD(41) | 2.500 | 50.0% | 100% | (F-10) | 100000 | 5 | (1-4)/(1-5) | 5/5 |
| Example 122 | ResinB(43) | 2.500 | ResinD(41) | 2.500 | 50.0% | 100% | (F-10) | 100000 | 8 | (1-8)/(1-9) | 3.5/3.5 |
| Example 123 | ResinB(43) | 2.500 | ResinD(41) | 2.500 | 50.0% | 100% | (F-10) | 100000 | 8 | (2-1) | 7 |
| Example 124 | ResinB(43) | 2.500 | ResinD(41) | 2.500 | 50.0% | 100% | (F-10) | 100000 | 5 | (2-1)/(3-1) | 5/5 |
| Example 125 | ResinB(43) | 2.500 | ResinD(41) | 2.500 | 50.0% | 100% | (F-10) | 100000 | 8 | (2-3) | 7 |
| Example 126 | ResinB(43) | 2.500 | ResinD(41) | 2.500 | 50.0% | 100% | (F-10) | 100000 | 8 | (2-4) | 7 |
| Example 127 | ResinB(43) | 2.500 | ResinD(41) | 2.500 | 50.0% | 100% | (F-10) | 100000 | 8 | (2-5) | 7 |
| Example 128 | ResinB(43) | 2.500 | ResinD(41) | 2.500 | 50.0% | 100% | (F-10) | 100000 | 8 | (2-6) | 7 |
| Example 129 | ResinB(43) | 2.500 | ResinD(2) | 2.500 | 50.0% | 100% | (F-10) | 100000 | 8 | (1-6)/(1-7) | 3.5/3.5 |
| Example 130 | ResinB(43) | 2.500 | ResinD(18) | 2.500 | 50.0% | 100% | (F-10) | 100000 | 8 | (1-6)/(1-7) | 3.5/3.5 |
| Example 131 | ResinB(43) | 2.500 | ResinD(33) | 2.500 | 50.0% | 100% | (F-10) | 100000 | 8 | (1-6)/(1-7) | 3.5/3.5 |
| Example 132 | ResinB(43) | 2.500 | ResinE(2) | 2.500 | 50.0% | 100% | (F-10) | 100000 | 8 | (1-6)/(1-7) | 3.5/3.5 |
| Example 133 | ResinB(43) | 2.500 | ResinE(33) | 2.500 | 50.0% | 100% | (F-10) | 100000 | 8 | (1-6)/(1-7) | 3.5/3.5 |

TABLE 7-continued

| | [α] | | | | | | [β] | | | | |
|---|---|---|---|---|---|---|---|---|---|---|---|
| | Resin [α1] | | Resin [α2] | | Resin [α1] | [α] | | Weight-average | | [γ] | |
| | Type of resin | Part | Type of resin | Part | content | content | Type of resin | molecular weight | Part | Type of CTM | Part |
| Example 134 | ResinB(47) | 0.050 | ResinD(44) | 4.950 | 1.0% | 100% | (F-1) | 80000 | 8 | (2-1) | 7 |
| Example 135 | ResinB(52) | 0.005 | ResinD(49) | 4.995 | 0.1% | 100% | (F-5)/(F-7) | 80000 | 4/1 | (1-8)/(1-9) | 5/5 |
| Example 136 | ResinB(52) | 0.050 | ResinD(49) | 4.950 | 1.0% | 100% | (F-5)/(F-7) | 80000 | 4/1 | (1-8)/(1-9) | 5/5 |
| Example 137 | ResinB(52) | 0.250 | ResinD(49) | 4.750 | 5.0% | 100% | (F-5)/(F-7) | 80000 | 4/1 | (1-8)/(1-9) | 5/5 |
| Example 138 | ResinB(52) | 1.000 | ResinD(49) | 4.000 | 20.0% | 100% | (F-5)/(F-7) | 80000 | 4/1 | (1-8)/(1-9) | 5/5 |
| Example 139 | ResinB(52) | 2.500 | ResinD(49) | 2.500 | 50.0% | 100% | (F-5)/(F-7) | 80000 | 4/1 | (1-8)/(1-9) | 5/5 |
| Example 140 | ResinB(52) | 5.000 | | | 100.0% | 100% | (F-5)/(F-7) | 80000 | 4/1 | (1-8)/(1-9) | 5/5 |
| Example 141 | ResinB(48) | 0.100 | ResinD(45) | 4.900 | 2.0% | 100% | (F-5)/(F-7) | 80000 | 4/1 | (1-8)/(1-9) | 5/5 |
| Example 142 | ResinB(49) | 0.100 | ResinD(46) | 4.900 | 2.0% | 100% | (F-5)/(F-7) | 80000 | 4/1 | (1-8)/(1-9) | 5/5 |
| Example 143 | ResinB(50) | 0.100 | ResinD(47) | 4.900 | 2.0% | 100% | (F-5)/(F-7) | 80000 | 4/1 | (1-8)/(1-9) | 5/5 |
| Example 144 | ResinB(51) | 0.100 | ResinD(48) | 4.900 | 2.0% | 100% | (F-5)/(F-7) | 80000 | 4/1 | (1-8)/(1-9) | 5/5 |
| Example 145 | ResinB(53) | 0.100 | ResinD(46) | 4.900 | 2.0% | 100% | (F-5)/(F-7) | 80000 | 4/1 | (1-8)/(1-9) | 5/5 |
| Example 146 | ResinB(54) | 0.100 | ResinD(50) | 4.900 | 2.0% | 100% | (F-5)/(F-7) | 80000 | 4/1 | (1-8)/(1-9) | 5/5 |
| Example 147 | ResinB(55) | 0.100 | ResinD(51) | 4.900 | 2.0% | 100% | (F-5)/(F-7) | 80000 | 4/1 | (1-8)/(1-9) | 5/5 |
| Example 148 | ResinB(53) | 0.100 | ResinD(46) | 4.900 | 2.0% | 100% | (F-1) | 80000 | 5 | (1-8)/(1-9) | 5/5 |
| Example 149 | ResinB(53) | 0.100 | ResinD(46) | 4.900 | 2.0% | 100% | (F-2) | 70000 | 5 | (1-8)/(1-9) | 5/5 |
| Example 150 | ResinB(53) | 0.100 | ResinD(46) | 4.900 | 2.0% | 100% | (F-3) | 90000 | 5 | (1-8)/(1-9) | 5/5 |
| Example 151 | ResinB(53) | 0.100 | ResinD(46) | 4.900 | 2.0% | 100% | (F-4) | 100000 | 5 | (1-8)/(1-9) | 5/5 |
| Example 152 | ResinB(53) | 0.100 | ResinD(46) | 4.900 | 2.0% | 100% | (F-6) | 80000 | 5 | (1-8)/(1-9) | 5/5 |
| Example 153 | ResinB(53) | 0.100 | ResinD(46) | 4.900 | 2.0% | 100% | (F-1)/(F-9) | 90000 | 4/1 | (1-8)/(1-9) | 5/5 |
| Example 154 | ResinB(53) | 0.100 | ResinD(46) | 4.900 | 2.0% | 100% | (F-10) | 100000 | 5 | (1-8)/(1-9) | 5/5 |
| Example 155 | ResinB(53) | 0.100 | ResinD(46) | 4.900 | 2.0% | 100% | (G-1) | 120000 | 5 | (1-8)/(1-9) | 5/5 |
| Example 156 | ResinB(53) | 0.100 | ResinD(46) | 4.900 | 2.0% | 100% | (G-2) | 120000 | 5 | (1-8)/(1-9) | 5/5 |
| Example 157 | ResinB(53) | 0.100 | ResinD(46) | 4.900 | 2.0% | 100% | (G-6) | 150000 | 5 | (1-8)/(1-9) | 5/5 |
| Example 158 | ResinB(53) | 0.100 | ResinD(46) | 4.900 | 2.0% | 100% | (G-7) | 150000 | 5 | (1-8)/(1-9) | 5/5 |
| Example 159 | ResinB(53) | 0.100 | ResinD(46) | 4.900 | 2.0% | 100% | (F-5)/(F-7) | 80000 | 4/1 | (1-1)/(1-2) | 5/5 |

TABLE 8

| | [α] | | | | Resin | | [β] | | | | |
|---|---|---|---|---|---|---|---|---|---|---|---|
| | Resin [α1] | | Resin [α2] | | [α1] | | | Weight-average | | [γ] | |
| | Type of resin | Part | Type of resin | Part | content | [α] content | Type of resin | molecular weight | Part | Type of CTM | Part |
| Example 160 | Resin B(53) | 0.100 | Resin D(46) | 4.900 | 2.0% | 100% | (F-5)/(F-7) | 80000 | 4/1 | (1-3) | 10 |
| Example 161 | Resin B(53) | 0.100 | Resin D(46) | 4.900 | 2.0% | 100% | (F-5)/(F-7) | 80000 | 4/1 | (1-4)/(1-5) | 5/5 |
| Example 162 | Resin B(53) | 0.100 | Resin D(46) | 4.900 | 2.0% | 100% | (F-5)/(F-7) | 80000 | 6.4/1.6 | (1-6)/(1-7) | 3.5/3.5 |
| Example 163 | Resin B(53) | 0.100 | Resin D(46) | 4.900 | 2.0% | 100% | (F-5)/(F-7) | 80000 | 6.4/1.6 | (2-1) | 7 |
| Example 164 | Resin B(53) | 0.100 | Resin D(46) | 4.900 | 2.0% | 100% | (F-5)/(F-7) | 80000 | 4/1 | (2-1)/(3-1) | 5/5 |
| Example 165 | Resin B(53) | 0.100 | Resin D(46) | 4.900 | 2.0% | 100% | (F-5)/(F-7) | 80000 | 6.4/1.6 | (2-3) | 7 |
| Example 166 | Resin B(53) | 0.100 | Resin D(46) | 4.900 | 2.0% | 100% | (F-5)/(F-7) | 80000 | 6.4/1.6 | (2-4) | 7 |
| Example 167 | Resin B(53) | 0.100 | Resin D(46) | 4.900 | 2.0% | 100% | (F-5)/(F-7) | 80000 | 6.4/1.6 | (2-5) | 7 |
| Example 168 | Resin B(53) | 0.100 | Resin D(46) | 4.900 | 2.0% | 100% | (F-5)/(F-7) | 80000 | 6.4/1.6 | (2-6) | 7 |
| Example 169 | Resin B(53) | 0.100 | Resin D(2) | 4.900 | 2.0% | 100% | (F-5)/(F-7) | 80000 | 4/1 | (1-8)/(1-9) | 5/5 |
| Example 170 | Resin B(53) | 0.100 | Resin D(18) | 4.900 | 2.0% | 100% | (F-5)/(F-7) | 80000 | 4/1 | (1-8)/(1-9) | 5/5 |
| Example 171 | Resin B(53) | 0.100 | Resin D(33) | 4.900 | 2.0% | 100% | (F-5)/(F-7) | 80000 | 4/1 | (1-8)/(1-9) | 5/5 |
| Example 172 | Resin B(53) | 0.100 | Resin E(2) | 4.900 | 2.0% | 100% | (F-5)/(F-7) | 80000 | 4/1 | (1-8)/(1-9) | 5/5 |
| Example 173 | Resin B(53) | 0.100 | Resin E(33) | 4.900 | 2.0% | 100% | (F-5)/(F-7) | 80000 | 4/1 | (1-8)/(1-9) | 5/5 |
| Example 174 | Resin C(2) | 0.005 | Resin E(2) | 4.995 | 0.1% | 100% | (G-1) | 120000 | 5 | (1-1)/(1-2) | 5/5 |
| Example 175 | Resin C(2) | 0.050 | Resin E(2) | 4.950 | 1.0% | 100% | (G-1) | 120000 | 5 | (1-1)/(1-2) | 5/5 |
| Example 176 | Resin C(2) | 0.250 | Resin E(2) | 4.750 | 5.0% | 100% | (G-1) | 120000 | 5 | (1-1)/(1-2) | 5/5 |
| Example 177 | Resin C(2) | 1.000 | Resin E(2) | 4.000 | 20.0% | 100% | (G-1) | 120000 | 5 | (1-1)/(1-2) | 5/5 |
| Example 178 | Resin C(2) | 2.500 | Resin E(2) | 2.500 | 50.0% | 100% | (G-1) | 120000 | 5 | (1-1)/(1-2) | 5/5 |
| Example 179 | Resin C(2) | 5.000 | | | 100.0% | 100% | (G-1) | 120000 | 5 | (1-1)/(1-2) | 5/5 |
| Example 180 | Resin C(3) | 0.250 | Resin E(3) | 4.750 | 5.0% | 100% | (G-1) | 120000 | 5 | (1-1)/(1-2) | 5/5 |
| Example 181 | Resin C(4) | 0.250 | Resin E(4) | 4.750 | 5.0% | 100% | (G-1) | 120000 | 5 | (1-1)/(1-2) | 5/5 |
| Example 182 | Resin C(6) | 0.250 | Resin E(6) | 4.750 | 5.0% | 100% | (G-1) | 120000 | 5 | (1-1)/(1-2) | 5/5 |
| Example 183 | Resin C(7) | 0.250 | Resin E(7) | 4.750 | 5.0% | 100% | (G-1) | 120000 | 5 | (1-1)/(1-2) | 5/5 |
| Example 184 | Resin C(8) | 0.250 | Resin E(8) | 4.750 | 5.0% | 100% | (G-1) | 120000 | 5 | (1-1)/(1-2) | 5/5 |
| Example 185 | Resin C(9) | 0.250 | Resin E(2) | 4.750 | 5.0% | 100% | (G-1) | 120000 | 5 | (1-1)/(1-2) | 5/5 |
| Example 186 | Resin C(10) | 0.250 | Resin E(2) | 4.750 | 5.0% | 100% | (G-1) | 120000 | 5 | (1-1)/(1-2) | 5/5 |
| Example 187 | Resin C(11) | 0.250 | Resin E(9) | 4.750 | 5.0% | 100% | (G-1) | 120000 | 5 | (1-1)/(1-2) | 5/5 |
| Example 188 | Resin C(12) | 0.250 | Resin E(10) | 4.750 | 5.0% | 100% | (G-1) | 120000 | 5 | (1-1)/(1-2) | 5/5 |
| Example 189 | Resin C(13) | 0.250 | Resin E(11) | 4.750 | 5.0% | 100% | (G-1) | 120000 | 5 | (1-1)/(1-2) | 5/5 |
| Example 190 | Resin C(14) | 0.250 | Resin E(12) | 4.750 | 5.0% | 100% | (G-1) | 120000 | 5 | (1-1)/(1-2) | 5/5 |
| Example 191 | Resin C(15) | 0.250 | Resin E(2) | 4.750 | 5.0% | 100% | (G-1) | 120000 | 5 | (1-1)/(1-2) | 5/5 |
| Example 192 | Resin C(30) | 0.250 | Resin E(25) | 4.750 | 5.0% | 100% | (G-1) | 120000 | 5 | (1-1)/(1-2) | 5/5 |
| Example 193 | Resin C(2) | 0.250 | Resin E(2) | 4.750 | 5.0% | 100% | (F-1) | 80000 | 5 | (1-1)/(1-2) | 5/5 |
| Example 194 | Resin C(2) | 0.250 | Resin E(2) | 4.750 | 5.0% | 100% | (F-2) | 70000 | 5 | (1-1)/(1-2) | 5/5 |
| Example 195 | Resin C(2) | 0.250 | Resin E(2) | 4.750 | 5.0% | 100% | (F-5)/(F-7) | 80000 | 4/1 | (1-1)/(1-2) | 5/5 |

TABLE 8-continued

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 196 | Resin C(2) | 0.250 | Resin E(2) | 4.750 | 5.0% | 100% | (F-6) | 80000 | 5 | (1-1)/(1-2) | 5/5 |
| Example 197 | Resin C(2) | 0.250 | Resin E(2) | 4.750 | 5.0% | 100% | (F-10) | 100000 | 5 | (1-1)/(1-2) | 5/5 |
| Example 198 | Resin C(2) | 0.250 | Resin E(2) | 4.750 | 5.0% | 100% | (G-2) | 120000 | 5 | (1-1)/(1-2) | 5/5 |
| Example 199 | Resin C(2) | 0.250 | Resin E(2) | 4.750 | 5.0% | 100% | (G-4) | 100000 | 5 | (1-1)/(1-2) | 5/5 |
| Example 200 | Resin C(2) | 0.250 | Resin E(2) | 4.750 | 5.0% | 100% | (G-5) | 80000 | 5 | (1-1)/(1-2) | 5/5 |
| Example 201 | Resin C(2) | 0.250 | Resin E(2) | 4.750 | 5.0% | 100% | (G-6) | 150000 | 5 | (1-1)/(1-2) | 5/5 |
| Example 202 | Resin C(2) | 0.250 | Resin E(2) | 4.750 | 5.0% | 100% | (G-7) | 150000 | 5 | (1-1)/(1-2) | 5/5 |
| Example 203 | Resin C(2) | 0.250 | Resin E(2) | 4.750 | 5.0% | 100% | (G-1) | 120000 | 8 | (1-3) | 7 |
| Example 204 | Resin C(2) | 0.250 | Resin E(2) | 4.750 | 5.0% | 100% | (G-1) | 120000 | 5 | (1-4)/(1-5) | 5/5 |
| Example 205 | Resin C(2) | 0.250 | Resin E(2) | 4.750 | 5.0% | 100% | (G-1) | 120000 | 8 | (1-6)/(1-7) | 3.5/3.5 |
| Example 206 | Resin C(2) | 0.250 | Resin E(2) | 4.750 | 5.0% | 100% | (G-1) | 120000 | 5 | (1-8)/(1-9) | 5/5 |
| Example 207 | Resin C(2) | 0.250 | Resin E(2) | 4.750 | 5.0% | 100% | (G-1) | 120000 | 8 | (2-1) | 7 |
| Example 208 | Resin C(2) | 0.250 | Resin E(2) | 4.750 | 5.0% | 100% | (G-1) | 120000 | 5 | (2-1)/(3-1) | 5/5 |
| Example 209 | Resin C(2) | 0.250 | Resin E(2) | 4.750 | 5.0% | 100% | (G-1) | 120000 | 8 | (2-3) | 7 |
| Example 210 | Resin C(2) | 0.250 | Resin E(2) | 4.750 | 5.0% | 100% | (G-1) | 120000 | 8 | (2-4) | 7 |
| Example 211 | Resin C(2) | 0.250 | Resin E(2) | 4.750 | 5.0% | 100% | (G-1) | 120000 | 8 | (2-5) | 7 |
| Example 212 | Resin C(2) | 0.250 | Resin E(2) | 4.750 | 5.0% | 100% | (G-1) | 120000 | 8 | (2-6) | 7 |
| Example 213 | Resin C(2) | 0.250 | Resin D(18) | 4.750 | 5.0% | 100% | (G-1) | 120000 | 5 | (1-1)/(1-2) | 5/5 |
| Example 214 | Resin C(2) | 0.250 | Resin D(33) | 4.750 | 5.0% | 100% | (G-1) | 120000 | 5 | (1-1)/(1-2) | 5/5 |

TABLE 9

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 215 | Resin C(2) | 0.250 | Resin D(44) | 4.750 | 5.0% | 100% | (G-1) | 120000 | 5 | (1-1)/(1-2) | 5/5 |
| Example 216 | Resin C(2) | 0.250 | Resin E(16) | 4.750 | 5.0% | 100% | (G-1) | 120000 | 5 | (1-1)/(1-2) | 5/5 |
| Example 217 | Resin C(2) | 0.250 | Resin E(29) | 4.750 | 5.0% | 100% | (G-1) | 120000 | 5 | (1-1)/(1-2) | 5/5 |
| Example 218 | Resin C(2) | 0.250 | Resin E(33) | 4.750 | 5.0% | 100% | (G-1) | 120000 | 5 | (1-1)/(1-2) | 5/5 |
| Example 219 | Resin C(17) | 0.005 | Resin E(16) | 4.995 | 0.1% | 100% | (G-2) | 120000 | 8 | (1-6)/(1-7) | 3.5/3.5 |
| Example 220 | Resin C(17) | 0.050 | Resin E(16) | 4.950 | 1.0% | 100% | (G-2) | 120000 | 8 | (1-6)/(1-7) | 3.5/3.5 |
| Example 221 | Resin C(17) | 0.250 | Resin E(16) | 4.750 | 5.0% | 100% | (G-2) | 120000 | 8 | (1-6)/(1-7) | 3.5/3.5 |
| Example 222 | Resin C(17) | 1.000 | Resin E(16) | 4.000 | 20.0% | 100% | (G-2) | 120000 | 8 | (1-6)/(1-7) | 3.5/3.5 |
| Example 223 | Resin C(17) | 2.500 | Resin E(16) | 2.500 | 50.0% | 100% | (G-2) | 120000 | 8 | (1-6)/(1-7) | 3.5/3.5 |
| Example 224 | Resin C(17) | 5.000 | | | 100.0% | 100% | (G-2) | 120000 | 8 | (1-6)/(1-7) | 3.5/3.5 |
| Example 225 | Resin C(19) | 0.050 | Resin E(16) | 4.950 | 1.0% | 100% | (G-2) | 120000 | 8 | (1-6)/(1-7) | 3.5/3.5 |
| Example 226 | Resin C(21) | 0.050 | Resin E(19) | 4.950 | 1.0% | 100% | (G-2) | 120000 | 8 | (1-6)/(1-7) | 3.5/3.5 |
| Example 227 | Resin C(22) | 0.050 | Resin E(20) | 4.950 | 1.0% | 100% | (G-2) | 120000 | 8 | (1-6)/(1-7) | 3.5/3.5 |
| Example 228 | Resin C(23) | 0.050 | Resin E(21) | 4.950 | 1.0% | 100% | (G-2) | 120000 | 8 | (1-6)/(1-7) | 3.5/3.5 |
| Example 229 | Resin C(24) | 0.050 | Resin E(22) | 4.950 | 1.0% | 100% | (G-2) | 120000 | 8 | (1-6)/(1-7) | 3.5/3.5 |
| Example 230 | Resin C(25) | 0.050 | Resin E(23) | 4.950 | 1.0% | 100% | (G-2) | 120000 | 8 | (1-6)/(1-7) | 3.5/3.5 |
| Example 231 | Resin C(26) | 0.050 | Resin E(24) | 4.950 | 1.0% | 100% | (G-2) | 120000 | 8 | (1-6)/(1-7) | 3.5/3.5 |
| Example 232 | Resin C(27) | 0.050 | Resin E(13) | 4.950 | 1.0% | 100% | (G-2) | 120000 | 8 | (1-6)/(1-7) | 3.5/3.5 |
| Example 233 | Resin C(28) | 0.050 | Resin E(13) | 4.950 | 1.0% | 100% | (G-2) | 120000 | 8 | (1-6)/(1-7) | 3.5/3.5 |
| Example 234 | Resin C(29) | 0.050 | Resin E(13) | 4.950 | 1.0% | 100% | (G-2) | 120000 | 8 | (1-6)/(1-7) | 3.5/3.5 |
| Example 235 | Resin C(18) | 0.050 | Resin E(16) | 4.950 | 1.0% | 100% | (F-1) | 80000 | 8 | (1-6)/(1-7) | 3.5/3.5 |
| Example 236 | Resin C(18) | 0.050 | Resin E(16) | 4.950 | 1.0% | 100% | (F-2) | 70000 | 8 | (1-6)/(1-7) | 3.5/3.5 |
| Example 237 | Resin C(18) | 0.050 | Resin E(16) | 4.950 | 1.0% | 100% | (F-5)/(F-7) | 80000 | 6.4/1.6 | (1-6)/(1-7) | 3.5/3.5 |
| Example 238 | Resin C(18) | 0.050 | Resin E(16) | 4.950 | 1.0% | 100% | (F-6) | 80000 | 8 | (1-6)/(1-7) | 3.5/3.5 |
| Example 239 | Resin C(18) | 0.050 | Resin E(16) | 4.950 | 1.0% | 100% | (F-10) | 100000 | 8 | (1-6)/(1-7) | 3.5/3.5 |
| Example 240 | Resin C(18) | 0.050 | Resin E(16) | 4.950 | 1.0% | 100% | (G-1) | 120000 | 8 | (1-6)/(1-7) | 3.5/3.5 |
| Example 241 | Resin C(18) | 0.050 | Resin E(16) | 4.950 | 1.0% | 100% | (G-4) | 100000 | 8 | (1-6)/(1-7) | 3.5/3.5 |
| Example 242 | Resin C(18) | 0.050 | Resin E(16) | 4.950 | 1.0% | 100% | (G-5) | 80000 | 8 | (1-6)/(1-7) | 3.5/3.5 |
| Example 243 | Resin C(18) | 0.050 | Resin E(16) | 4.950 | 1.0% | 100% | (G-6) | 150000 | 8 | (1-6)/(1-7) | 3.5/3.5 |
| Example 244 | Resin C(18) | 0.050 | Resin E(16) | 4.950 | 1.0% | 100% | (G-7) | 150000 | 8 | (1-6)/(1-7) | 3.5/3.5 |
| Example 245 | Resin C(18) | 0.050 | Resin E(16) | 4.950 | 1.0% | 100% | (G-2) | 120000 | 5 | (1-1)/(1-2) | 5/5 |
| Example 246 | Resin C(18) | 0.050 | Resin E(16) | 4.950 | 1.0% | 100% | (G-2) | 120000 | 8 | (1-3) | 7 |
| Example 247 | Resin C(18) | 0.050 | Resin E(16) | 4.950 | 1.0% | 100% | (G-2) | 120000 | 5 | (1-4)/(1-5) | 5/5 |
| Example 248 | Resin C(18) | 0.050 | Resin E(16) | 4.950 | 1.0% | 100% | (G-2) | 120000 | 5 | (1-8)/(1-9) | 5/5 |
| Example 249 | Resin C(18) | 0.050 | Resin E(16) | 4.950 | 1.0% | 100% | (G-2) | 120000 | 8 | (2-1) | 7 |
| Example 250 | Resin C(18) | 0.050 | Resin E(16) | 4.950 | 1.0% | 100% | (G-2) | 120000 | 5 | (2-1)/(3-1) | 5/5 |
| Example 251 | Resin C(18) | 0.050 | Resin E(16) | 4.950 | 1.0% | 100% | (G-2) | 120000 | 8 | (2-3) | 7 |
| Example 252 | Resin C(18) | 0.050 | Resin E(16) | 4.950 | 1.0% | 100% | (G-2) | 120000 | 8 | (2-4) | 7 |
| Example 253 | Resin C(18) | 0.050 | Resin E(16) | 4.950 | 1.0% | 100% | (G-2) | 120000 | 8 | (2-5) | 7 |
| Example 254 | Resin C(18) | 0.050 | Resin E(16) | 4.950 | 1.0% | 100% | (G-2) | 120000 | 8 | (2-6) | 7 |
| Example 255 | Resin C(18) | 0.050 | Resin D(18) | 4.950 | 1.0% | 100% | (G-2) | 120000 | 8 | (1-6)/(1-7) | 3.5/3.5 |
| Example 256 | Resin C(18) | 0.050 | Resin D(33) | 4.950 | 1.0% | 100% | (G-2) | 120000 | 8 | (1-6)/(1-7) | 3.5/3.5 |
| Example 257 | Resin C(18) | 0.050 | Resin D(44) | 4.950 | 1.0% | 100% | (G-2) | 120000 | 8 | (1-6)/(1-7) | 3.5/3.5 |

TABLE 9-continued

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 258 | Resin C(18) | 0.050 | Resin E(2) | 4.950 | 1.0% | 100% | (G-2) | 120000 | 8 | (1-6)/(1-7) | 3.5/3.5 |
| Example 259 | Resin C(18) | 0.050 | Resin E(29) | 4.950 | 1.0% | 100% | (G-2) | 120000 | 8 | (1-6)/(1-7) | 3.5/3.5 |
| Example 260 | Resin C(18) | 0.050 | Resin E(33) | 4.950 | 1.0% | 100% | (G-2) | 120000 | 8 | (1-6)/(1-7) | 3.5/3.5 |
| Example 261 | Resin C(40) | 0.005 | Resin E(34) | 4.995 | 0.1% | 100% | (G-7) | 150000 | 8 | (2-1) | 7 |
| Example 262 | Resin C(40) | 0.050 | Resin E(34) | 4.950 | 1.0% | 100% | (G-7) | 150000 | 8 | (2-1) | 7 |
| Example 263 | Resin C(40) | 0.250 | Resin E(34) | 4.750 | 5.0% | 100% | (G-7) | 150000 | 8 | (2-1) | 7 |
| Example 264 | Resin C(40) | 1.000 | Resin E(34) | 4.000 | 20.0% | 100% | (G-7) | 150000 | 8 | (2-1) | 7 |
| Example 265 | Resin C(40) | 2.500 | Resin E(34) | 2.500 | 50.0% | 100% | (G-7) | 150000 | 8 | (2-1) | 7 |
| Example 266 | Resin C(40) | 5.000 | | | 100.0% | 100% | (G-7) | 150000 | 8 | (2-1) | 7 |
| Example 267 | Resin C(44) | 2.500 | Resin E(37) | 2.500 | 50.0% | 100% | (G-7) | 150000 | 8 | (2-1) | 7 |
| Example 268 | Resin C(45) | 2.500 | Resin E(38) | 2.500 | 50.0% | 100% | (G-7) | 150000 | 8 | (2-1) | 7 |
| Example 269 | Resin C(46) | 2.500 | Resin E(39) | 2.500 | 50.0% | 100% | (G-7) | 150000 | 8 | (2-1) | 7 |
| Example 270 | Resin C(47) | 2.500 | Resin E(40) | 2.500 | 50.0% | 100% | (G-7) | 150000 | 8 | (2-1) | 7 |

TABLE 10

| | [α] | | | | Resin | | [β] | | | [γ] | |
|---|---|---|---|---|---|---|---|---|---|---|---|
| | Resin [α1] | | Resin [α2] | | [α1] | | | Weight-average | | | |
| | Type of resin | Part | Type of resin | Part | content | [α] content | Type of resin | molecular weight | Part | Type of CTM | Part |
| Example 271 | Resin C(48) | 2.500 | Resin E(41) | 2.500 | 50.0% | 100% | (G-7) | 150000 | 8 | (2-1) | 7 |
| Example 272 | Resin C(49) | 2.500 | Resin E(42) | 2.500 | 50.0% | 100% | (G-7) | 150000 | 8 | (2-1) | 7 |
| Example 273 | Resin C(50) | 2.500 | Resin E(43) | 2.500 | 50.0% | 100% | (G-7) | 150000 | 8 | (2-1) | 7 |
| Example 274 | Resin C(40) | 2.500 | Resin E(34) | 2.500 | 50.0% | 100% | (F-1) | 80000 | 8 | (2-1) | 7 |
| Example 275 | Resin C(40) | 2.500 | Resin E(34) | 2.500 | 50.0% | 100% | (F-2) | 70000 | 8 | (2-1) | 7 |
| Example 276 | Resin C(40) | 2.500 | Resin E(34) | 2.500 | 50.0% | 100% | (F-5)/(F-7) | 80000 | 6.4/1.6 | (2-1) | 7 |
| Example 277 | Resin C(40) | 2.500 | Resin E(34) | 2.500 | 50.0% | 100% | (F-6) | 80000 | 8 | (2-1) | 7 |
| Example 278 | Resin C(40) | 2.500 | Resin E(34) | 2.500 | 50.0% | 100% | (F-10) | 100000 | 8 | (2-1) | 7 |
| Example 279 | Resin C(40) | 2.500 | Resin E(34) | 2.500 | 50.0% | 100% | (G-1) | 120000 | 8 | (2-1) | 7 |
| Example 280 | Resin C(40) | 2.500 | Resin E(34) | 2.500 | 50.0% | 100% | (G-2) | 120000 | 8 | (2-1) | 7 |
| Example 281 | Resin C(40) | 2.500 | Resin E(34) | 2.500 | 50.0% | 100% | (G-4) | 100000 | 8 | (2-1) | 7 |
| Example 282 | Resin C(40) | 2.500 | Resin E(34) | 2.500 | 50.0% | 100% | (G-5) | 80000 | 8 | (2-1) | 7 |
| Example 283 | Resin C(40) | 2.500 | Resin E(34) | 2.500 | 50.0% | 100% | (G-6) | 150000 | 8 | (2-1) | 7 |
| Example 284 | Resin C(40) | 2.500 | Resin E(34) | 2.500 | 50.0% | 100% | (G-7) | 150000 | 5 | (1-1)/(1-2) | 5/5 |
| Example 285 | Resin C(40) | 2.500 | Resin E(34) | 2.500 | 50.0% | 100% | (G-7) | 150000 | 8 | (1-3) | 7 |
| Example 286 | Resin C(40) | 2.500 | Resin E(34) | 2.500 | 50.0% | 100% | (G-7) | 150000 | 5 | (1-4)/(1-5) | 5/5 |
| Example 287 | Resin C(40) | 2.500 | Resin E(34) | 2.500 | 50.0% | 100% | (G-7) | 150000 | 8 | (1-6)/(1-7) | 3.5/3.5 |
| Example 288 | Resin C(40) | 2.500 | Resin E(34) | 2.500 | 50.0% | 100% | (G-7) | 150000 | 5 | (1-8)/(1-9) | 5/5 |
| Example 289 | Resin C(40) | 2.500 | Resin E(34) | 2.500 | 50.0% | 100% | (G-7) | 150000 | 5 | (2-1)/(3-1) | 5/5 |
| Example 290 | Resin C(40) | 2.500 | Resin E(34) | 2.500 | 50.0% | 100% | (G-7) | 150000 | 8 | (2-3) | 7 |
| Example 291 | Resin C(40) | 2.500 | Resin E(34) | 2.500 | 50.0% | 100% | (G-7) | 150000 | 8 | (2-4) | 7 |
| Example 292 | Resin C(40) | 2.500 | Resin E(34) | 2.500 | 50.0% | 100% | (G-7) | 150000 | 8 | (2-5) | 7 |
| Example 293 | Resin C(40) | 2.500 | Resin E(34) | 2.500 | 50.0% | 100% | (G-7) | 150000 | 8 | (2-6) | 7 |
| Example 294 | Resin C(40) | 2.500 | Resin D(18) | 2.500 | 50.0% | 100% | (G-7) | 150000 | 8 | (2-1) | 7 |
| Example 295 | Resin C(40) | 2.500 | Resin D(33) | 2.500 | 50.0% | 100% | (G-7) | 150000 | 8 | (2-1) | 7 |
| Example 296 | Resin C(40) | 2.500 | Resin D(44) | 2.500 | 50.0% | 100% | (G-7) | 150000 | 8 | (2-1) | 7 |
| Example 297 | Resin C(40) | 2.500 | Resin E(2) | 2.500 | 50.0% | 100% | (G-7) | 150000 | 8 | (2-1) | 7 |
| Example 298 | Resin C(40) | 2.500 | Resin E(16) | 2.500 | 50.0% | 100% | (G-7) | 150000 | 8 | (2-1) | 7 |
| Example 299 | Resin C(40) | 2.500 | Resin E(29) | 2.500 | 50.0% | 100% | (G-7) | 150000 | 8 | (2-1) | 7 |

TABLE 11

| | [α] | | | | Another terminal- | | Resin | | [β] | | | [γ] | |
|---|---|---|---|---|---|---|---|---|---|---|---|---|---|
| | Resin [α1] | | Resin [α2] | | siloxane resin | | [α1] | | | Weight-average | | | |
| | Type of resin | Part | Type of resin | Part | Type of resin | Part | content | [α] content | Type of resin | molecular weight | Part | Type of CTM | Part |
| Example 300 | Resin C(40) | 0.500 | Resin E(34) | 2.500 | *Resin C(37) | 2.000 | 16.7% | 60.0% | (G-7) | 150000 | 8 | (2-1) | 7 |
| Example 301 | Resin B(20) | 0.250 | Resin D(19) | 3.750 | *Resin B(18) | 1.000 | 6.3% | 80.0% | (F-6) | 80000 | 5 | (1-3) | 10 |
| Example 302 | Resin B(20) | 0.500 | Resin D(19) | 2.500 | *Resin B(22) | 2.000 | 16.7% | 60.0% | (F-6) | 80000 | 5 | (1-3) | 10 |
| Example 303 | Resin C(40) | 0.250 | Resin E(34) | 3.750 | *Resin C(41) | 1.000 | 6.3% | 80.0% | (G-7) | 150000 | 8 | (2-1) | 7 |
| Example 304 | Resin B(20) | 0.500 | Resin D(19) | 2.500 | *Resin D(17) | 2.000 | 16.7% | 60.0% | (F-6) | 80000 | 5 | (1-3) | 10 |
| Example 305 | Resin C(40) | 0.250 | Resin E(34) | 3.750 | *Resin E(32) | 1.000 | 6.3% | 80.0% | (G-7) | 150000 | 8 | (2-1) | 7 |

TABLE 11-continued

| | [α] | | | | | | | | [β] | | | [γ] | |
|---|---|---|---|---|---|---|---|---|---|---|---|---|---|
| | Resin [α1] | | Resin [α2] | | Another terminal-siloxane resin | | Resin [α1] content | [α] content | Type of resin | Weight-average molecular weight | Part | Type of CTM | Part |
| | Type of resin | Part | Type of resin | Part | Type of resin | Part | | | | | | | |
| Example 306 | Resin C(40) | 0.500 | Resin E(34) | 2.500 | *Resin E(36) | 2.000 | 16.7% | 60.0% | (G-7) | 150000 | 8 | (2-1) | 7 |
| Example 307 | Resin B(20) | 0.250 | Resin D(19) | 3.750 | *Resin D(21) | 1.000 | 6.3% | 80.0% | (F-6) | 80000 | 5 | (1-3) | 10 |

The term "Component [γ]" in Tables 5 to 11 refers to the component [γ] in the charge-transporting layer. In the case of using a mixture of charge-transporting substances, the term refers to the types and mixing ratio of the component [γ] and another charge-transporting substance. The term "Resin [α1]" in Tables 5 to 11 refers to the composition of the resin [α1]. The term "Resin [α2]" in Tables 5 to 11 refers to the composition of the resin [α2]. The term "Resin [α1] content" in Tables 5 to 11 refers to the mass ratio (resin [α1]/component [α]) of the resin [α1] with respect to the whole resins in the component [α]. The term "[α] content" in Tables 5 to 11 refers to the component [α] content with respect to the total mass of the resin having a siloxane moiety at the end in the charge-transporting layer. The term "Component [β]" in Tables 5 to 11 refers to the composition of the component [β].

It should be noted that the resin B(18), resin B(22), resin C(37), resin C(41), resin D(17), resin D(21), resin E(32), and resin E(36) indicated by "*" in Table 11 are comparative resins.

TABLE 12

| | Potential variation (V) | Initial torque relative value | Torque relative value after repeated use of 2,000 sheets of paper | Particle size (nm) |
|---|---|---|---|---|
| Example 1 | 5 | 0.80 | 0.88 | 450 |
| Example 2 | 5 | 0.75 | 0.79 | 400 |
| Example 3 | 5 | 0.75 | 0.79 | 350 |
| Example 4 | 5 | 0.75 | 0.79 | 350 |
| Example 5 | 5 | 0.75 | 0.79 | 350 |
| Example 6 | 5 | 0.65 | 0.83 | 350 |
| Example 7 | 8 | 0.80 | 0.87 | 450 |
| Example 8 | 8 | 0.70 | 0.74 | 350 |
| Example 9 | 15 | 0.80 | 0.87 | 500 |
| Example 10 | 15 | 0.61 | 0.83 | 450 |
| Example 11 | 5 | 0.75 | 0.79 | 350 |
| Example 12 | 5 | 0.75 | 0.79 | 350 |
| Example 13 | 5 | 0.75 | 0.79 | 350 |
| Example 14 | 5 | 0.75 | 0.79 | 350 |
| Example 15 | 5 | 0.75 | 0.79 | 350 |
| Example 16 | 5 | 0.75 | 0.79 | 350 |
| Example 17 | 5 | 0.75 | 0.79 | 350 |
| Example 18 | 5 | 0.75 | 0.79 | 350 |
| Example 19 | 6 | 0.75 | 0.78 | 350 |
| Example 20 | 7 | 0.75 | 0.78 | 350 |
| Example 21 | 8 | 0.75 | 0.78 | 350 |
| Example 22 | 8 | 0.75 | 0.78 | 350 |
| Example 23 | 5 | 0.75 | 0.78 | 350 |
| Example 24 | 10 | 0.75 | 0.79 | 350 |
| Example 25 | 10 | 0.75 | 0.78 | 350 |
| Example 26 | 12 | 0.75 | 0.80 | 350 |
| Example 27 | 12 | 0.75 | 0.80 | 350 |
| Example 28 | 5 | 0.75 | 0.80 | 350 |
| Example 29 | 5 | 0.75 | 0.80 | 350 |
| Example 30 | 5 | 0.75 | 0.79 | 350 |
| Example 31 | 5 | 0.75 | 0.79 | 350 |
| Example 32 | 5 | 0.75 | 0.79 | 350 |
| Example 33 | 7 | 0.75 | 0.79 | 350 |
| Example 34 | 8 | 0.75 | 0.79 | 350 |
| Example 35 | 6 | 0.75 | 0.79 | 350 |

TABLE 12-continued

| | Potential variation (V) | Initial torque relative value | Torque relative value after repeated use of 2,000 sheets of paper | Particle size (nm) |
|---|---|---|---|---|
| Example 36 | 6 | 0.75 | 0.79 | 350 |
| Example 37 | 6 | 0.75 | 0.79 | 350 |
| Example 38 | 6 | 0.75 | 0.79 | 350 |
| Example 39 | 6 | 0.75 | 0.79 | 350 |
| Example 40 | 6 | 0.75 | 0.79 | 350 |
| Example 41 | 6 | 0.75 | 0.79 | 350 |
| Example 42 | 6 | 0.75 | 0.79 | 350 |
| Example 43 | 6 | 0.75 | 0.79 | 350 |
| Example 44 | 6 | 0.75 | 0.79 | 350 |
| Example 45 | 8 | 0.80 | 0.84 | 300 |
| Example 46 | 8 | 0.83 | 0.88 | 300 |
| Example 47 | 8 | 0.72 | 0.86 | 300 |
| Example 48 | 10 | 0.78 | 0.84 | 550 |
| Example 49 | 10 | 0.70 | 0.75 | 500 |
| Example 50 | 10 | 0.70 | 0.75 | 450 |
| Example 51 | 10 | 0.70 | 0.75 | 450 |
| Example 52 | 12 | 0.70 | 0.75 | 450 |
| Example 53 | 15 | 0.60 | 0.80 | 450 |
| Example 54 | 15 | 0.73 | 0.81 | 600 |
| Example 55 | 20 | 0.63 | 0.69 | 600 |
| Example 56 | 8 | 0.70 | 0.75 | 500 |
| Example 57 | 8 | 0.70 | 0.75 | 500 |
| Example 58 | 8 | 0.70 | 0.75 | 500 |
| Example 59 | 8 | 0.70 | 0.75 | 500 |
| Example 60 | 8 | 0.70 | 0.75 | 500 |
| Example 61 | 8 | 0.70 | 0.75 | 500 |
| Example 62 | 8 | 0.70 | 0.75 | 500 |
| Example 63 | 8 | 0.70 | 0.75 | 500 |
| Example 64 | 6 | 0.70 | 0.75 | 500 |
| Example 65 | 7 | 0.70 | 0.75 | 500 |
| Example 66 | 8 | 0.70 | 0.75 | 500 |
| Example 67 | 10 | 0.70 | 0.75 | 500 |
| Example 68 | 10 | 0.70 | 0.75 | 500 |
| Example 69 | 7 | 0.70 | 0.75 | 500 |
| Example 70 | 8 | 0.70 | 0.75 | 500 |
| Example 71 | 7 | 0.70 | 0.75 | 500 |
| Example 72 | 8 | 0.70 | 0.75 | 500 |
| Example 73 | 8 | 0.70 | 0.75 | 500 |
| Example 74 | 8 | 0.70 | 0.75 | 500 |
| Example 75 | 8 | 0.70 | 0.75 | 500 |
| Example 76 | 7 | 0.70 | 0.75 | 500 |
| Example 77 | 9 | 0.70 | 0.75 | 500 |
| Example 78 | 10 | 0.70 | 0.75 | 500 |
| Example 79 | 10 | 0.70 | 0.75 | 500 |
| Example 80 | 10 | 0.70 | 0.75 | 500 |
| Example 81 | 8 | 0.70 | 0.75 | 500 |
| Example 82 | 8 | 0.70 | 0.75 | 500 |
| Example 83 | 8 | 0.70 | 0.75 | 500 |
| Example 84 | 8 | 0.70 | 0.75 | 500 |
| Example 85 | 8 | 0.70 | 0.75 | 500 |
| Example 86 | 9 | 0.70 | 0.75 | 500 |
| Example 87 | 9 | 0.70 | 0.75 | 500 |
| Example 88 | 10 | 0.70 | 0.75 | 500 |
| Example 89 | 12 | 0.70 | 0.75 | 500 |
| Example 90 | 5 | 0.78 | 0.81 | 350 |
| Example 91 | 5 | 0.82 | 0.86 | 400 |
| Example 92 | 6 | 0.78 | 0.81 | 350 |
| Example 93 | 8 | 0.77 | 0.81 | 400 |
| Example 94 | 7 | 0.70 | 0.74 | 350 |

TABLE 12-continued

| | Potential variation (V) | Initial torque relative value | Torque relative value after repeated use of 2,000 sheets of paper | Particle size (nm) |
|---|---|---|---|---|
| Example 95 | 9 | 0.70 | 0.74 | 350 |
| Example 96 | 8 | 0.70 | 0.74 | 350 |
| Example 97 | 9 | 0.60 | 0.78 | 350 |
| Example 98 | 15 | 0.71 | 0.80 | 600 |
| Example 99 | 18 | 0.63 | 0.66 | 500 |
| Example 100 | 9 | 0.63 | 0.66 | 450 |
| Example 101 | 10 | 0.63 | 0.66 | 450 |
| Example 102 | 10 | 0.63 | 0.66 | 450 |
| Example 103 | 9 | 0.63 | 0.66 | 450 |
| Example 104 | 13 | 0.63 | 0.66 | 450 |
| Example 105 | 15 | 0.63 | 0.66 | 450 |
| Example 106 | 17 | 0.63 | 0.66 | 450 |
| Example 107 | 15 | 0.63 | 0.66 | 450 |
| Example 108 | 13 | 0.63 | 0.66 | 450 |
| Example 109 | 15 | 0.63 | 0.66 | 450 |
| Example 110 | 17 | 0.63 | 0.66 | 450 |
| Example 111 | 15 | 0.63 | 0.66 | 450 |
| Example 112 | 16 | 0.63 | 0.66 | 450 |
| Example 113 | 15 | 0.63 | 0.66 | 450 |
| Example 114 | 18 | 0.63 | 0.66 | 450 |
| Example 115 | 20 | 0.63 | 0.66 | 450 |
| Example 116 | 22 | 0.63 | 0.66 | 450 |
| Example 117 | 18 | 0.63 | 0.66 | 450 |
| Example 118 | 20 | 0.63 | 0.66 | 450 |
| Example 119 | 15 | 0.63 | 0.66 | 450 |
| Example 120 | 14 | 0.63 | 0.66 | 450 |
| Example 121 | 16 | 0.63 | 0.66 | 450 |
| Example 122 | 15 | 0.63 | 0.66 | 450 |
| Example 123 | 15 | 0.63 | 0.66 | 450 |
| Example 124 | 18 | 0.63 | 0.66 | 450 |
| Example 125 | 15 | 0.63 | 0.66 | 450 |
| Example 126 | 15 | 0.63 | 0.66 | 450 |
| Example 127 | 15 | 0.63 | 0.66 | 450 |
| Example 128 | 15 | 0.63 | 0.66 | 450 |
| Example 129 | 16 | 0.63 | 0.66 | 450 |
| Example 130 | 15 | 0.63 | 0.66 | 450 |
| Example 131 | 17 | 0.63 | 0.66 | 450 |
| Example 132 | 15 | 0.63 | 0.66 | 450 |
| Example 133 | 15 | 0.63 | 0.66 | 450 |
| Example 134 | 8 | 0.79 | 0.83 | 250 |
| Example 135 | 7 | 0.82 | 0.87 | 300 |
| Example 136 | 8 | 0.79 | 0.83 | 350 |
| Example 137 | 10 | 0.79 | 0.83 | 300 |
| Example 138 | 8 | 0.79 | 0.83 | 300 |
| Example 139 | 7 | 0.79 | 0.83 | 250 |
| Example 140 | 7 | 0.69 | 0.84 | 200 |
| Example 141 | 9 | 0.72 | 0.75 | 300 |
| Example 142 | 10 | 0.72 | 0.76 | 300 |
| Example 143 | 9 | 0.72 | 0.76 | 300 |
| Example 144 | 8 | 0.72 | 0.76 | 300 |
| Example 145 | 10 | 0.72 | 0.76 | 300 |
| Example 146 | 11 | 0.72 | 0.76 | 300 |
| Example 147 | 11 | 0.72 | 0.76 | 300 |
| Example 148 | 8 | 0.72 | 0.76 | 300 |
| Example 149 | 9 | 0.72 | 0.77 | 300 |
| Example 150 | 9 | 0.72 | 0.76 | 300 |

TABLE 13

| | Potential variation (V) | Initial torque relative value | Torque relative value after repeated use of 2,000 sheets of paper | Particle size (nm) |
|---|---|---|---|---|
| Example 151 | 8 | 0.72 | 0.76 | 300 |
| Example 152 | 8 | 0.72 | 0.75 | 300 |
| Example 153 | 9 | 0.72 | 0.76 | 300 |
| Example 154 | 6 | 0.72 | 0.75 | 300 |
| Example 155 | 8 | 0.72 | 0.77 | 300 |
| Example 156 | 9 | 0.72 | 0.77 | 300 |
| Example 157 | 8 | 0.72 | 0.76 | 300 |
| Example 158 | 8 | 0.72 | 0.77 | 300 |
| Example 159 | 7 | 0.72 | 0.76 | 300 |
| Example 160 | 7 | 0.72 | 0.76 | 300 |

TABLE 13-continued

| | Potential variation (V) | Initial torque relative value | Torque relative value after repeated use of 2,000 sheets of paper | Particle size (nm) |
|---|---|---|---|---|
| Example 161 | 8 | 0.72 | 0.76 | 300 |
| Example 162 | 8 | 0.72 | 0.76 | 300 |
| Example 163 | 8 | 0.72 | 0.76 | 300 |
| Example 164 | 6 | 0.72 | 0.76 | 300 |
| Example 165 | 7 | 0.72 | 0.76 | 300 |
| Example 166 | 7 | 0.72 | 0.76 | 300 |
| Example 167 | 7 | 0.72 | 0.76 | 300 |
| Example 168 | 7 | 0.72 | 0.76 | 300 |
| Example 169 | 8 | 0.72 | 0.75 | 300 |
| Example 170 | 9 | 0.72 | 0.76 | 300 |
| Example 171 | 6 | 0.72 | 0.77 | 300 |
| Example 172 | 6 | 0.72 | 0.77 | 300 |
| Example 173 | 7 | 0.72 | 0.77 | 300 |
| Example 174 | 10 | 0.80 | 0.88 | 350 |
| Example 175 | 11 | 0.75 | 0.80 | 300 |
| Example 176 | 10 | 0.75 | 0.80 | 250 |
| Example 177 | 10 | 0.75 | 0.80 | 250 |
| Example 178 | 12 | 0.75 | 0.80 | 250 |
| Example 179 | 12 | 0.65 | 0.82 | 250 |
| Example 180 | 15 | 0.69 | 0.74 | 350 |
| Example 181 | 22 | 0.65 | 0.70 | 350 |
| Example 182 | 8 | 0.76 | 0.81 | 250 |
| Example 183 | 9 | 0.76 | 0.81 | 250 |
| Example 184 | 10 | 0.76 | 0.81 | 250 |
| Example 185 | 10 | 0.76 | 0.81 | 250 |
| Example 186 | 8 | 0.76 | 0.81 | 250 |
| Example 187 | 10 | 0.76 | 0.81 | 250 |
| Example 188 | 8 | 0.76 | 0.81 | 250 |
| Example 189 | 10 | 0.76 | 0.81 | 250 |
| Example 190 | 10 | 0.76 | 0.81 | 250 |
| Example 191 | 10 | 0.76 | 0.81 | 250 |
| Example 192 | 10 | 0.75 | 0.80 | 250 |
| Example 193 | 8 | 0.78 | 0.82 | 250 |
| Example 194 | 10 | 0.78 | 0.81 | 250 |
| Example 195 | 10 | 0.78 | 0.81 | 250 |
| Example 196 | 12 | 0.78 | 0.81 | 250 |
| Example 197 | 10 | 0.78 | 0.83 | 250 |
| Example 198 | 8 | 0.78 | 0.83 | 250 |
| Example 199 | 8 | 0.78 | 0.83 | 250 |
| Example 200 | 8 | 0.78 | 0.83 | 250 |
| Example 201 | 10 | 0.78 | 0.83 | 250 |
| Example 202 | 10 | 0.78 | 0.83 | 250 |
| Example 203 | 9 | 0.78 | 0.83 | 250 |
| Example 204 | 10 | 0.78 | 0.83 | 250 |
| Example 205 | 8 | 0.78 | 0.83 | 250 |
| Example 206 | 10 | 0.78 | 0.83 | 250 |
| Example 207 | 10 | 0.78 | 0.83 | 250 |
| Example 208 | 10 | 0.78 | 0.83 | 250 |
| Example 209 | 8 | 0.78 | 0.83 | 250 |
| Example 210 | 8 | 0.78 | 0.83 | 250 |
| Example 211 | 8 | 0.78 | 0.83 | 250 |
| Example 212 | 8 | 0.78 | 0.83 | 250 |
| Example 213 | 8 | 0.78 | 0.83 | 250 |
| Example 214 | 10 | 0.78 | 0.83 | 250 |
| Example 215 | 10 | 0.78 | 0.83 | 250 |
| Example 216 | 9 | 0.78 | 0.83 | 250 |
| Example 217 | 9 | 0.78 | 0.83 | 250 |
| Example 218 | 10 | 0.78 | 0.83 | 250 |
| Example 219 | 6 | 0.81 | 0.88 | 350 |
| Example 220 | 6 | 0.76 | 0.81 | 300 |
| Example 221 | 7 | 0.76 | 0.81 | 300 |
| Example 222 | 8 | 0.76 | 0.81 | 250 |
| Example 223 | 7 | 0.76 | 0.81 | 250 |
| Example 224 | 8 | 0.65 | 0.83 | 250 |
| Example 225 | 15 | 0.63 | 0.68 | 500 |
| Example 226 | 12 | 0.67 | 0.72 | 400 |
| Example 227 | 10 | 0.67 | 0.72 | 400 |
| Example 228 | 12 | 0.67 | 0.72 | 400 |
| Example 229 | 12 | 0.67 | 0.72 | 400 |
| Example 230 | 12 | 0.67 | 0.72 | 400 |
| Example 231 | 15 | 0.67 | 0.72 | 400 |
| Example 232 | 12 | 0.67 | 0.72 | 400 |
| Example 233 | 13 | 0.67 | 0.72 | 400 |
| Example 234 | 13 | 0.67 | 0.72 | 400 |
| Example 235 | 12 | 0.68 | 0.72 | 400 |
| Example 236 | 10 | 0.68 | 0.72 | 400 |

TABLE 13-continued

| | Potential variation (V) | Initial torque relative value | Torque relative value after repeated use of 2,000 sheets of paper | Particle size (nm) |
|---|---|---|---|---|
| Example 237 | 15 | 0.68 | 0.72 | 400 |
| Example 238 | 15 | 0.68 | 0.72 | 400 |
| Example 239 | 10 | 0.68 | 0.72 | 400 |
| Example 240 | 12 | 0.68 | 0.73 | 400 |
| Example 241 | 12 | 0.68 | 0.73 | 400 |
| Example 242 | 12 | 0.68 | 0.73 | 400 |
| Example 243 | 10 | 0.68 | 0.73 | 400 |
| Example 244 | 10 | 0.68 | 0.73 | 400 |
| Example 245 | 10 | 0.68 | 0.73 | 400 |
| Example 246 | 10 | 0.68 | 0.73 | 400 |
| Example 247 | 10 | 0.68 | 0.73 | 400 |
| Example 248 | 9 | 0.68 | 0.73 | 400 |
| Example 249 | 11 | 0.68 | 0.73 | 400 |
| Example 250 | 9 | 0.68 | 0.73 | 400 |
| Example 251 | 9 | 0.68 | 0.73 | 400 |
| Example 252 | 9 | 0.68 | 0.73 | 400 |
| Example 253 | 9 | 0.68 | 0.73 | 400 |
| Example 254 | 9 | 0.68 | 0.73 | 400 |
| Example 255 | 10 | 0.68 | 0.73 | 400 |
| Example 256 | 10 | 0.68 | 0.73 | 400 |
| Example 257 | 10 | 0.68 | 0.73 | 400 |
| Example 258 | 10 | 0.68 | 0.73 | 400 |
| Example 259 | 11 | 0.68 | 0.73 | 400 |
| Example 260 | 10 | 0.68 | 0.73 | 400 |
| Example 261 | 25 | 0.75 | 0.83 | 700 |
| Example 262 | 22 | 0.63 | 0.68 | 650 |
| Example 263 | 22 | 0.63 | 0.68 | 600 |
| Example 264 | 20 | 0.63 | 0.68 | 600 |
| Example 265 | 20 | 0.63 | 0.68 | 600 |
| Example 266 | 22 | 0.58 | 0.73 | 600 |
| Example 267 | 25 | 0.63 | 0.68 | 600 |
| Example 268 | 23 | 0.63 | 0.68 | 600 |
| Example 269 | 25 | 0.63 | 0.68 | 600 |
| Example 270 | 20 | 0.63 | 0.68 | 600 |
| Example 271 | 18 | 0.63 | 0.68 | 600 |
| Example 272 | 22 | 0.63 | 0.68 | 600 |

TABLE 13-continued

| | Potential variation (V) | Initial torque relative value | Torque relative value after repeated use of 2,000 sheets of paper | Particle size (nm) |
|---|---|---|---|---|
| Example 273 | 22 | 0.63 | 0.68 | 600 |
| Example 274 | 20 | 0.63 | 0.66 | 600 |
| Example 275 | 20 | 0.63 | 0.67 | 600 |
| Example 276 | 18 | 0.63 | 0.67 | 600 |
| Example 277 | 20 | 0.63 | 0.66 | 600 |
| Example 278 | 20 | 0.63 | 0.67 | 600 |
| Example 279 | 18 | 0.63 | 0.68 | 600 |
| Example 280 | 15 | 0.63 | 0.68 | 600 |
| Example 281 | 18 | 0.63 | 0.68 | 600 |
| Example 282 | 15 | 0.63 | 0.68 | 600 |
| Example 283 | 20 | 0.63 | 0.68 | 600 |
| Example 284 | 18 | 0.63 | 0.68 | 600 |
| Example 285 | 15 | 0.63 | 0.68 | 600 |
| Example 286 | 17 | 0.63 | 0.68 | 600 |
| Example 287 | 17 | 0.63 | 0.68 | 600 |
| Example 288 | 16 | 0.63 | 0.68 | 600 |
| Example 289 | 15 | 0.63 | 0.68 | 600 |
| Example 290 | 18 | 0.63 | 0.68 | 600 |
| Example 291 | 18 | 0.63 | 0.68 | 600 |
| Example 292 | 18 | 0.63 | 0.68 | 600 |
| Example 293 | 18 | 0.63 | 0.68 | 600 |
| Example 294 | 20 | 0.63 | 0.68 | 600 |
| Example 295 | 18 | 0.63 | 0.68 | 600 |
| Example 296 | 18 | 0.63 | 0.68 | 600 |
| Example 297 | 20 | 0.63 | 0.68 | 600 |
| Example 298 | 20 | 0.63 | 0.68 | 600 |
| Example 299 | 20 | 0.63 | 0.68 | 600 |
| Example 300 | 22 | 0.63 | 0.75 | 600 |
| Example 301 | 12 | 0.70 | 0.77 | 450 |
| Example 302 | 33 | 0.70 | 0.75 | 550 |
| Example 303 | 38 | 0.63 | 0.68 | 650 |
| Example 304 | 30 | 0.70 | 0.75 | 450 |
| Example 305 | 30 | 0.63 | 0.68 | 600 |
| Example 306 | 22 | 0.63 | 0.73 | 600 |
| Example 307 | 12 | 0.68 | 0.77 | 450 |

TABLE 14

| | [α] | | | | | | [β] | | | [γ] | |
|---|---|---|---|---|---|---|---|---|---|---|---|
| | Resin [α1]/ Other Resin | | Resin [α2]/ Other Resin | | Resin [α1] | | | Weight-average | | | |
| | Type of resin | Part | Type of resin | Part | content | [α] content | Type of resin | molecular weight | Part | Type of CTM | Part |
| Comparative Example 1 | *Resin B(1) | 0.005 | Resin D(2) | 4.995 | 0.0% | 99.9% | (F-1) | 80000 | 8 | (2-1) | 7 |
| Comparative Example 2 | *Resin B(1) | 1.000 | Resin D(2) | 4.000 | 0.0% | 80.0% | (F-1) | 80000 | 8 | (2-1) | 7 |
| Comparative Example 3 | *Resin B(1) | 5.000 | | | 0.0% | 0.0% | (F-1) | 80000 | 8 | (2-1) | 7 |
| Comparative Example 4 | *Resin B(18) | 0.005 | Resin D(19) | 4.995 | 0.0% | 99.9% | (F-6) | 80000 | 5 | (1-3) | 10 |
| Comparative Example 5 | *Resin B(18) | 1.000 | Resin D(19) | 4.000 | 0.0% | 80.0% | (F-6) | 80000 | 5 | (1-3) | 10 |
| Comparative Example 6 | *Resin B(18) | 5.000 | | | 0.0% | 0.0% | (F-6) | 80000 | 5 | (1-3) | 10 |
| Comparative Example 7 | *Resin B(34) | 0.005 | Resin D(34) | 4.995 | 0.0% | 99.9% | (F-10) | 100000 | 8 | (1-6)/(1-7) | 3.5/3.5 |
| Comparative Example 8 | *Resin B(34) | 1.000 | Resin D(34) | 4.000 | 0.0% | 80.0% | (F-10) | 100000 | 8 | (1-6)/(1-7) | 3.5/3.5 |
| Comparative Example 9 | *Resin B(34) | 5.000 | | | 0.0% | 0.0% | (F-10) | 100000 | 8 | (1-6)/(1-7) | 3.5/3.5 |
| Comparative Example 10 | *Resin C(1) | 0.005 | Resin E(2) | 4.995 | 0.0% | 99.9% | (G-1) | 120000 | 5 | (1-1)/(1-2) | 5/5 |
| Comparative Example 11 | *Resin C(1) | 1.000 | Resin E(2) | 4.000 | 0.0% | 80.0% | (G-1) | 120000 | 5 | (1-1)/(1-2) | 5/5 |
| Comparative Example 12 | *Resin C(1) | 5.000 | | | 0.0% | 0.0% | (G-1) | 120000 | 5 | (1-1)/(1-2) | 5/5 |
| Comparative Example 13 | *Resin C(16) | 0.005 | Resin E(16) | 4.995 | 0.0% | 99.9% | (G-2) | 120000 | 8 | (1-6)/(1-7) | 3.5/3.5 |

TABLE 14-continued

| | [α] | | | | | | [β] | | | [γ] | |
|---|---|---|---|---|---|---|---|---|---|---|---|
| | Resin [α1]/ Other Resin | | Resin [α2]/ Other Resin | | Resin [α1] | | | Weight-average | | | |
| | Type of resin | Part | Type of resin | Part | content | [α] content | Type of resin | molecular weight | Part | Type of CTM | Part |
| Comparative Example 14 | *Resin C(16) | 1.000 | Resin E(16) | 4.000 | 0.0% | 80.0% | (G-2) | 120000 | 8 | (1-6)/(1-7) | 3.5/3.5 |
| Comparative Example 15 | *Resin C(16) | 5.000 | | | 0.0% | 0.0% | (G-2) | 120000 | 8 | (1-6)/(1-7) | 3.5/3.5 |
| Comparative Example 16 | *Resin C(37) | 0.005 | Resin E(34) | 4.995 | 0.0% | 99.9% | (G-7) | 150000 | 8 | (2-1) | 7 |
| Comparative Example 17 | *Resin C(37) | 1.000 | Resin E(34) | 4.000 | 0.0% | 80.0% | (G-7) | 150000 | 8 | (2-1) | 7 |
| Comparative Example 18 | *Resin C(37) | 5.000 | | | 0.0% | 0.0% | (G-7) | 150000 | 8 | (2-1) | 7 |
| Comparative Example 19 | *Resin B(18) | 0.005 | Resin D(19) | 4.995 | 0.0% | 99.9% | (F-6) | 80000 | 8 | (2-5) | 7 |
| Comparative Example 20 | *Resin B(18) | 1.000 | Resin D(19) | 4.000 | 0.0% | 80.0% | (F-6) | 80000 | 8 | (2-5) | 7 |
| Comparative Example 21 | *Resin B(18) | 5.000 | | | 0.0% | 0.0% | (F-6) | 80000 | 8 | (2-5) | 7 |
| Comparative Example 22 | *Resin B(5) | 0.005 | Resin D(2) | 4.995 | 0.0% | 99.9% | (F-1) | 80000 | 8 | (2-1) | 7 |
| Comparative Example 23 | *Resin B(5) | 1.000 | Resin D(2) | 4.000 | 0.0% | 80.0% | (F-1) | 80000 | 8 | (2-1) | 7 |
| Comparative Example 24 | *Resin B(5) | 5.000 | | | 0.0% | 0.0% | (F-1) | 80000 | 8 | (2-1) | 7 |
| Comparative Example 25 | *Resin B(22) | 0.005 | Resin D(19) | 4.995 | 0.0% | 99.9% | (F-6) | 80000 | 5 | (1-3) | 10 |
| Comparative Example 26 | *Resin B(22) | 1.000 | Resin D(19) | 4.000 | 0.0% | 80.0% | (F-6) | 80000 | 5 | (1-3) | 10 |
| Comparative Example 27 | *Resin B(22) | 5.000 | | | 0.0% | 0.0% | (F-6) | 80000 | 5 | (1-3) | 10 |
| Comparative Example 28 | *Resin B(22) | 0.005 | Resin D(19) | 4.995 | 0.0% | 99.9% | (F-6) | 80000 | 8 | (2-5) | 7 |
| Comparative Example 29 | *Resin B(22) | 1.000 | Resin D(19) | 4.000 | 0.0% | 80.0% | (F-6) | 80000 | 8 | (2-5) | 7 |
| Comparative Example 30 | *Resin B(22) | 5.000 | | | 0.0% | 0.0% | (F-6) | 80000 | 8 | (2-5) | 7 |
| Comparative Example 31 | *Resin B(38) | 0.005 | Resin D(34) | 4.995 | 0.0% | 99.9% | (F-10) | 100000 | 8 | (1-6)/(1-7) | 3.5/3.5 |
| Comparative Example 32 | *Resin B(38) | 1.000 | Resin D(34) | 4.000 | 0.0% | 80.0% | (F-10) | 100000 | 8 | (1-6)/(1-7) | 3.5/3.5 |
| Comparative Example 33 | *Resin B(38) | 5.000 | | | 0.0% | 0.0% | (F-10) | 100000 | 8 | (1-6)/(1-7) | 3.5/3.5 |
| Comparative Example 34 | *Resin C(5) | 0.005 | Resin E(2) | 4.995 | 0.0% | 99.9% | (G-1) | 120000 | 5 | (1-1)/(1-2) | 5/5 |
| Comparative Example 35 | *Resin C(5) | 1.000 | Resin E(2) | 4.000 | 0.0% | 80.0% | (G-1) | 120000 | 5 | (1-1)/(1-2) | 5/5 |
| Comparative Example 36 | *Resin C(5) | 5.000 | | | 0.0% | 0.0% | (G-1) | 120000 | 5 | (1-1)/(1-2) | 5/5 |
| Comparative Example 37 | *Resin C(20) | 0.005 | Resin E(16) | 4.995 | 0.0% | 99.9% | (G-2) | 120000 | 8 | (1-6)/(1-7) | 3.5/3.5 |
| Comparative Example 38 | *Resin C(20) | 1.000 | Resin E(16) | 4.000 | 0.0% | 80.0% | (G-2) | 120000 | 8 | (1-6)/(1-7) | 3.5/3.5 |
| Comparative Example 39 | *Resin C(20) | 5.000 | | | 0.0% | 0.0% | (G-2) | 120000 | 8 | (1-6)/(1-7) | 3.5/3.5 |
| Comparative Example 40 | *Resin C(41) | 0.005 | Resin E(34) | 4.995 | 0.0% | 99.9% | (G-7) | 150000 | 8 | (2-1) | 7 |
| Comparative Example 41 | *Resin C(41) | 1.000 | Resin E(33) | 4.000 | 0.0% | 80.0% | (G-7) | 150000 | 8 | (2-1) | 7 |
| Comparative Example 42 | *Resin C(41) | 5.000 | | | 0.0% | 0.0% | (G-7) | 150000 | 8 | (2-1) | 7 |
| Comparative Example 43 | Resin B(2) | 0.005 | *Resin D(1) | 4.995 | 100.0% | 0.1% | (F-1) | 80000 | 8 | (2-1) | 7 |
| Comparative Example 44 | Resin B(2) | 2.500 | *Resin D(1) | 2.500 | 100.0% | 50.0% | (F-1) | 80000 | 8 | (2-1) | 7 |
| Comparative Example 45 | Resin B(20) | 0.005 | *Resin D(17) | 4.995 | 100.0% | 0.1% | (F-6) | 80000 | 5 | (1-3) | 10 |
| Comparative Example 46 | Resin B(20) | 2.500 | *Resin D(17) | 2.500 | 100.0% | 50.0% | (F-6) | 80000 | 5 | (1-3) | 10 |
| Comparative Example 47 | Resin B(20) | 0.005 | *Resin D(17) | 4.995 | 100.0% | 0.1% | (F-6) | 80000 | 8 | (2-5) | 7 |
| Comparative Example 48 | Resin B(20) | 2.500 | *Resin D(17) | 2.500 | 100.0% | 50.0% | (F-6) | 80000 | 8 | (2-5) | 7 |
| Comparative Example 49 | Resin B(43) | 0.005 | *Resin D(32) | 4.995 | 100.0% | 0.1% | (F-10) | 100000 | 8 | (1-6)/(1-7) | 3.5/3.5 |

TABLE 14-continued

| | [α] | | | | | | [β] | | | [γ] | |
|---|---|---|---|---|---|---|---|---|---|---|---|
| | Resin [α1]/ Other Resin | | Resin [α2]/ Other Resin | | Resin [α1] | | | Weight-average | | | |
| | Type of resin | Part | Type of resin | Part | content | [α] content | Type of resin | molecular weight | Part | Type of CTM | Part |
| Comparative Example 50 | Resin B(43) | 2.500 | *Resin D(32) | 2.500 | 100.0% | 50.0% | (F-10) | 100000 | 8 | (1-6)/(1-7) | 3.5/3.5 |

TABLE 15

| | [α] | | | | | | [β] | | | [γ] | |
|---|---|---|---|---|---|---|---|---|---|---|---|
| | Resin [α1]/ Other Resin | | Resin [α2]/ Other Resin | | Resin [α1] | | | Weight-average | | | |
| | Type of resin | Part | Type of resin | Part | content | [α] content | Type of resin | molecular weight | Part | Type of CTM | Part |
| Comparative Example 51 | Resin C(2) | 0.005 | *Resin E(1) | 4.995 | 100.0% | 0.1% | (G-1) | 120000 | 5 | (1-1)/(1-2) | 5/5 |
| Comparative Example 52 | Resin C(2) | 2.500 | *Resin E(1) | 2.500 | 100.0% | 50.0% | (G-1) | 120000 | 5 | (1-1)/(1-2) | 5/5 |
| Comparative Example 53 | Resin C(18) | 0.005 | *Resin E(14) | 4.995 | 100.0% | 0.1% | (G-2) | 120000 | 8 | (1-6)/(1-7) | 3.5/3.5 |
| Comparative Example 54 | Resin C(18) | 2.500 | *Resin E(14) | 2.500 | 100.0% | 50.0% | (G-2) | 120000 | 8 | (1-6)/(1-7) | 3.5/3.5 |
| Comparative Example 55 | Resin C(40) | 0.005 | *Resin E(32) | 4.995 | 100.0% | 0.1% | (G-7) | 150000 | 8 | (2-1) | 7 |
| Comparative Example 56 | Resin C(40) | 2.500 | *Resin E(32) | 2.500 | 100.0% | 50.0% | (G-7) | 150000 | 8 | (2-1) | 7 |
| Comparative Example 57 | Resin B(2) | 0.005 | *Resin D(5) | 4.995 | 100.0% | 0.1% | (F-1) | 80000 | 8 | (2-1) | 7 |
| Comparative Example 58 | Resin B(2) | 2.500 | *Resin D(5) | 2.500 | 100.0% | 50.0% | (F-1) | 80000 | 8 | (2-1) | 7 |
| Comparative Example 59 | Resin B(20) | 0.005 | *Resin D(21) | 4.995 | 100.0% | 0.1% | (F-6) | 80000 | 5 | (1-3) | 10 |
| Comparative Example 60 | Resin B(20) | 2.500 | *Resin D(21) | 2.500 | 100.0% | 50.0% | (F-6) | 80000 | 5 | (1-3) | 10 |
| Comparative Example 61 | Resin B(20) | 0.005 | *Resin D(21) | 4.995 | 100.0% | 0.1% | (F-6) | 80000 | 8 | (2-5) | 7 |
| Comparative Example 62 | Resin B(20) | 2.500 | *Resin D(21) | 2.500 | 100.0% | 50.0% | (F-6) | 80000 | 8 | (2-5) | 7 |
| Comparative Example 63 | Resin B(43) | 0.005 | *Resin D(36) | 4.995 | 100.0% | 0.1% | (F-10) | 100000 | 8 | (1-6)/(1-7) | 3.5/3.5 |
| Comparative Example 64 | Resin B(43) | 2.500 | *Resin D(36) | 2.500 | 100.0% | 50.0% | (F-10) | 100000 | 8 | (1-6)/(1-7) | 3.5/3.5 |
| Comparative Example 65 | Resin C(2) | 0.005 | *Resin E(5) | 4.995 | 100.0% | 0.1% | (G-1) | 120000 | 5 | (1-1)/(1-2) | 5/5 |
| Comparative Example 66 | Resin C(2) | 2.500 | *Resin E(5) | 2.500 | 100.0% | 50.0% | (G-1) | 120000 | 5 | (1-1)/(1-2) | 5/5 |
| Comparative Example 67 | Resin C(18) | 0.005 | *Resin E(18) | 4.995 | 100.0% | 0.1% | (G-2) | 120000 | 8 | (1-6)/(1-7) | 3.5/3.5 |
| Comparative Example 68 | Resin C(18) | 2.500 | *Resin E(18) | 2.500 | 100.0% | 50.0% | (G-2) | 120000 | 8 | (1-6)/(1-7) | 3.5/3.5 |
| Comparative Example 69 | Resin C(40) | 0.005 | *Resin E(36) | 4.995 | 100.0% | 0.1% | (G-7) | 150000 | 8 | (2-1) | 7 |
| Comparative Example 70 | Resin C(40) | 2.500 | *Resin E(36) | 2.500 | 100.0% | 50.0% | (G-7) | 150000 | 8 | (2-1) | 7 |
| Comparative Example 71 | | | Resin D(2) | 5.000 | 0.0% | 0.0% | (F-1) | 80000 | 8 | (2-1) | 7 |
| Comparative Example 72 | | | Resin D(19) | 5.000 | 0.0% | 0.0% | (F-6) | 80000 | 5 | (1-3) | 10 |
| Comparative Example 73 | | | Resin D(19) | 5.000 | 0.0% | 0.0% | (F-6) | 80000 | 8 | (2-5) | 7 |
| Comparative Example 74 | | | Resin D(34) | 5.000 | 0.0% | 0.0% | (F-10) | 100000 | 8 | (1-6)/(1-7) | 3.5/3.5 |
| Comparative Example 75 | | | Resin E(2) | 5.000 | 0.0% | 0.0% | (G-1) | 120000 | 5 | (1-1)/(1-2) | 5/5 |
| Comparative Example 76 | | | Resin E(16) | 5.000 | 0.0% | 0.0% | (G-2) | 120000 | 8 | (1-6)/(1-7) | 3.5/3.5 |
| Comparative Example 77 | | | Resin E(34) | 5.000 | 0.0% | 0.0% | (G-7) | 150000 | 8 | (2-1) | 7 |
| Comparative Example 78 | Resin B(2) | 0.500 | Resin D(2) | 9.500 | 5.0% | 100.0% | — | — | — | (1-3) | 10 |

TABLE 15-continued

| | [α] | | | | | | [β] | | | [γ] | |
|---|---|---|---|---|---|---|---|---|---|---|---|
| | Resin [α1]/ Other Resin | | Resin [α2]/ Other Resin | | Resin [α1] | | | Weight-average | | | |
| | Type of resin | Part | Type of resin | Part | content | [α] content | Type of resin | molecular weight | Part | Type of CTM | Part |
| Comparative Example 79 | Resin B(20) | 0.100 | Resin D(19) | 9.900 | 1.0% | 100.0% | — | — | — | (1-3) | 10 |
| Comparative Example 80 | Resin B(43) | 5.000 | Resin D(41) | 5.000 | 50.0% | 100.0% | — | — | — | (1-3) | 10 |
| Comparative Example 81 | Resin C(2) | 0.500 | Resin E(2) | 9.500 | 5.0% | 100.0% | — | — | — | (1-3) | 10 |
| Comparative Example 82 | Resin C(18) | 0.100 | Resin E(16) | 9.900 | 1.0% | 100.0% | — | — | — | (1-3) | 10 |
| Comparative Example 83 | Resin C(40) | 5.000 | Resin E(34) | 5.000 | 50.0% | 100.0% | — | — | — | (1-3) | 10 |
| Comparative Example 84 | | Resin J-1 | | 5.000 | 0.0% | 0.0% | (F-1) | 80000 | 8 | (2-1) | 7 |
| Comparative Example 85 | | Resin J-1 | | 5.000 | 0.0% | 0.0% | (F-6) | 80000 | 5 | (1-3) | 10 |
| Comparative Example 86 | | Resin J-1 | | 5.000 | 0.0% | 0.0% | (F-10) | 100000 | 8 | (1-6)/(1-7) | 3.5/3.5 |
| Comparative Example 87 | | Resin J-1 | | 5.000 | 0.0% | 0.0% | (G-1) | 120000 | 5 | (1-1)/(1-2) | 5/5 |
| Comparative Example 88 | | Resin J-1 | | 5.000 | 0.0% | 0.0% | (G-2) | 120000 | 8 | (1-6)/(1-7) | 3.5/3.5 |
| Comparative Example 89 | | Resin J-1 | | 5.000 | 0.0% | 0.0% | (G-7) | 150000 | 8 | (2-4) | 7 |
| Comparative Example 90 | | KF-56 | | — | 0.0% | 0.0% | (F-1) | 80000 | 13 | (2-1) | 7 |
| Comparative Example 91 | | KF-56 | | — | 0.0% | 0.0% | (F-6) | 80000 | 10 | (1-3) | 10 |
| Comparative Example 92 | | KF-56 | | — | 0.0% | 0.0% | (F-10) | 100000 | 13 | (1-6)/(1-7) | 3.5/3.5 |
| Comparative Example 93 | | KF-56 | | — | 0.0% | 0.0% | (G-1) | 120000 | 10 | (1-1)/(1-2) | 5/5 |
| Comparative Example 94 | | KF-56 | | — | 0.0% | 0.0% | (G-2) | 120000 | 13 | (1-6)/(1-7) | 3.5/3.5 |
| Comparative Example 95 | | KF-56 | | — | 0.0% | 0.0% | (G-7) | 150000 | 13 | (2-4) | 7 |

It should be noted that, in Tables 14 and 15, the resins B(1), (5), (18), (22), (34), and (38), the resins C(1), (5), (16), (20), (37), and (41), the resins D(1), (5), (17), (21), (32), and (36), and the resins E(1), (5), (14), (18), (32), and (36), each of which is indicated by an asterisk *, are comparative resins.

The term "Component [γ]" in Tables 14 and 15 refers to the component [γ] in the charge-transporting layer. In the case of using a mixture of charge-transporting substances, the term refers to the types and mixing ratio of the component [γ] and another charge-transporting substance. The term "Resin [α1]" in Tables 14 and 15 refers to the composition of the resin [α1], and the term "Resin [α2]" in Tables 14 and 15 refers to the composition of the resin [α2]. The term "Resin [α1] content" in Tables 14 and 15 refers to the mass ratio (resin [α1]/component [α]) of the resin [α1] with respect to the whole resins in the component [α]. The term "[α] content" in Tables 14 and 15 refers to the component [α] content with respect to the total mass of the resin having a siloxane moiety at the end in the charge-transporting layer. The term "Component [β]" in Tables 14 and 15 refers to the composition of the component [β].

TABLE 16

| | Potential variation (V) | Initial torque relative value | Torque relative value after repeated use of 2,000 sheets of paper | Particle size (nm) |
|---|---|---|---|---|
| Comparative Example 1 | 65 | 0.70 | 0.99 | — |

TABLE 16-continued

| | Potential variation (V) | Initial torque relative value | Torque relative value after repeated use of 2,000 sheets of paper | Particle size (nm) |
|---|---|---|---|---|
| Comparative Example 2 | 18 | 0.73 | 0.97 | 300 |
| Comparative Example 3 | 15 | 0.80 | 0.98 | 350 |
| Comparative Example 4 | 70 | 0.66 | 0.98 | — |
| Comparative Example 5 | 18 | 0.70 | 0.97 | 300 |
| Comparative Example 6 | 16 | 0.75 | 0.96 | 350 |
| Comparative Example 7 | 70 | 0.68 | 0.99 | — |
| Comparative Example 8 | 16 | 0.70 | 0.97 | 300 |
| Comparative Example 9 | 16 | 0.75 | 0.96 | 350 |
| Comparative Example 10 | 80 | 0.70 | 0.99 | — |
| Comparative Example 11 | 22 | 0.73 | 0.98 | 300 |
| Comparative Example 12 | 20 | 0.81 | 0.97 | 350 |
| Comparative Example 13 | 80 | 0.65 | 0.99 | — |
| Comparative Example 14 | 20 | 0.70 | 0.99 | 300 |
| Comparative Example 15 | 20 | 0.75 | 0.98 | 350 |

TABLE 16-continued

| | Potential variation (V) | Initial torque relative value | Torque relative value after repeated use of 2,000 sheets of paper | Particle size (nm) |
|---|---|---|---|---|
| Comparative Example 16 | 75 | 0.65 | 0.97 | — |
| Comparative Example 17 | 18 | 0.70 | 0.97 | 300 |
| Comparative Example 18 | 18 | 0.75 | 0.97 | 350 |
| Comparative Example 19 | 85 | 0.66 | 0.99 | — |
| Comparative Example 20 | 20 | 0.72 | 0.99 | 300 |
| Comparative Example 21 | 22 | 0.77 | 0.98 | 350 |
| Comparative Example 22 | 150 | 0.68 | 0.72 | 800 |
| Comparative Example 23 | 140 | 0.67 | 0.71 | 800 |
| Comparative Example 24 | 130 | 0.67 | 0.71 | 1000 |
| Comparative Example 25 | 200 | 0.65 | 0.69 | 800 |
| Comparative Example 26 | 180 | 0.65 | 0.69 | 800 |
| Comparative Example 27 | 180 | 0.65 | 0.69 | 1000 |
| Comparative Example 28 | 220 | 0.67 | 0.70 | 800 |
| Comparative Example 29 | 200 | 0.67 | 0.70 | 1000 |
| Comparative Example 30 | 200 | 0.67 | 0.70 | 1000 |
| Comparative Example 31 | 220 | 0.67 | 0.71 | 800 |
| Comparative Example 32 | 200 | 0.68 | 0.72 | 800 |
| Comparative Example 33 | 180 | 0.66 | 0.70 | 1000 |
| Comparative Example 34 | 170 | 0.68 | 0.72 | 800 |
| Comparative Example 35 | 120 | 0.67 | 0.71 | 800 |
| Comparative Example 36 | 130 | 0.67 | 0.71 | 1000 |
| Comparative Example 37 | 190 | 0.65 | 0.69 | 800 |
| Comparative Example 38 | 150 | 0.65 | 0.69 | 800 |
| Comparative Example 39 | 150 | 0.65 | 0.69 | 1000 |
| Comparative Example 40 | 170 | 0.67 | 0.71 | 800 |
| Comparative Example 41 | 130 | 0.68 | 0.72 | 800 |
| Comparative Example 42 | 120 | 0.66 | 0.70 | 1000 |
| Comparative Example 43 | 150 | 0.90 | 0.97 | 100 |
| Comparative Example 44 | 100 | 0.75 | 0.82 | 300 |
| Comparative Example 45 | 150 | 0.87 | 0.98 | 100 |
| Comparative Example 46 | 100 | 0.73 | 0.80 | 350 |
| Comparative Example 47 | 160 | 0.88 | 0.97 | 100 |
| Comparative Example 48 | 100 | 0.73 | 0.82 | 300 |
| Comparative Example 49 | 170 | 0.87 | 0.97 | 100 |
| Comparative Example 50 | 90 | 0.77 | 0.84 | 300 |
| Comparative Example 51 | 180 | 0.87 | 0.98 | 100 |
| Comparative Example 52 | 110 | 0.77 | 0.84 | 350 |
| Comparative Example 53 | 180 | 0.87 | 0.97 | 100 |

TABLE 16-continued

| | Potential variation (V) | Initial torque relative value | Torque relative value after repeated use of 2,000 sheets of paper | Particle size (nm) |
|---|---|---|---|---|
| Comparative Example 54 | 100 | 0.75 | 0.82 | 350 |
| Comparative Example 55 | 170 | 0.90 | 0.99 | 100 |
| Comparative Example 56 | 100 | 0.80 | 0.87 | 300 |
| Comparative Example 57 | 60 | 0.60 | 0.98 | 100 |
| Comparative Example 58 | 50 | 0.75 | 0.88 | 300 |
| Comparative Example 59 | 70 | 0.65 | 0.98 | 100 |
| Comparative Example 60 | 50 | 0.75 | 0.85 | 300 |
| Comparative Example 61 | 60 | 0.80 | 0.87 | 300 |
| Comparative Example 62 | 50 | 0.60 | 0.98 | 100 |
| Comparative Example 63 | 80 | 0.60 | 0.99 | 100 |
| Comparative Example 64 | 60 | 0.75 | 0.88 | 350 |
| Comparative Example 65 | 70 | 0.65 | 0.98 | 100 |
| Comparative Example 66 | 60 | 0.77 | 0.90 | 350 |
| Comparative Example 67 | 60 | 0.67 | 0.99 | 100 |
| Comparative Example 68 | 50 | 0.75 | 0.85 | 350 |
| Comparative Example 69 | 60 | 0.65 | 0.98 | 100 |
| Comparative Example 70 | 50 | 0.75 | 0.85 | 300 |
| Comparative Example 71 | 45 | 0.60 | 0.98 | — |
| Comparative Example 72 | 40 | 0.65 | 0.99 | — |
| Comparative Example 73 | 50 | 0.63 | 0.98 | — |
| Comparative Example 74 | 35 | 0.60 | 0.98 | — |
| Comparative Example 75 | 40 | 0.65 | 0.97 | — |
| Comparative Example 76 | 45 | 0.65 | 0.97 | — |
| Comparative Example 77 | 45 | 0.65 | 0.98 | — |
| Comparative Example 78 | 100 | 0.70 | 0.88 | — |
| Comparative Example 79 | 110 | 0.75 | 0.90 | — |
| Comparative Example 80 | 100 | 0.75 | 0.90 | — |
| Comparative Example 81 | 120 | 0.70 | 0.85 | — |
| Comparative Example 82 | 120 | 0.70 | 0.85 | — |
| Comparative Example 83 | 150 | 0.75 | 0.90 | — |
| Comparative Example 84 | 150 | 0.68 | 0.72 | 400 |
| Comparative Example 85 | 140 | 0.65 | 0.69 | 400 |
| Comparative Example 86 | 150 | 0.65 | 0.69 | 400 |
| Comparative Example 87 | 160 | 0.70 | 0.74 | 400 |
| Comparative Example 88 | 160 | 0.68 | 0.72 | 400 |
| Comparative Example 89 | 150 | 0.65 | 0.69 | 400 |
| Comparative Example 90 | 120 | 0.85 | 0.92 | 200 |
| Comparative Example 91 | 110 | 0.85 | 0.93 | 200 |

TABLE 16-continued

| | Potential variation (V) | Initial torque relative value | Torque relative value after repeated use of 2,000 sheets of paper | Particle size (nm) |
|---|---|---|---|---|
| Comparative Example 92 | 120 | 0.85 | 0.95 | 200 |
| Comparative Example 93 | 150 | 0.85 | 0.93 | 200 |
| Comparative Example 94 | 150 | 0.85 | 0.94 | 200 |
| Comparative Example 95 | 160 | 0.85 | 0.95 | 200 |

A comparison between Examples and Comparative Examples 1 to 21 reveals that, in the case where the resin [α1] was not contained and a siloxane resin having a siloxane moiety at the end one including low siloxane moiety content was contained, the effect of reducing contact stress is insufficient. This is shown by the fact that the effect of reducing the torque was insufficient in evaluation after repeated use of 2,000 sheets of the paper in this evaluation method. This is probably because the content of the siloxane resin having a siloxane moiety at the end one was low, and hence, first, the resin [α2] and part of the siloxane resin having a siloxane moiety at the end one did not enter the domain but transferred to the surface. Further, the effect of reducing contact stress was insufficient (torque relative value after repeated use of 2,000 sheets of paper) because the siloxane resin having a siloxane moiety at the end one had insufficient lubricity, resulting in an insufficient sustained effect of reducing contact stress. Meanwhile, in Comparative Examples 1, 4, 7, 10, 13, 16, and 19, formation of the matrix-domain structure was not confirmed. This is probably because the content of the siloxane resin having a siloxane moiety at the end one was low, and hence, first, the resin [α2] did not enter the domain but transferred to the surface. Further, the domain was not formed and the effect of reducing contact stress was insufficient (torque relative value after repeated use of 2,000 sheets of paper) because the content of the siloxane resin having a siloxane moiety at the end one was low, resulting in an insufficient sustained effect of reducing contact stress.

A comparison between Examples and Comparative Examples 22 to 42 reveals that, in the case where the resin [α1] was not contained and a siloxane resin having a siloxane moiety at the end one including high siloxane moiety content was contained, the potential stability in repeated use was lowered. This is probably because, although the matrix-domain structure was formed, the siloxane resin having a siloxane moiety at the end one had an excessive amount of the siloxane moiety, and hence the function of the domain as a surfactant was insufficient, resulting in insufficient stability of the domain. This caused aggregation of the charge-transporting substance in the vicinity of the domain, resulting in an insufficient effect of the potential stability in repeated use.

A comparison between Examples and Comparative Examples 43 to 56 reveals that, in the case where the component [α] content was less than 60% by mass with respect to the total mass of the resin having a siloxane moiety at the end in the charge-transporting layer and a large amount of a siloxane resin having a siloxane moiety at the both ends including low siloxane moiety content was contained, the potential stability in repeated use was insufficient. This is probably because the component [α] content with respect to the total mass of the resin having a siloxane moiety at the end was low and the content of the siloxane resin having a siloxane moiety at the both ends was low, and hence the siloxane resin having a siloxane moiety at the both ends was dispersed in the matrix. As a result, the matrix contained a large amount of the siloxane resin having a siloxane moiety at the both ends, and the charge-transporting substance became liable to aggregate, resulting in a large potential variation.

A comparison between Examples and Comparative Examples 57 to 70 reveals that, in the case where the component [α] content was less than 60% by mass with respect to the total mass of the resin having a siloxane moiety at the end in the charge-transporting layer and a large amount of a siloxane resin having a siloxane moiety at the both ends including large siloxane moiety content was contained, the effect of reducing contact stress was insufficient. This is shown by the fact that the effect of reducing a torque relative value was insufficient in evaluation after repeated use of 2,000 sheets of paper in this evaluation method. This is probably because the component [α] content with respect to the resin having a siloxane moiety at the end was low and the content of the siloxane resin having a siloxane moiety at the both ends was too high, and hence the siloxane resin having a siloxane moiety at the both ends did not enter the domain but transferred to the surface. As a result, the amount of the domain decreased, resulting in an insufficient effect of reducing contact stress (torque relative value after repeated use of 2,000 sheets of paper), and the sustained effect of reducing contact stress was not obtained.

A comparison between Examples and Comparative Examples 71 to 77 reveals that a domain was formed when the resin [α1] was contained, resulting in the sustained effect of reducing contact stress. This is probably because, when the resin [a1] formed the domain, the resin played a role as a surfactant within the matrix.

A comparison between Examples and Comparative Examples 78 to 83 reveals that an excellent balance between sustained reduction of contact stress and potential stability in repeated use was achieved when the resin [β] was contained. This is probably because, when the matrix-domain structure was formed by the component [β] contained, compatibility between the matrix and the charge-transporting substance was maintained while functional separation of the effect of reducing contact stress by the siloxane moiety in the domain was introduced.

A comparison between Examples and Comparative Examples 84 to 89 reveals that, when the charge-transporting substance shown in the present invention was used together with the resin of the present invention, an excellent balance between sustained reduction of contact stress and potential stability in repeated use was achieved. This is probably because the component [γ] in the present invention has high compatibility with the resin in the charge-transporting layer. Therefore, in Comparative Examples 84 to 89, the component [γ] having high compatibility with the resin in the charge-transporting layer contained a large amount of the charge-transporting substance in the domain including the siloxane-containing resin, and as a result, an aggregate state of the charge-transporting substance was formed in the domain, resulting in insufficient potential stability. However, in Examples, compatibility between the component [α] and the component [γ] of the present invention was low, and hence the charge-transporting substance content in the domain decreased, resulting in an excellent effect for the potential stability in repeated use.

In Comparative Examples 90 to 95, when the silicone oil having an effect of reducing contact stress was used, formation of a domain was confirmed in the charge-transporting layer. However, the sustained effect of reducing contact stress and the effect of the potential stability in repeated use were insufficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-244360, filed Oct. 29, 2010 and Japanese Patent Application No. 2011-120704, filed May 30, 2011 which are hereby incorporated by reference herein in their entirety.

The invention claimed is:

1. An electrophotographic photosensitive member, comprising:

a conductive support, a charge-generating layer which is provided on the conductive support and comprises a charge-generating substance, and a charge-transporting layer which is provided on the charge-generating layer and is a surface layer of the electrophotographic photosensitive member;

wherein the charge-transporting layer comprises a resin having a siloxane moiety at the end one or both ends, and has a matrix-domain structure having:

a domain which comprises the component α; and a matrix which comprises the component β and the component γ;

wherein the content of the component a is not less than 60% by mass and not more than 100% by mass relative to the total mass of the resin having a siloxane moiety at the end one or both ends in the charge-transporting layer;

wherein the component a consists of a resin a1, or the resin α1 and a resin α2, and the content of the resin α1 is not less than 0.1% by mass and not more than 100% by mass relative to the total mass of the component α;

wherein the resin α1 is at least one resin selected from the group consisting of a resin having a structure represented by the following formula (B), and a resin having a structure represented by the following formula (C), and the content of a siloxane moiety in the resin α1 is not less than 5% by mass and not more than 30% by mass relative to the total mass of the resin α1;

(B)

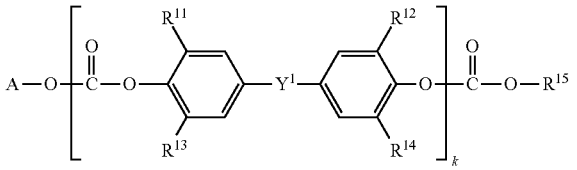

wherein, in the formula (B), $R^{11}$ to $R^{14}$ each independently represents a hydrogen atom, or a methyl group, $R^{15}$ represents a structure represented by the following formula (R15-1) or (R15-2), $Y^1$ represents a single bond, a methylene group, an ethylidene group, a propylidene group, a phenylethylidene group, a cyclohexylidene group, or an oxygen atom, "k" represents number of repetitions of a structure within the brackets, "A" represents a structure represented by the following formula (A);

(R15-1)

(R15-2)

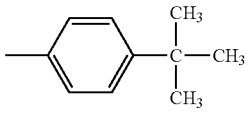

(C)

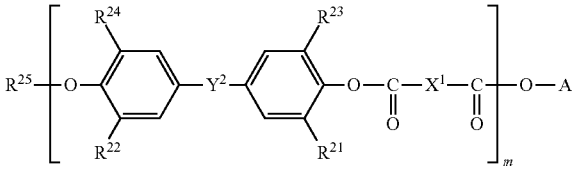

wherein, in the formula (C), $R^{21}$ to $R^{24}$ each independently represents a hydrogen atom, or a methyl group, $R^{25}$ represents a structure represented by the following formula (R25-1), (R25-2), or (R25-3), $X^1$ and $X^2$ each independently represents a meta-phenylene group, a para-phenylene group, or a bivalent group having two para-phenylene groups bonded with an oxygen atom, $Y^2$ represents a single bond, a methylene group, an ethylidene group, a propylidene group, a cyclohexylidene group, or an oxygen atom, "m" represents number of repetitions of a structure within the brackets, "A" represents a structure represented by the following formula (A):

(R25-1)

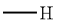

(R25-2)

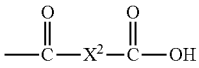

(R25-3)

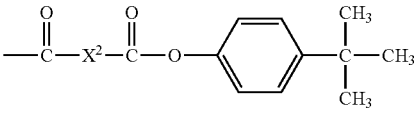

(A)

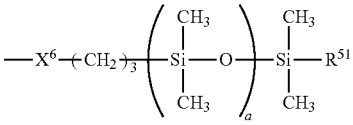

wherein, in the formula (A), $R^{51}$ represents an alkyl group having 1 to 4 carbon atoms, $X^6$ represents a phenylene group or a structure represented by the following formula (A2), "a" in the formula (A) and "b" in the formula (A2) each represents number of repetitions of a structure within the brackets, an average of "a" in the resin α1 or the resin α2 ranges from 10 to 400, an average of "b" in the resin α1 or the resin α2 ranges from 1 to 10;

(A2)

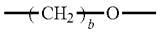

wherein the resin α2 is at least one resin selected from the group consisting of a resin having a structure represented by the following formula (D), and a resin having a structure represented by the following formula (E), and the content of a siloxane moiety in the resin α2 is not less than 5% by mass and not more than 60% by mass relative to the total mass of the resin α2;

(D)

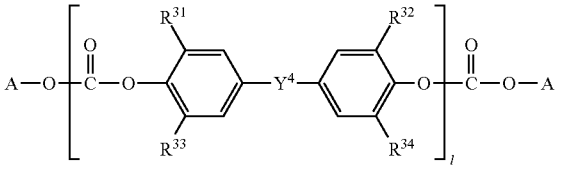

wherein, in the formula (D), $R^{31}$ to $R^{34}$ each independently represents a hydrogen atom, or a methyl group, $Y^3$ represents a single bond, a methylene group, an ethylidene group, a propylidene group, a phenylethylidene group, a cyclohexylidene group, or an oxygen atom, "1" represents number of repetitions of a structure within the brackets, "A" represents a structure represented by the formula (A);

(E)

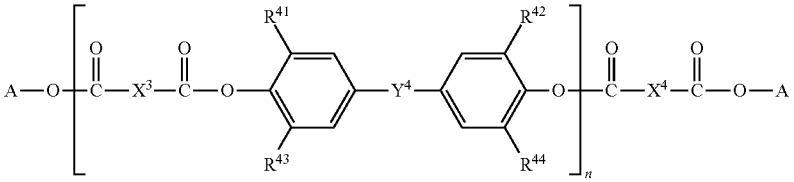

wherein, in the formula (E), $R^{41}$ to $R^{44}$ each independently represents a hydrogen atom, or a methyl group, $X^3$ and $X^4$ each independently represents a meta-phenylene group, a para-phenylene group, or a bivalent group having two para-phenylene groups bonded with an oxygen atom, $Y^4$ represents a single bond, a methylene group, an ethylidene group, a propylidene group, a cyclohexylidene group, or an oxygen atom, "n" represents number of repetitions of a structure within the brackets, "A" represents a structure represented by the formula (A):

wherein the component β is the at least one resin selected from the group consisting of a polycarbonate resin F having a repeating structural unit represented by the following formula (F) and a polyester resin G having a repeating structural unit represented by the following formula (G);

(F)

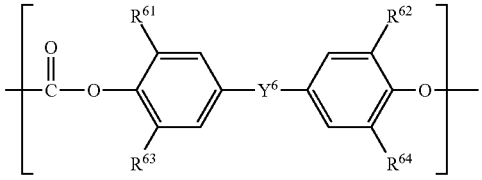

wherein, in the formula (F), $R^{61}$ to $R^{64}$ each independently represents a hydrogen atom, or a methyl group, $Y^6$ represents a single bond, a methylene group, an ethylidene group, a propylidene group, a phenylethylidene group, a cyclohexylidene group, or an oxygen atom;

(G)

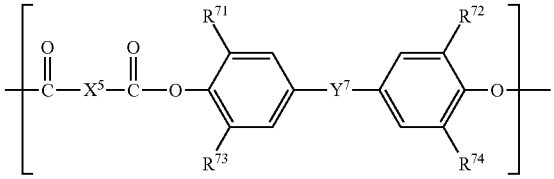

wherein, in the formula (G), $R^{71}$ to $R^{74}$ each independently represents a hydrogen atom, or a methyl group, $X^5$ represents a meta-phenylene group, a para-phenylene group, or a bivalent group having two para-phenylene groups bonded with an oxygen atom, $Y^7$ represents a single bond, a methylene group, an ethylidene group, a propylidene group, a cyclohexylidene group, or an oxygen atom;

wherein the component γ is at least one charge-transporting substance selected from the group consisting of a compound represented by the following formula (1), a compound represented by the following formula (1'), a compound represented by the following formula (2) and a compound represented by the following formula (2');

(1)

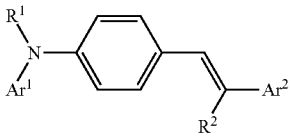

-continued (1')

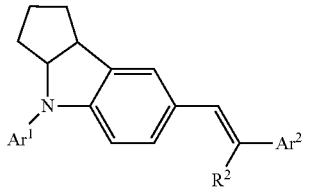

wherein, in the formulae (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a methyl group; and

3. An electrophotographic photosensitive member, comprising:

a conductive support, a charge-generating layer which is provided on the conductive support and comprises a charge-generating substance, and a charge-transporting layer which is provided on the charge-generating layer and is a surface layer of the electrophotographic photosensitive member;

wherein the charge-transporting layer has a matrix-domain structure having:

a domain which consists of a component α; and a matrix which comprises the component β and the component γ;

wherein the component α is a resin α1, or the resin α1 and a resin α2, and wherein the resin α1 is at least one resin selected from the group consisting of a resin having a structure represented by the following formula (B), and a resin having a structure represented by the following formula (C), and the content of a siloxane moiety in the resin α1 is not less than 5% by mass and not more than 30% by mass relative to the total mass of the resin α1;

(2)

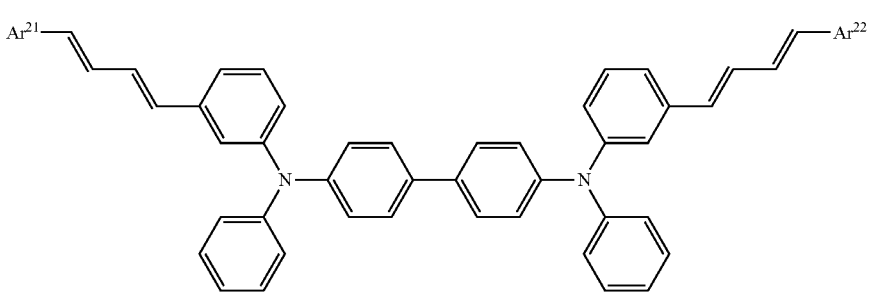

(2')

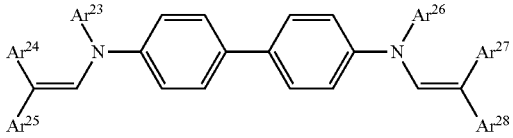

wherein, in the formulae (2) and (2'), $Ar^{21}$, $Ar^{22}$, $Ar^{24}$, $Ar^{25}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

2. The electrophotographic photosensitive member according to claim 1, wherein the content of the resin α1 is not less than 1% by mass and not more than 50% by mass relative to the total mass of the component α.

(B)

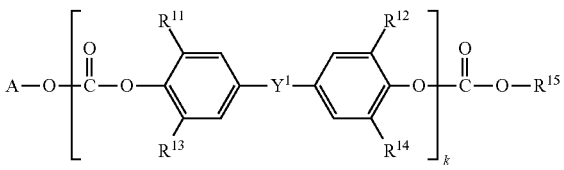

wherein, in the formula (B), $R^{11}$ to $R^{14}$ each independently represents a hydrogen atom, or a methyl group, $R^{15}$ represents a structure represented by the following formula (R15-1) or (R15-2), $Y^1$ represents a single bond, a methylene group, an ethylidene group, a propylidene group, a phenylethylidene group, a cyclohexylidene group, or an oxygen atom, "k" represents number of repetitions of a structure within the brackets, "A" represents a structure represented by the following formula (A);

(R15-1)

(R15-2)

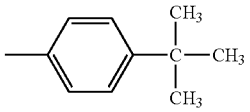

(C)

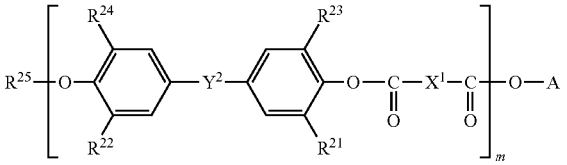

wherein, in the formula (C), $R^{21}$ to $R^{24}$ each independently represents a hydrogen atom, or a methyl group, $R^{25}$ represents a structure represented by the following formula (R25-1),(R25-2), or (R25-3)

$X^1$ and $X^2$ each independently represents a meta-phenylene group, a para-phenylene group, or a bivalent group having two para-phenylene groups bonded with an oxygen atom, $Y^2$ represents a single bond, a methylene group, an ethylidene group, a propylidene group, a cyclohexylidene group, or an oxygen atom, "m" represents number of repetitions of a structure within the brackets, "A" represents a structure represented by the following formula (A):

(R25-1)

(R25-2)

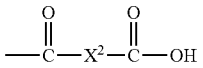

(R25-3)

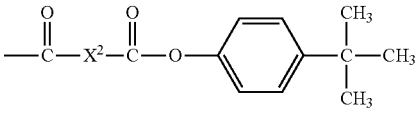

-continued (A)

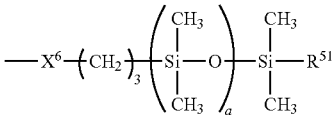

wherein, in the formula (A), $R^{51}$ represents an alkyl group having 1 to 4 carbon atoms, $X^6$ represents a phenylene group or a structure represented by the following formula (A2), "a" in the formula (A) and "b" in the formula (A2) each represents number of repetitions of a structure within the brackets, an average of "a" in the resin α1 or the resin α2 ranges from 10 to 400, an average of "b" in the resin α1 or the resin α2 ranges from 1 to 10;

(A2)

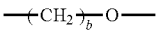

wherein the resin α2 is at least one resin selected from the group consisting of a resin having a structure represented by the following formula (D), and a resin having a structure represented by the following formula (E), and the content of a siloxane moiety in the resin α2 is not less than 5% by mass and not more than 60% by mass relative to the total mass of the resin α2;

(D)

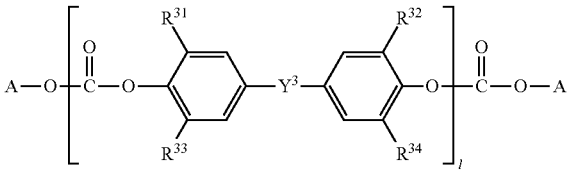

wherein, in the formula (D), $R^{31}$ to $R^{34}$ each independently represents a hydrogen atom, or a methyl group, $Y^3$ represents a single bond, a methylene group, an ethylidene group, a propylidene group, a phenylethylidene group, a cyclohexylidene group, or an oxygen atom, "1" represents number of repetitions of a structure within the brackets, "A" represents a structure represented by the formula (A);

(E)

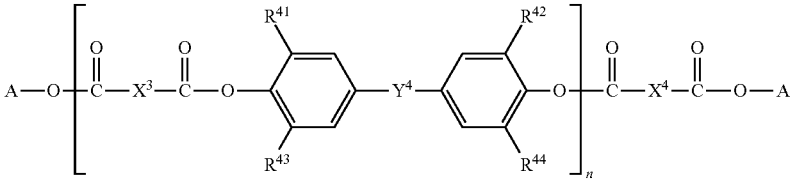

wherein, in the formula (E), $R^{41}$ to $R^{44}$ each independently represents a hydrogen atom, or a methyl group, $X^3$ and $X^4$ each independently represents a meta-phenylene group, a para-phenylene group, or a bivalent group having two para-phenylene groups bonded with an oxygen atom, $Y^4$ represents a single bond, a methylene group, an ethylidene group, a propylidene group, a cyclohexylidene group, or an oxygen atom, "n" represents number of repetitions of a structure within the brackets, "A" represents a structure represented by the formula (A):

wherein the component β is the at least one resin selected from the group consisting of a polycarbonate resin F having a repeating structural unit represented by the following formula (F) and a polyester resin G having a repeating structural unit represented by the following formula (G);

(F)

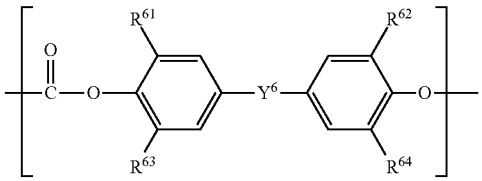

wherein, in the formula (F), $R^{61}$ to $R^{64}$ each independently represents a hydrogen atom, or a methyl group, $Y^6$ represents a single bond, a methylene group, an ethylidene group, a propylidene group, a phenylethylidene group, a cyclohexylidene group, or an oxygen atom;

(G)

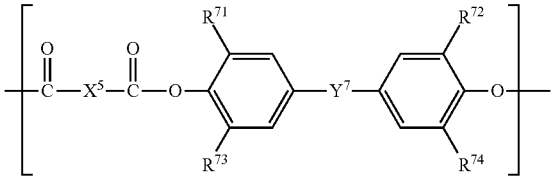

wherein,in the formula (G), $R^{71}$ to $R^{74}$ each independently represents a hydrogen atom, or a methy group, $X^5$ each independently represents a meta-phenylene group, a para-phenylene group, or a bivalent group having two para-phenylene groups bonded with an oxygen atom, $Y^7$ represents a single bond, a methylene group, an ethylidene group, a propylidene group, a cyclohexylidene group, or an oxygen atom;

wherein the component γ is at least one charge-transporting substance selected from the group consisting of a compound represented by the following formula (1) ,a compound represented by the following formula (1'), a compound represented by the following formula (2) and a compound represented by the following formula (2');

(1)

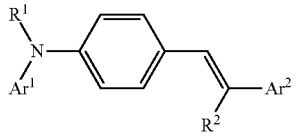

(1')

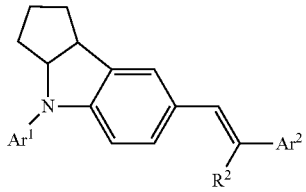

wherein, in the formula (1) and (1'), $Ar^1$ represents a phenyl group, or a phenyl group substituted with a methyl group or an ethyl group, $Ar^2$ represents a phenyl group, a phenyl group substituted with a methyl group, a phenyl group substituted with an univalent group represented by the formula "—CH═CH—Ta", or a biphenyl group substituted with an univalent group represented by the formula "—CH═CH—Ta" (where, Ta represents an univalent group derived from a benzene ring of a triphenylamine by loss of one hydrogen atom, or derived from a benzene ring of a triphenylamine substituted with a methyl group or an ethyl group by loss of one hydrogen atom), $R^1$ represents a phenyl group, a phenyl group substituted with a methyl group, or a phenyl group substituted with an univalent group represented by the formula "—CH═C($Ar^3$)$Ar^4$" (where, $Ar^3$ and $Ar^4$ each independently represents a phenyl group or a phenyl group substituted with a methyl group), and $R^2$ represents a hydrogen atom, a phenyl group, or a phenyl group substituted with a metyl group;

(2)

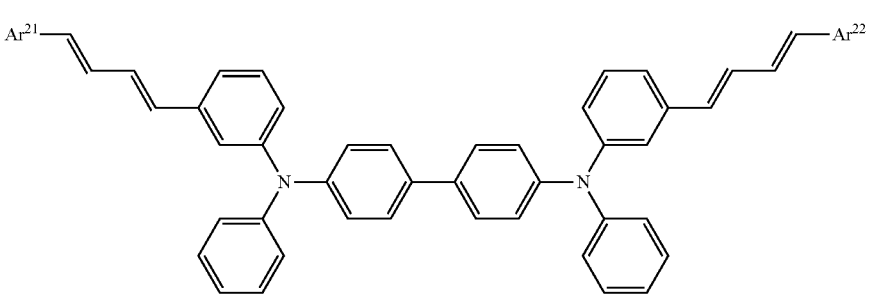

-continued (2')

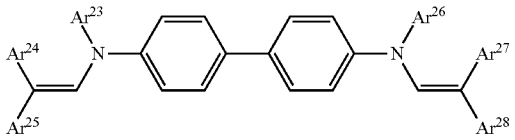

wherein, in the formula (2) and (2'), $Ar^{21}$, $Ar^{22}$, $Ar^{24}$, $Ar^{27}$, and $Ar^{28}$ each independently represents a phenyl group or a tolyl group, $Ar^{23}$ and $Ar^{26}$ each independently represents a phenyl group or a phenyl group substituted with a methyl group.

4. A process cartridge detachably attachable to a main body of an electrophotographic apparatus, wherein the process cartridge integrally supports:

the electrophotographic photosensitive member according claim 1; and at least one device selected from the group consisting of a charging device, a developing device, a transferring device, and a cleaning device.

5. An electrophotographic apparatus, comprising:

the electrophotographic photosensitive member according to claim 1; a charging device; an exposing device; a developing device; and a transferring device.

6. A method of manufacturing the electrophotographic photosensitive member according to claim 1, wherein the method comprises a step of forming the charge-transporting layer by applying a charge-transporting-layer coating solution on the charge-generating layer and drying the coating solution, and wherein the charge-transporting-layer coating solution comprises the component α, the component β and the component γ.

* * * * *